US012480740B2

(12) United States Patent
Freeman et al.

(10) Patent No.: US 12,480,740 B2
(45) **Date of Patent: *Nov. 25, 2025**

(54) TWO-PART FOLDING TRIGGER FOR A FOLDING FIREARM

(71) Applicant: Magpul Industries Corp., Austin, TX (US)

(72) Inventors: Zachary Freeman, Broomfield, CO (US); Nicholas Kielsmeier, Denver, CO (US)

(73) Assignee: Magpul Industries Corp., Austin, TX (US)

( * ) Notice: Subject to any disclaimer, the term of this patent is extended or adjusted under 35 U.S.C. 154(b) by 1360 days.

This patent is subject to a terminal disclaimer.

(21) Appl. No.: 17/108,384

(22) Filed: Jan. 7, 2021

(65) Prior Publication Data

US 2021/0254927 A1 Aug. 19, 2021

Related U.S. Application Data

(60) Continuation-in-part of application No. 16/799,962, filed on Feb. 25, 2020, now Pat. No. 10,900,741,
(Continued)

(51) Int. Cl.
*F41C 23/04* (2006.01)
*F41A 3/66* (2006.01)
(Continued)

(52) U.S. Cl.
CPC ..... *F41C 23/04* (2013.01); *F41A 3/66* (2013.01); *F41A 3/72* (2013.01); *F41A 11/04* (2013.01);
(Continued)

(58) Field of Classification Search
CPC ..... F41C 23/04
See application file for complete search history.

(56) References Cited

U.S. PATENT DOCUMENTS 1,059,405 A 4/1913 Sprague
1,454,454 A 5/1923 Rosier
(Continued)

FOREIGN PATENT DOCUMENTS

CA 2970349 A1 6/2015
CA 3025163 A1 12/2017
(Continued)

OTHER PUBLICATIONS

Schwingel, Dirk, "Partial Supplementary European Search Report Regarding Application No. 18895647.8", Mar. 22, 2021, pp. 13, Published in: EP.
(Continued)

*Primary Examiner* — Reginald S Tillman, Jr.
(74) *Attorney, Agent, or Firm* — INOD Law PC

(57) ABSTRACT

The present disclosure describes a foldable firearm that collapses into a folded state under spring pressure. The foldable firearm may include a foldable grip assembly. The foldable grip assembly may include a foldable pistol grip, a foldable trigger assembly, a folding bar, and a foldable hand stop. The foldable grip assembly may fold into the housing of the foldable firearm. The foldable grip assembly may include a two-part folding trigger a part of which folds forward when the platform folds, to compress the vertical profile of the platform and also to present an inherent safety in the stowed configuration. The foldable firearm can also include a manual safety accessible from outside a housing of the platform that renders a trigger bar incapable of movement and release of the striking mechanism when the safety is engaged.

18 Claims, 41 Drawing Sheets

Related U.S. Application Data which is a continuation of application No. 16/584,133, filed on Sep. 26, 2019, now Pat. No. 10,612,887, which is a division of application No. 16/228,600, filed on Dec. 20, 2018, now Pat. No. 10,443,971.

(60) Provisional application No. 63/033,370, filed on Jun. 2, 2020, provisional application No. 62/610,731, filed on Dec. 27, 2017.

(51) Int. Cl.

| | |
|---|---|
| ***F41A 3/72*** | (2006.01) |
| ***F41A 11/04*** | (2006.01) |
| ***F41A 35/06*** | (2006.01) |
| ***F41C 9/02*** | (2006.01) |
| ***F41C 23/12*** | (2006.01) |
| ***F41C 33/08*** | (2006.01) |

(52) U.S. Cl.

CPC ..... *F41A 35/06* (2013.01); *F41C 9/02* (2013.01); *F41C 23/12* (2013.01); *F41C 33/08* (2013.01)

(56) References Cited

U.S. PATENT DOCUMENTS

| | | | |
|---|---|---|---|
| D118,916 | S | 2/1940 | Stone |
| 3,619,930 | A | 11/1971 | Beermann et al. |
| 3,979,850 | A | 9/1976 | Schiessl et al. |
| 4,271,623 | A | 6/1981 | Beretta |
| 4,299,046 | A | 11/1981 | Atchisson |
| 4,413,546 | A | 11/1983 | Taylor, Jr. |
| 4,539,889 | A | 9/1985 | Glock |
| 4,625,621 | A | 12/1986 | Warin |
| 4,689,908 | A | 9/1987 | McClellan |
| 4,825,744 | A | 5/1989 | Glock |
| 4,893,546 | A | 1/1990 | Glock |
| 5,088,222 | A | 2/1992 | Larson |
| 5,293,708 | A | 3/1994 | Strayer et al. |
| 5,305,539 | A | 4/1994 | Kuster |
| 5,483,766 | A | 1/1996 | Hochstrate et al. |
| 5,669,169 | A | 9/1997 | Schmitter et al. |
| 5,671,560 | A | 9/1997 | Meller |
| 5,717,156 | A | 2/1998 | Lenkarski |
| 5,758,524 | A | 6/1998 | Yu |
| 6,212,812 | B1 | 4/2001 | Aigner |
| 6,234,058 | B1 | 5/2001 | Morgado |
| 6,234,059 | B1 | 5/2001 | Fuchs et al. |
| 6,253,479 | B1 | 7/2001 | Fuchs et al. |
| 6,257,116 | B1 | 7/2001 | Moczijdlower et al. |
| 6,260,301 | B1 | 7/2001 | Aigner et al. |
| 6,354,032 | B1 | 3/2002 | Viani |
| 6,357,157 | B1 | 3/2002 | Constant et al. |
| 6,401,379 | B1 | 6/2002 | Moon |
| 6,421,944 | B1 | 7/2002 | Klebes et al. |
| 6,470,617 | B1 | 10/2002 | Gregory et al. |
| 6,513,273 | B2 | 2/2003 | da Silveira |
| 6,560,909 | B2 | 5/2003 | Cominolli |
| 6,718,680 | B2 | 4/2004 | Roca et al. |
| 6,789,342 | B2 | 9/2004 | Wonisch et al. |
| 6,843,013 | B2 | 1/2005 | Cutini |
| 6,865,979 | B1 | 3/2005 | Vaid |
| 7,204,051 | B2 | 4/2007 | Thomele et al. |
| 7,213,359 | B2 | 5/2007 | Beretta |
| 7,234,261 | B2 | 6/2007 | McGarry |
| 7,243,453 | B2 | 7/2007 | McGarry |
| 7,357,058 | B1 | 4/2008 | Olcott |
| 7,383,657 | B2 | 6/2008 | Pikielny |
| 7,472,507 | B2 | 1/2009 | Curry et al. |
| 7,500,327 | B2 | 3/2009 | Bubits |
| 7,600,340 | B2 | 10/2009 | Curry et al. |
| 7,703,230 | B2 | 4/2010 | Curry et al. |
| 7,726,059 | B2 | 6/2010 | Pikielny |
| 7,739,821 | B1 | 6/2010 | Hamme |
| 7,810,268 | B1 | 10/2010 | Mcgarry |
| 7,810,269 | B2 | 10/2010 | Zukowski et al. |
| 7,900,546 | B2 | 3/2011 | Bordson |
| 7,941,954 | B2 | 5/2011 | Carr et al. |
| 7,941,956 | B2 | 5/2011 | Carr et al. |
| 7,941,957 | B2 | 5/2011 | Carr et al. |
| 8,006,425 | B2 | 8/2011 | Burt et al. |
| 8,033,043 | B2 | 10/2011 | McGarry |
| 8,051,594 | B2 | 11/2011 | Carr et al. |
| 8,127,481 | B2 | 3/2012 | Rozum et al. |
| 8,132,496 | B2 | 3/2012 | Zukowski |
| 8,156,677 | B2 | 4/2012 | Glock |
| 8,196,328 | B2 | 6/2012 | Simpkins |
| 8,266,998 | B1 | 9/2012 | Davis |
| 8,276,302 | B2 | 10/2012 | Zukowski |
| 8,296,990 | B2 | 10/2012 | Zukowski et al. |
| 8,333,028 | B1 | 12/2012 | Karfiol et al. |
| 8,333,142 | B1 | 12/2012 | Karfiol et al. |
| 8,356,537 | B2 | 1/2013 | Kincel |
| 8,448,366 | B2 | 5/2013 | Faifer |
| 8,464,455 | B2 | 6/2013 | Kallio |
| 8,468,732 | B2 | 6/2013 | Young |
| 8,510,980 | B2 | 8/2013 | Lee |
| 8,539,871 | B1 | 9/2013 | Burt et al. |
| 8,549,780 | B2 | 10/2013 | Emde et al. |
| 8,567,301 | B1 | 10/2013 | Sharron |
| 8,650,789 | B2 | 2/2014 | Dionne et al. |
| 8,650,790 | B2 | 2/2014 | Dionne et al. |
| 8,661,722 | B2 | 3/2014 | Dionne et al. |
| 8,667,882 | B1 | 3/2014 | Larson et al. |
| 8,667,883 | B1 | 3/2014 | Larson et al. |
| 8,819,978 | B2 | 9/2014 | Lee |
| 8,863,632 | B1 | 10/2014 | O'Malley |
| 8,887,432 | B2 | 11/2014 | Oz |
| 8,899,138 | B2 | 12/2014 | Brown |
| 8,935,871 | B2 | 1/2015 | Bardy |
| 8,960,066 | B2 | 2/2015 | Gomez |
| 8,966,797 | B2 | 3/2015 | Carlson |
| 8,997,620 | B2 | 4/2015 | Brown |
| 9,021,734 | B2 | 5/2015 | Voigt |
| 9,074,831 | B2 | 7/2015 | Glock |
| 9,146,065 | B2 | 9/2015 | Lee |
| 9,188,400 | B2 | 11/2015 | Crouse |
| 9,222,738 | B2 | 12/2015 | Asher et al. |
| 9,222,745 | B2 | 12/2015 | Kallio |
| 9,239,207 | B2 | 1/2016 | Kresser |
| 9,273,927 | B2 | 3/2016 | Bondhus et al. |
| 9,291,416 | B2 | 3/2016 | Wurkner |
| 9,297,613 | B2 | 3/2016 | Maentymaa |
| 9,303,936 | B2 | 4/2016 | Toner |
| 9,341,425 | B2 | 5/2016 | Carlson |
| 9,377,260 | B2 | 6/2016 | Locher et al. |
| 9,383,153 | B2 | 7/2016 | Nebeker et al. |
| 9,435,598 | B2 | 9/2016 | Seckman et al. |
| 9,441,897 | B2 | 9/2016 | Mather et al. |
| 9,448,023 | B2 | 9/2016 | Sheets, Jr. et al. |
| 9,546,843 | B2 | 1/2017 | Sroufe et al. |
| 9,625,227 | B2 | 4/2017 | Lee et al. |
| 9,677,836 | B2 | 6/2017 | Lee et al. |
| 9,714,804 | B2 | 7/2017 | Singh |
| 9,726,449 | B2 | 8/2017 | Spinner et al. |
| 9,733,030 | B2 | 8/2017 | Daniel et al. |
| 9,739,549 | B2 | 8/2017 | Kincel |
| 9,810,497 | B2 | 11/2017 | Carlson |
| 9,829,262 | B1 | 11/2017 | Suttie et al. |
| 9,835,411 | B2 | 12/2017 | Larson, Jr. et al. |
| 9,857,134 | B1 | 1/2018 | Karfiol et al. |
| 9,909,826 | B2 | 3/2018 | Kincel |
| 9,927,200 | B2 | 3/2018 | Kuracina et al. |
| 9,945,629 | B2 | 4/2018 | Osborne |
| 9,970,726 | B1 | 5/2018 | Hubert et al. |
| 10,006,728 | B2 | 6/2018 | Bailey |
| 10,012,461 | B2 | 7/2018 | Curry |
| 10,030,924 | B1 | 7/2018 | Smith |
| 10,030,927 | B1 | 7/2018 | Theiss |
| 10,060,693 | B2 | 8/2018 | Bubits et al. |
| D832,388 | S | 10/2018 | McNally et al. |
| 10,113,822 | B1 | 10/2018 | Hobush |
| 10,119,777 | B2 | 11/2018 | Wolf et al. |

(56) References Cited

U.S. PATENT DOCUMENTS 10,126,079 B2 11/2018 Voigt
10,126,086 B2 11/2018 Smith et al.
10,139,177 B2 11/2018 Giesen et al.
10,151,556 B2 12/2018 Kjellberg
10,156,421 B2 12/2018 Smith et al.
10,161,709 B1 12/2018 Wright
10,175,019 B1 1/2019 Al-Mutawa
10,184,736 B2 1/2019 Fumia et al.
10,209,019 B2 2/2019 Dechant et al.
10,240,880 B1 3/2019 Viani
10,254,059 B1 4/2019 Fellows et al.
10,274,276 B2 4/2019 Full
D849,869 S 5/2019 Kielsmeier et al.
10,288,369 B2 5/2019 Albury et al.
10,309,742 B1 6/2019 Viani
10,352,635 B2 7/2019 Noonan
10,359,247 B1 7/2019 Ballard
10,359,250 B2 7/2019 Carlson et al.
10,365,059 B2 7/2019 Sroufe et al.
10,371,474 B2 8/2019 Young
10,378,847 B2 8/2019 Folk et al.
10,393,456 B1 8/2019 Beardsley
10,415,905 B2 9/2019 Bubits et al.
10,415,916 B2 9/2019 Cusano
10,422,602 B2 9/2019 Theiss
10,443,971 B2 10/2019 Kielsmeier et al.
10,451,369 B1 10/2019 Hunt et al.
10,488,132 B2 11/2019 Full
10,551,142 B1 2/2020 Wright
10,551,143 B2 2/2020 Kielsmeier et al.
10,578,382 B1 3/2020 Melnikov
10,612,870 B2 4/2020 Borges et al.
10,612,887 B1 4/2020 Kielsmeier et al.
10,619,960 B2 4/2020 Cross
10,627,189 B2 4/2020 Faifer
10,641,567 B2 5/2020 Weilharter et al.
10,641,568 B2 5/2020 Zinsner et al.
10,655,925 B2 5/2020 Carr
10,663,243 B2 5/2020 Timmons et al.
10,663,245 B2 5/2020 Folk et al.
10,677,551 B2 6/2020 Drake
10,690,428 B1 6/2020 Vestbom et al.
10,697,721 B2 6/2020 Kincel
10,697,724 B2 6/2020 Cochran et al.
10,704,851 B1 7/2020 Redillo
10,704,860 B2 7/2020 Hall
10,718,585 B2 7/2020 Ballard
10,739,090 B2 8/2020 Borges et al.
10,753,694 B2 8/2020 Unger et al.
10,760,874 B2 9/2020 Kjellberg
10,794,646 B2 10/2020 Fellows et al.
10,794,661 B2 10/2020 Irvin et al.
10,823,517 B1 11/2020 Brandly et al.
10,837,727 B2 11/2020 Lee
10,845,156 B1 11/2020 Fortin
10,871,344 B2 12/2020 Brown, Jr. et al.
10,871,345 B2 12/2020 Faifer
10,876,806 B2 12/2020 Lee
10,876,814 B1 12/2020 Visser
10,895,428 B2 1/2021 Sessions et al.
10,900,741 B2 1/2021 Kielsmeier et al.
10,928,159 B2 2/2021 Vanek et al.
10,955,209 B2 3/2021 Wolf et al.
10,962,313 B2 3/2021 Noonan et al.
10,996,011 B2 5/2021 Mccallum et al.
11,022,386 B2 6/2021 Muska
11,029,109 B2 6/2021 Golan
11,029,110 B2 6/2021 Curry et al.
11,262,159 B2 3/2022 Kielsmeier et al.
11,680,771 B2 6/2023 Kielsmeier et al.
12,000,671 B2 * 6/2024 Kielsmeier ..... F41C 23/04
2008/0060247 A1 3/2008 Thomele et al.
2009/0064556 A1 3/2009 Fluhr et al.
2009/0071053 A1 3/2009 Thomele et al.
2009/0277066 A1 11/2009 Burt et al.
2011/0107648 A1 5/2011 Tuz
2012/0006188 A1 1/2012 Kincel
2012/0174454 A1 7/2012 Kallio
2012/0180647 A1 7/2012 Dublin
2013/0111795 A1 5/2013 Dionne et al.
2013/0111796 A1 5/2013 Dionne et al.
2013/0174457 A1 7/2013 Gangl et al.
2014/0060293 A1 3/2014 Gomez
2014/0075816 A1 3/2014 Larson et al.
2014/0150316 A1 6/2014 Acarreta
2015/0316346 A1 11/2015 Brandt
2016/0178298 A1 6/2016 Daniel et al.
2016/0187090 A1 6/2016 Mather et al.
2017/0045329 A1 2/2017 Turnington
2017/0131052 A1 5/2017 Voigt
2017/0321980 A1 11/2017 Wolf et al.
2017/0336160 A1 11/2017 Walther et al.
2017/0356710 A1 12/2017 Full
2018/0142976 A1 5/2018 Full
2018/0195820 A1 7/2018 Noonan
2018/0224233 A1 8/2018 Macy
2018/0224234 A1 8/2018 Macy
2018/0372437 A1 12/2018 Hudson, III
2019/0011207 A1 1/2019 Al-Mutawa
2019/0024996 A1 1/2019 Borges et al.
2019/0033025 A1 1/2019 Wolf et al.
2019/0033027 A1 1/2019 Voigt
2019/0041158 A1 2/2019 Kjellberg
2019/0154368 A1 5/2019 Kim et al.
2019/0170463 A1 6/2019 Walther et al.
2019/0195595 A1 6/2019 Kielsmeier et al.
2019/0212085 A1 7/2019 Wilkinson et al.
2019/0226783 A1 7/2019 Full
2019/0257602 A1 8/2019 Reynolds
2019/0310036 A1 10/2019 Lucansky et al.
2019/0323795 A1 10/2019 Zimmer
2020/0056853 A1 2/2020 Singh
2020/0080802 A1 3/2020 Jennings
2020/0080805 A1 3/2020 Headrick et al.
2020/0088493 A1 3/2020 Kielsmeier et al.
2020/0103191 A1 4/2020 Macy
2020/0132413 A1 4/2020 Laing Rory et al.
2020/0141677 A1 5/2020 Deaza
2020/0158463 A1 5/2020 Samson et al.
2020/0191508 A1 6/2020 Satzinger et al.
2020/0191509 A1 6/2020 Young
2020/0191510 A1 6/2020 Sessions et al.
2020/0191512 A1 6/2020 Lee
2020/0191514 A1 6/2020 Lee
2020/0191520 A1 6/2020 Kielsmeier et al.
2020/0217604 A1 7/2020 Borges et al.
2020/0232734 A1 7/2020 Herring et al.
2020/0278171 A1 9/2020 Peknik
2020/0318922 A1 10/2020 Curry et al.
2020/0348104 A1 11/2020 Chambers
2020/0363154 A1 11/2020 Lake
2020/0370850 A1 11/2020 O'clair
2021/0033363 A1 2/2021 Regan
2021/0041208 A1 2/2021 Muska
2021/0071977 A1 3/2021 Lee et al.
2021/0080211 A1 3/2021 Barrett et al.
2021/0102777 A1 4/2021 Kielsmeier et al.
2021/0102778 A1 4/2021 Fortin
2021/0116209 A1 4/2021 Faifer
2021/0140738 A1 5/2021 Lynch
2021/0156642 A1 5/2021 Kjellberg
2021/0164752 A1 6/2021 Stewart et al.
2021/0180897 A1 6/2021 Underwood et al.
2021/0180910 A1 6/2021 Porat
2021/0254927 A1 8/2021 Freeman et al.
2021/0318096 A1 10/2021 Rudiuk
2022/0136799 A1 5/2022 Kielsmeier et al.
2023/0304770 A1 9/2023 Kielsmeier et al.

FOREIGN PATENT DOCUMENTS

CA 2863316 C 3/2020
CA 2908702 C 4/2021
CN 111089511 A 5/2020

(56) References Cited

FOREIGN PATENT DOCUMENTS

| | | | |
|---|---|---|---|
| CN | 112066796 | A | 12/2020 |
| CZ | 308750 | B6 | 4/2021 |
| DE | 102010054245 | A1 | 6/2012 |
| DE | 102018132757 | A1 | 6/2020 |
| DE | 102018132756 | B4 | 10/2020 |
| EP | 1870660 | A1 | 12/2007 |
| EP | 1924814 | A1 | 5/2008 |
| EP | 1870660 | B1 | 12/2008 |
| EP | 2171389 | A | 4/2010 |
| EP | 2314976 | A2 | 4/2011 |
| EP | 2661599 | A1 | 11/2013 |
| EP | 2045561 | B1 | 12/2014 |
| EP | 2950033 | A1 | 12/2015 |
| EP | 2950033 | B1 | 11/2016 |
| EP | 3367040 | A1 | 8/2018 |
| EP | 2685202 | B1 | 12/2018 |
| EP | 3472549 | A1 | 4/2019 |
| EP | 3593079 | A1 | 1/2020 |
| EP | 3625513 | A1 | 3/2020 |
| EP | 3449201 | B1 | 4/2020 |
| EP | 3737907 | A1 | 11/2020 |
| EP | 3749910 | A1 | 12/2020 |
| EP | 3625513 | A4 | 2/2021 |
| EP | 3581872 | B1 | 5/2021 |
| ES | 2545229 | B1 | 3/2016 |
| ES | 2751696 | T3 | 4/2020 |
| ES | 2770356 | T3 | 7/2020 |
| FR | 3089002 | B1 | 11/2020 |
| IL | 272421 | A | 8/2020 |
| JP | 4996963 | B2 | 8/2012 |
| KR | 102220398 | B1 | 2/2021 |
| WO | 9521366 | A1 | 8/1995 |
| WO | 2007030843 | A1 | 3/2007 |
| WO | 2009048668 | A1 | 4/2009 |
| WO | 2009051872 | A2 | 4/2009 |
| WO | 2012018316 | A1 | 2/2012 |
| WO | 2012094493 | A1 | 7/2012 |
| WO | 2014035032 | A1 | 3/2014 |
| WO | 2015026427 | A1 | 2/2015 |
| WO | 2015088794 | A1 | 6/2015 |
| WO | 2016125196 | A1 | 8/2016 |
| WO | 2016193841 | A1 | 12/2016 |
| WO | 2017017560 | A1 | 2/2017 |
| WO | 2017044589 | A1 | 3/2017 |
| WO | 2017136838 | A1 | 8/2017 |
| WO | 2017186807 | A1 | 11/2017 |
| WO | 2017217939 | A1 | 12/2017 |
| WO | 2018165149 | A1 | 9/2018 |
| WO | 2018213328 | A1 | 11/2018 |
| WO | 2019159177 | A1 | 8/2019 |
| WO | 2020152375 | A1 | 7/2020 |
| WO | 2020190503 | A1 | 9/2020 |
| WO | 2020264508 | A1 | 12/2020 |
| WO | 2021040638 | A1 | 3/2021 |

OTHER PUBLICATIONS

Yukari Nakamura, "International Preliminary Report on Patentability for International Application No. PCT/US2018/066953", Jul. 9, 2020, pp. 7, Published in: CH.

Young, Lee W., "International Search Report and Written Opinion Regarding International Application No. PCT/US2018/66953", May 3, 2019, pp. 15, Published in: WO.

Tillman, Jr., Reginald, "Office Action Regarding U.S. Appl. No. 16/799,962", Jun. 24, 2020, pp. 24, Published in: US.

Gruber, Stephen, "Response to Office Action Regarding U.S. Appl. No. 16/799,962", Sep. 22, 2020, pp. 10, Published in: US.

Eger, Chris, "4 Folding Submachine Guns We'd Love to Get Our Hands On", Aug. 8, 2017, pp. 3, Publisher: Retrieved from https://www.guns.com/news/2017/08/08/foldable-submachine-guns.

NRA Museum, "Belgian Folding Trigger", Known to exist as early as Apr. 30, 2020, pp. 1.

Kirkpatrick, John, "Glock Manual Safety Kit by Cominolli Custom", Mar. 17, 2011, Downloaded on Jul. 30, 2020 from https://www.usacarry.com/glock-manual-safety-kit-by-cominolli-custom/, pp. 6.

Nicholas C., "Full Conceals Folding Glock Akin to Magpuls FMG9", Jul. 28, 2017, pp. 7, Publisher: Retrieved from https://www.thefirearmblog.com/blog/2017/07/28/full-conceals-folding-glock-akin-magpuls-fmg9/.

Pete, "Uncovered: GEN5 Glock 22 With Manual Safety in Sao Paulo Brazil", Jan. 19, 2018, "Downloaded on Jul. 30, 2020 from https://www.thefirearmblog.com/blog/2018/01/19/gen5-glock-22-sao-paulo/", pp. 33.

Nicholas C, "A Closer Look at the Glock Thumb Safety", Nov. 2, 2018, "Downloaded on Jul. 30, 2020 from https://www.thefirearmblog.com/blog/2018/11/02/a-closer-look-at-the-glock-thumb-safety/", pp. 34.

White, Phil, "Breaking: New Glock 19 MHS 9MM and Glock 23 MHS .40 S and W", Jun. 27, 2017 "Downloaded on Jul. 30, 2020 from https://www.thefirearmblog.com/blog/2017/06/27/glock-19-mhs-23-mhs-photos/", pp. 23.

Full Conceal, "M3D-AL Frame (Glock 19 GEN 3/4/5 Compatible)", Known to exist as early as Apr. 23, 2020, pp. 2, Publisher: Retrieved from https://www.fullconceal.com.

Full Conceal, "M3D Handgun (Based on Glock 19 GEN 4)", "Known to exist as early as Apr. 23, 2020", pp. 1, Publisher: Downloaded from https://www.fullconceal.com.

Full Conceal, "M3D-S6 Bare Frame", "Known to exist as early as Apr. 30, 2020", Publisher: Retrieved from https://www.fullconceal.com.

Grab a Gun, "Full Conceal Viper With M3D Folding Glock Pistol 9MM 21RDS", "Known to exist as early as Apr. 30, 2020", pp. 11, Publisher: https://grabagun.com/fc-viper-m3d-glock-19-9mm-21rd-blk.html.

Full Conceal, "M3S Handgun (Based On Glock 43)", "Known to exist as early as Apr. 23, 2020", pp. 2, Publisher: Retrieved from https://www.fullconceal.com.

Wikipedia, "Magpul FMG-9", Known to exist as early as Dec. 12, 2017, pp. 1, Publisher: Retrieved from https://en.wikipedia.org/wiki/Magpul_FMG-9.

Premier Arms, "Glock Safety Kits", Known to exist as early as Jul. 30, 2020, pp. 7, Publisher: Downloaded on Jul. 30, 2020 from premierarms.com/services/glock_safety_kits.

siderlock.com, "Siderlock", Known to exist as early as Apr. 20, 2020, Publisher: Retrieved from http://www.siderlock.com/.

Tarnhelm Supply Co., Inc., "Glock Manual Safety", Known to exist as early as Jul. 30, 2020, pp. 2, Publisher: Downloaded on Jul. 30, 2020 from www.tarnhelm.com/GlockSafety.html.

Tau Development Group, "Striker Control Device", Known to exist as early as Apr. 20, 2020 , pp. 1, Publisher: Retrieved from https://taudevgroup.myshopify.com/products/striker-control-device.

Ten-Ring Precision, Inc., "Glock Pistol Work", Known to exist as early as Jul. 30, 2020, pp. 6, Publisher: Downloaded on Jul. 30, 2020 from https://tenring.com/glock-pistol-work-2/.

Clipdraw, "Trigger Guard", Known to exist as early as Apr. 20, 2020, pp. 3, Publisher: Retrieved from https://www.clipdraw.com/glock-trigger-safety-products/.

Final Office Action received for U.S. Appl. No. 18/653,250 dated Nov. 8, 2024, 7 pages.

Notice of Allowance received for U.S. Appl. No. 18/653,250 dated Mar. 21, 2025, 5 pages.

"Colt SCW: A Trailblazer for the Seals", State of Guns, 3 pages, <https://stateofguns.com/colt-scw-557/>, Known as early as Jun. 9, 2021.

"Foldar", 2 pages, online available at <https://www.foldar.com/>, Known as early as Jun. 9, 2021.

"Franchi SPAS-12", Wikipedia, 2 pages, online available at <https://en.wikipedia.org/wiki/Franchi_SPAS-12>, Known as early as Jun. 9, 2021.

"Full Conceal", Full Conceal Inc., 4 pages, online avilable at <https://web.archive.org/web/20201030172807/https://www.fullconceal.com/>, known as early as Jun. 9, 2021.

(56) References Cited

OTHER PUBLICATIONS

"H&K G3: The Very First Import (3/62)", Forgotten Weapons, Youtube, 2 pages, online available at <https://www.youtube.com/watch?u=a9xsPJQgBo&t=519s>, Known as early as Mar. 6, 2016.
"Heckler & Koch G36", Wikipedia, 5 pages, online available at <https://en.wikipedia.org/wiki/Heckler_%26_Koch_G36>, Known as early as Jun. 9, 2021.
"Ideal Conceal", 2 pages, online available at <https://www.idealconceal.com/>, Known as early as Jun. 9, 2021.
"Lifecard", Trailblazer Firearms, 2 pages, online avilable at <https://trailblazerfirearms.com/lifecard-gun/>, Known as ? Arty as Jun. 9, 2021.
"M3MOD Shell", Full Conceal Inc., 2 pages, online available at <https://web.archive.org/web/20200222195416/https://www.fullconceal.com/product-page/m3mod-shell/>, Known as early as Feb. 22, 2020.
"MP 40", Wikipedia, 3 pages, online avilable at <https://en.wikipedia.org/wiki/MP_40>, Known as early as Jun. 9, 2021.
"NAA-22LR-HG", North American Arms, 1 page, online available at <https://northamericanarms.com/shop/firearms/riaa-221r-hg/>, Known as early as Jun. 9, 2021.
"PP-90", Wikipedia, 1 page, online available at <https://en.wikipedia.org/wiki/PP-90>, Known as early as Jun. 9, 2021.
"SU16TM Series", Keltec Weapons, 3 pages, online available at <https://www.keltecweapons.com/firearms/rifles/su16/>, Known as early as Jun. 9, 2021.
"SUB2000TM", Keltec Weapons, 3 pages, online available at <https://www.keltecweapons.com/firearms/rifles/sub2000/ >, Known as early as Jun. 9, 2021.
"UC-9 Folding Submachine Gun", Midwest Tactical Inc., atfmachinegun.com, 2 pages, online available at <https://www.attmachinegun.com/ blog/uc9>, known as early as May 16, 2019.
Communication pursuant to Rule 164(1) EPC received for European Patent Application Serial No. 18895647.8 dated Mar. 22, 2021, 12 pages.
Eger, Chris,"Ruger AC556: The Totally Legal, Totally Select Fire Mini 14 (Video)", guns.com, 4 pages, online available at <https://www.guns.com/news/2014/03/10/ruger-ac556-totally-legal-totally-full-auto-mini-14-video>, Known as early as Mar. 10, 2014.
Extended European Search Report received for European Patent Application Serial No. 22158123.4 dated Jun. 15, 2022, 10 pages.
"Little Badger Rifle (Blued) 221r/16.5 Inches BBL", Chiappa Firearms, 7 pages, online avilable at <https://www.thiappafirearms.com/product.php?id=181>, Known as early as Jun. 9, 2021.
Marconopolo, "870 Police Magnum-Overtolder (A.K.A. Sarah Connor Shotgun)", Youtube, 2 pages, online avilable at <https://www.youtube.com/watch?v=T8jptYUeSNY>, Known as early as Dec. 5, 2012.
McCollum, Ian, "Forgotten Weapons: The Burgess Folding Shotgun", 4 pages, online available at <https://www.popularmechanics.com/military/weapons/a17376/folding-shotgun/>, Known as early as Sep. 18, 2016.
McCollum, Ian, "Forgotten Weapons: The Folding Gun that was a Bit too Fancy", 3 pages, online available at <https://www.popularmechanic,s.com/military/weapons/a17376/folding-shotgun/>, Known as early as Jun. 9, 2016.
Notice of Allowance received for U.S. Appl. No. 16/228,600 dated Jun. 14, 2019, 9 pages.
Requirement for Restriction received for U.S. Appl. No. 16/228,600 dated Mar. 21, 2019, 6 pages.
Vining, Miles, "Thumb-safety Glock", 2 pages, online available at <https://www.forgottenweapons.com/thumb-safety-glockf/>, Known as early as Jul. 30, 2020.
Writer, Staff, "The Ares Defense FMG was a Novel, Concealable Submachine Gun Concept Developed to Protect High-Level Businessmen Overseas", 3 pages, online available at <https://www.militaryfactory.com/smallarms/detail.php? smallarms_id=112>, Known as early as May 12, 2021.
Non-Final office action received for U.S. Appl. No. 17/578,661 dated Oct. 7, 2022, 7 pages.
Notice of Allowance received for U.S. Appl. No. 17/578,661 dated Feb. 15, 2023 9 pages.
Notice of Allowance received for U.S. Appl. No. 17/123,846 dated Oct. 22, 2021, 8 pages.
Notice of Allowance received for U.S. Appl. No. 16/584,133 dated Jan. 15, 2020, 9 pages.

* cited by examiner

TWO-PART FOLDING TRIGGER FOR A FOLDING FIREARM

CROSS REFERENCE TO RELATED APPLICATIONS

The present Application for Patent claims priority to U.S. Provisional Patent Application No. 63/033,370, entitled "FOLDING GUN MANUAL SAFETY AND FOLDING TRIGGER," filed Jun. 2, 2020. The present Application for Patent is also a Continuation-in-Part of U.S. patent application Ser. No. 16/799,962, entitled "FOLDABLE FIREARM" filed Feb. 25, 2020, pending, which is a Continuation of U.S. patent application Ser. No. 16/584,133 entitled "FOLDABLE FIREARM" filed Sep. 26, 2019, issued as U.S. Pat. No. 10,612,887 on Apr. 7, 2020, which is a Divisional of U.S. patent application Ser. No. 16/228,600 entitled "FOLDABLE FIREARM" filed Dec. 20, 2018 and issued as U.S. Pat. No. 10,443,971 on Oct. 15, 2019, which claims priority to U.S. Provisional Application No. 62/610,731, entitled "ARM BRACE FOR PISTOL," filed Dec. 27, 2017, the entire disclosures of which are hereby incorporated by reference for all proper purposes.

FIELD OF DISCLOSURE

The present disclosure relates generally to handheld firearms, and more specifically to a foldable handheld firearm which may include a charging handle assembly and/or a foldable grip assembly to enable folding and unfolding of the foldable firearm.

DESCRIPTION OF RELATED ART

Folding firearms such as MAGPUL'S FMG-9, the ARES/Warin Stealth Gun, UC-9 and M-21, PP-90 and Goblin are exemplary of folding handheld firearms. Historically these handled firearms were of a submachinegun design. These firearms utilized a folding cover as a butt stock providing shoulder support when deployed. Even if rudimentary as compared to typical rifle stocks, they provided stability and support during shooting especially during fully-automatic fire as would be typical of this type of firearm.

The FMG-9 included a charging handle that could be moved from one side of the firearm to the other to facilitate different-handedness. However, this process required some disassembly of the firearm. Further, the FMG-9 used a trigger pivot axis that was forward of a grip pivot axis.

SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as a foldable firearm. The foldable firearm may comprise an ambidextrous charging handle assembly. The ambidextrous charging handle assembly may comprise a first and second charging handles which may be arranged on opposing sides of the ambidextrous charging handle assembly. In some embodiments, the first and second charging handles may be rotatably coupled such that a degree of rotation of one charging handle may cause rotation of the other charging handle. In some embodiments, the first and second charging handles may be rotatably coupled such that movement of either charging handle parallel to a longitudinal axis of the foldable firearm may cause the other charging handle to correspondingly move along the longitudinal axis of the foldable firearm. The first charging handle may comprise a large detent which may be on an upper interface level and a small detent which may be on a lower interface level. The second charging handle may comprise a small detent which may be on an upper interface level and a large detent which may be on a lower interface level. In some embodiments, the large detent of the first charging handle and the small detent of the second charging handle may interface when the first charging handle is rotated, which may cause the second charging handle to rotate to a lesser degree than the first charging handle. In some embodiments, the large detent of the first charging handle and the small detent of the second charging handle may interface when either of the charging handles is moved rearward such that both charging handles may move rearward in concert. In some embodiments, the large detent of the second charging handle and the small detent of the first charging handle may interface when either of the charging handles is moved rearward such that both charging handles may move rearward in concert. In some embodiments, the first charging handle may be oriented in a perpendicular orientation about the longitudinal axis of the firearm and the first charging handle may move towards the rear of the firearm which may cause the slide to move backwards towards a racked position. In some embodiments, the second charging handle may be oriented in a perpendicular orientation about the longitudinal axis of the firearm and the second charging handle may move towards the rear of the firearm which may cause the slide to move backwards towards a racked position.

The foldable firearm may comprise a slide racking assembly. In some embodiments, the slide racking assembly may be coupled to the first and second charging handles and may provide a first vertical pivot axis for the first charging handle and a second vertical pivot axis for the second charging handle. In some embodiments, the slide racking assembly may be configured to move parallel to the longitudinal axis of the foldable firearm in concert with the first and second charging handles. In some embodiments, the slide racking assembly may include one or more slide racking detents which may be shaped to engage a slide of the foldable firearm and may force the slide to move backward toward a racked position when the first or second charging handle is moved toward a rear of the ambidextrous charging handle assembly. In some embodiments, the first charging handle may be coupled to a bottom portion of the slide racking assembly by a first pivot nub. The first pivot nub may interface with a top portion of the slide racking assembly at a first pivot nub aperture. The interface may provide the first vertical pivot axis for the first charging handle. In some embodiments, the second charging handle may be coupled to the bottom portion of the slide racking assembly by a second pivot nub. The second pivot nub may interface with the top portion of the slide racking assembly at a second pivot nub aperture. The interface may provide the second vertical pivot axis for the second charging handle. In some embodiments, the bottom portion of the slide racking assembly may be coupled to the top portion of the slide racking assembly by a set of forward coupling protrusions of the bottom portion which may interface with a set of forward coupling recessions of the top portion. In some embodiments, the bottom portion of the slide racking assembly may be coupled to the top portion of the slide racking assembly by a set of rear coupling protrusions of the bottom portion which may interface with a set of rear coupling recessions of the top portion. In some embodiments, the slide racking assembly may be constrained to move parallel to the longitudinal axis of the firearm by a guide rail. The guide rail may be coupled to the firearm and may be positioned within a guide rail aperture of the top portion of the slide racking assembly. In some embodiments, the foldable firearm may be converted from a folded to a deployed configuration by pivoting either the first or second charging handles which may be towards the rear end of the foldable firearm. The pivoting of the first charging handle may comprise pivoting the first charging handle from a forward-facing orientation to a non-forward-facing orientation less than, or equal to, a perpendicular orientation about the longitudinal axis of the firearm. The pivoting of the second charging handle may comprise pivoting the second charging handle from a forward-facing orientation to a non-forward-facing orientation less than, or equal to, a perpendicular orientation about the longitudinal axis of the firearm.

The foldable firearm may comprise a foldable grip assembly. The foldable grip assembly may comprise a foldable pistol grip. The foldable pistol grip may comprise a pistol grip-frame hinge axis. In some embodiments, the foldable pistol grip may be rotatably coupled to the frame of the foldable firearm at the pistol grip-frame hinge axis. The foldable pistol grip may comprise a rear part. The foldable pistol grip may comprise a folding part. The foldable pistol grip may comprise a pistol grip release button. In some embodiments, the rear part may be separably coupled to the folding part and may be separated at a breakaway interface by actuating the pistol grip release button. The foldable grip assembly may comprise a foldable trigger. In some embodiments, the foldable trigger may be rotatably coupled to the frame of the foldable firearm at a trigger hinge axis. The foldable grip assembly may comprise a foldable trigger guard assembly. In some embodiments, the foldable trigger guard assembly may be rotatably coupled to the foldable pistol grip and the frame of the firearm. The foldable trigger guard assembly may comprise a bottom trigger guard. The foldable trigger guard assembly may comprise a forward trigger guard. The foldable trigger guard assembly may comprise a trigger guard-pistol grip hinge axis. In some embodiments, the bottom trigger guard may be rotatably coupled to the folding part of the foldable pistol grip at the trigger guard-pistol grip hinge axis. The foldable trigger guard assembly may comprise a trigger guard hinge axis. In some embodiments, the bottom trigger guard may be rotatably coupled to the forward trigger guard at the trigger guard hinge axis. The foldable trigger guard assembly may comprise a trigger guard-frame hinge axis. In some embodiments, the forward trigger guard may be rotatably coupled to the frame of the foldable firearm at the trigger guard-frame hinge axis. The foldable trigger guard assembly may comprise a trigger guard-folding bar hinge axis. The foldable grip assembly may comprise a hand stop. In some embodiments, the hand stop may be rotatably coupled to the frame of the foldable firearm at a hand stop-frame hinge axis. The foldable trigger guard assembly may comprise a folding bar. In some embodiments, the folding bar may be mechanically coupled to the trigger guard at the trigger guard-folding bar hinge axis and may be mechanically coupled to the hand stop at the hand stop-folding bar hinge axis.

The foldable grip assembly may be converted from a deployed to a folded configuration. Converting the foldable grip from a deployed to a folded configuration may comprise actuating the pistol grip release button. In some embodiments, actuating the pistol grip release button may separate the rear part from the folding part of the foldable trigger frame. Converting the foldable grip from an deployed to a folded configuration comprise supplying a torqueing force about the pistol grip-frame hinge axis to the folding part of the pistol grip. In some embodiments, the folding part may supply a lateral force to the foldable trigger assembly, the folding bar, and the hand stop, which may cause the hand stop to rotate about the hand stop-frame hinge axis. In some embodiments, when converting the foldable grip assembly from an deployed to a folded configuration, the folding part of the pistol grip may fold from a vertical to a horizontal orientation about the pistol grip-frame hinge axis, the bottom trigger guard may fold horizontally upwards about the pistol grip-trigger guard hinge axis and the trigger guard hinge axis, the forward trigger guard may fold vertically upwards about the trigger guard hinge axis and the trigger guard-frame hinge axis, the foldable trigger may rotate upwards about the trigger hinge axis, the folding bar may move laterally forward about the trigger guard-folding bar axis and the hand stop-folding bar hinge axis, and the hand stop may rotate inwards about the hand stop-folding bar axis and the hand stop-frame hinge axis.

In another aspect, the disclosure describes a folding firearm comprising a frame, a grip and a foldable trigger guard. The frame can comprise a trigger and a fixed rear part extending downward from an axis parallel to a slide direction of a slide of the folding firearm. The grip can rotatably separate from the fixed rear part along a breakaway interface when the firearm is folded, the folding part configured to fold around a first pivot axis that is forward of a front face of the grip when in a deployed state, the grip further having a grip trigger contact region proximal a top of the front face. The foldable trigger guard can comprise a front leg, a bottom leg, and a folded and deployed state. The front leg and the bottom leg can be oblique to each other in the deployed state, the bottom leg rotatably coupling to the grip via a second pivot axis, the front leg and the bottom leg rotatably coupling via a third pivot axis. The trigger can be configured to fold forward and split into a rear part and a forward part when the grip trigger contact region of the grip biases the trigger forward and the firearm is folded about the first pivot axis, the trigger rotating about a fifth pivot axis.

DETAILED DESCRIPTION

This disclosure presents embodiments of a foldable firearm. The foldable firearm can be formed from a frame, such as a serialized portion of a firearm (e.g., including a chamber, barrel, slide and trigger assembly). A two-part folding trigger may be pivotally mounted to the frame and can have two portions, one of which folds forward when the foldable firearm folds into a stowed state, and in this folded state the trigger is unable to cause discharge of the firearm. A folding grip and folding trigger guard assembly can be arranged around the trigger assembly in the deployed state, where the trigger guard assembly and the folding grip are pivotally coupled to a "housing" near, but optionally not in line with a same pivot that the trigger assembly rotates about. The trigger guard assembly can also be pivotally mounted to a forward portion of the folding grip and have a frontal portion pivotally mounted to the housing such that when the foldable firearm folds into a stowed state, the grip can rotate forward and the foldable grip assembly can correspondingly fold forward and compress flat against a bottom of the frame.

The foldable firearm can also include a safety cover that extends rearward from a slide and chamber of the firearm in a deployed state, but rotates down and under the firearm into a stowed or closed state where the safety cover surrounds, protects, and hides a folding grip assembly, trigger guards, forward grip, and portions of the receiver or frame. The foldable firearm The words "for example" and "exemplary" are used herein to mean "serving as an example, instance, or illustration." Any embodiment described herein as "for example" or "exemplary" is not necessarily to be construed as preferred or advantageous over other embodiments.

Preliminary note: the flowcharts and block diagrams in the following Figures illustrate the architecture, functionality, and operation of possible implementations of systems, methods and computer program products according to various embodiments of the present disclosure. In this regard, some blocks in these flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

Figure 17:
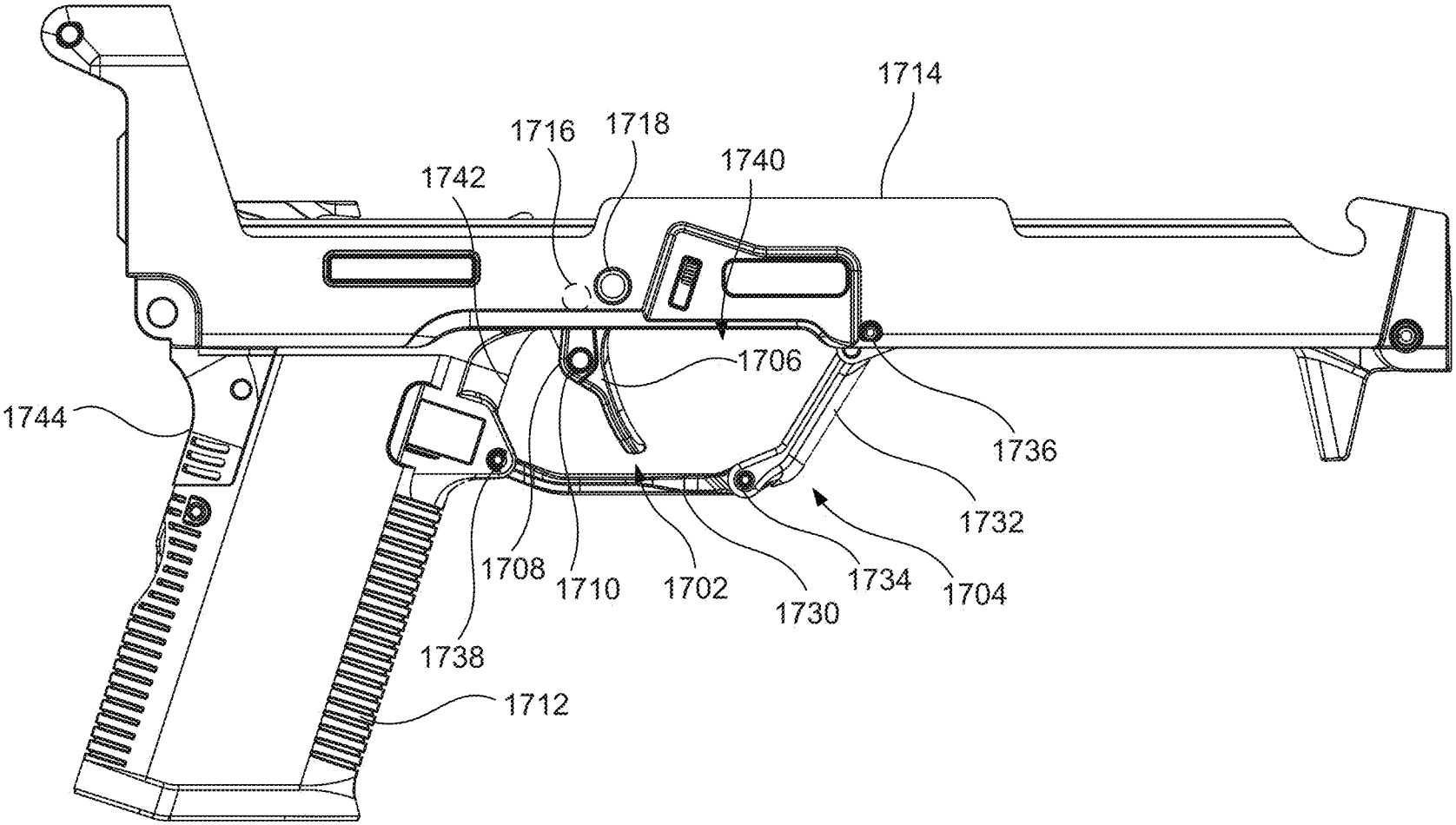
FIG. 17 shows a profile view of a folding grip, foldable trigger guard assembly, and housing of an embodiment of a folding firearm in a deployed state.
Figure 18:
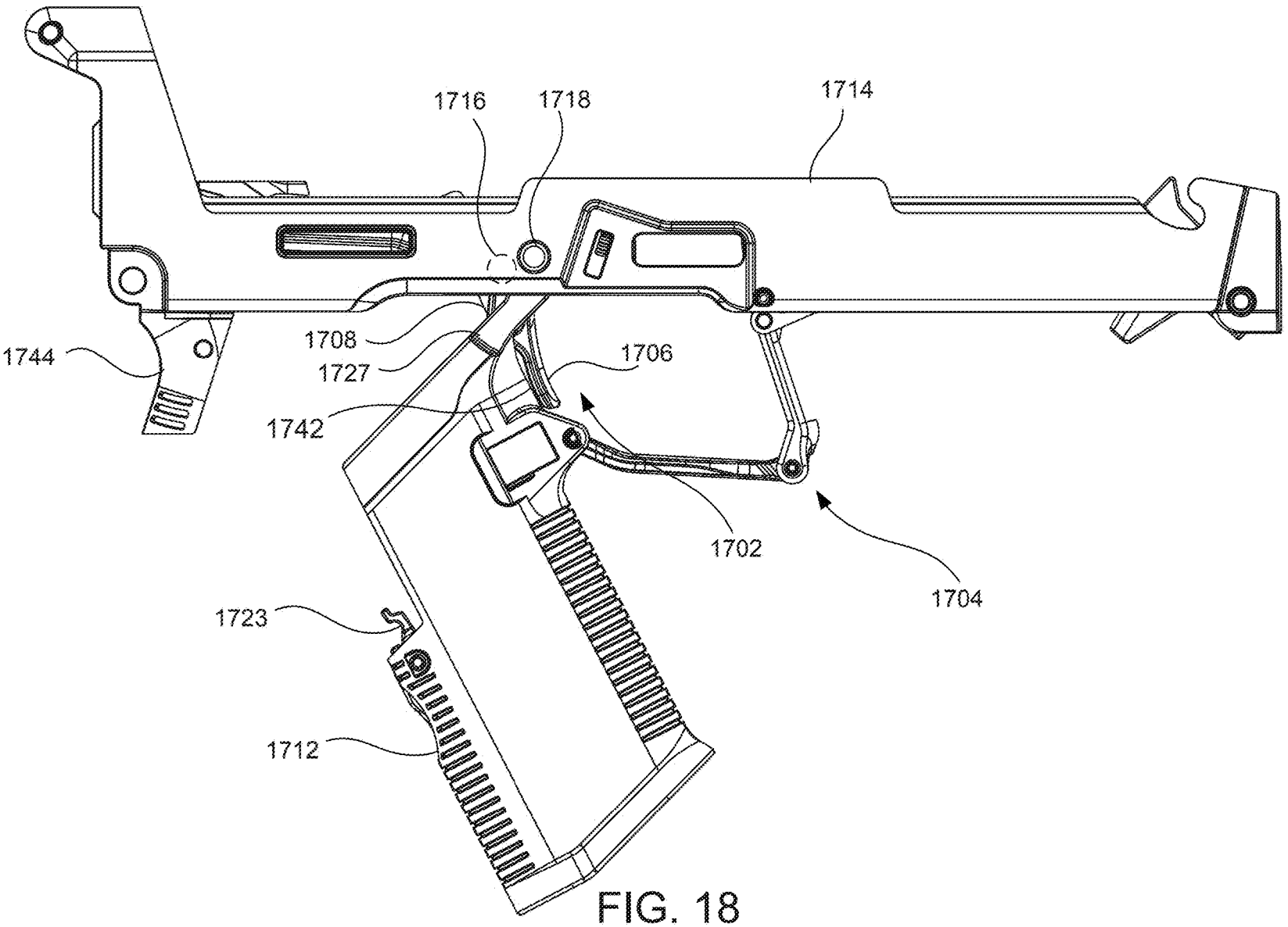
FIG. 18 shows a profile view of the folding grip, the foldable trigger guard assembly, and the housing of FIG. 17 in a state partway between deployed and stowed/folded.
Figure 19:
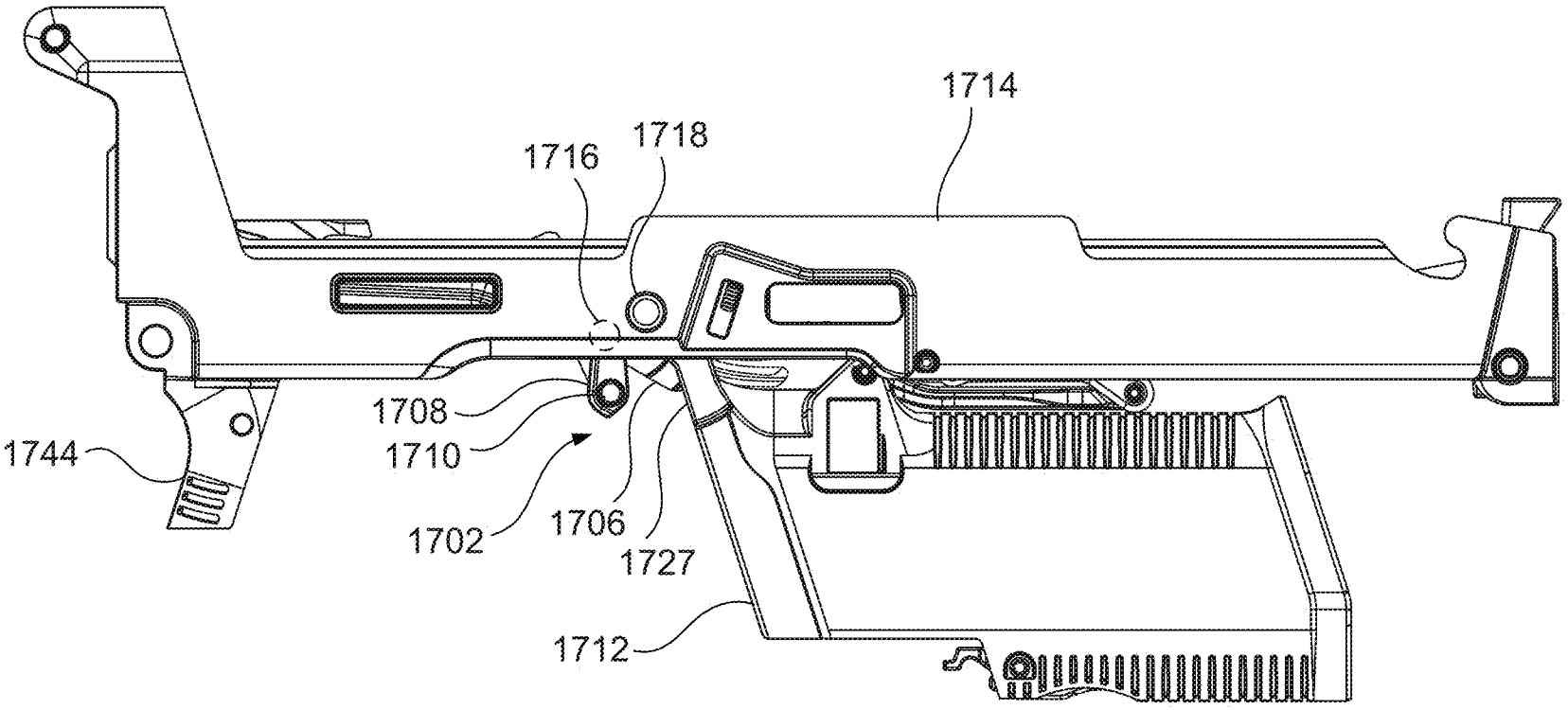
FIG. 19 shows a profile view of the folding grip, the foldable trigger guard assembly, and the housing of FIG. 17 in a stowed/folded state
Figure 33:
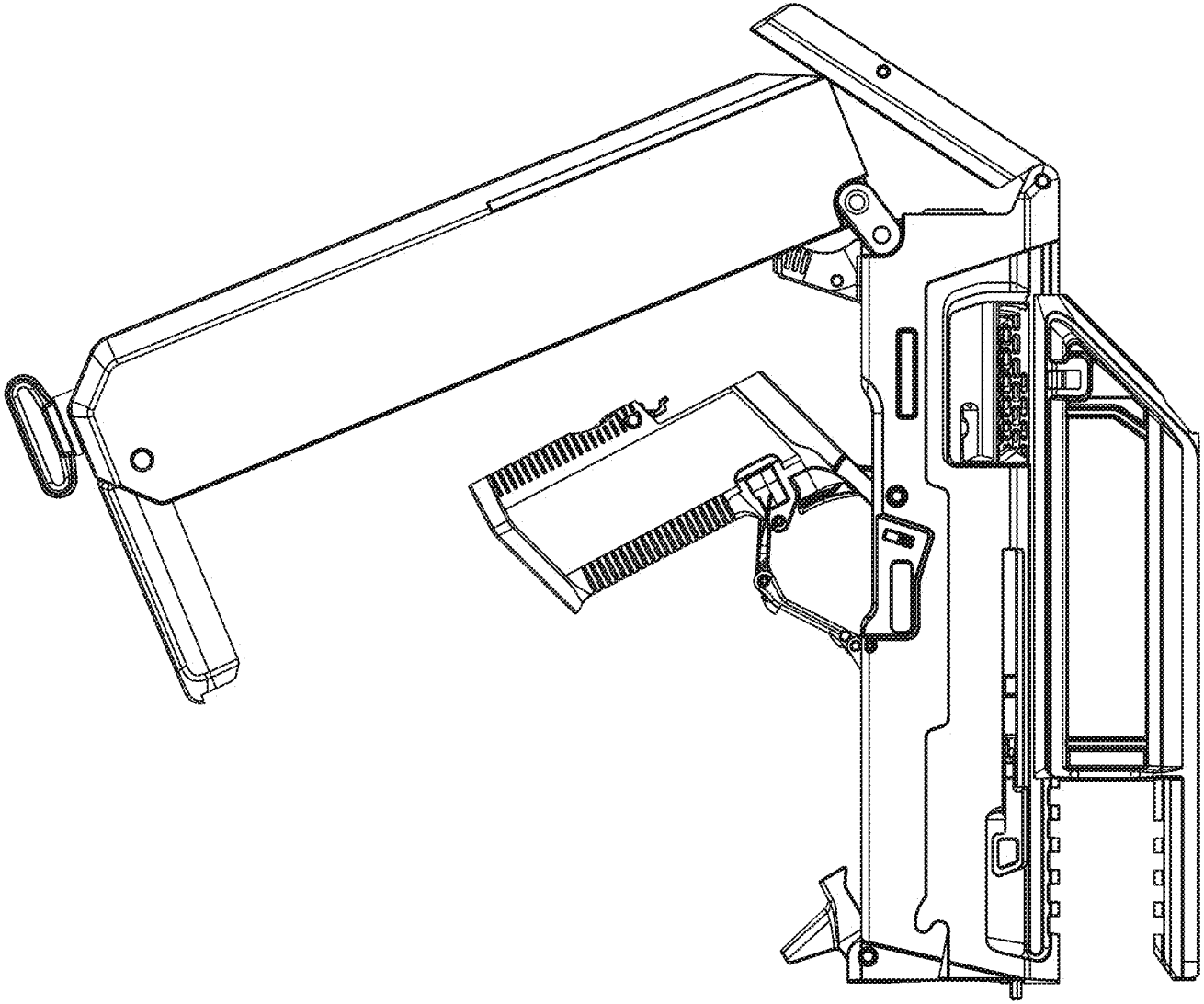
FIG. 33 illustrates an embodiment of a folding firearm between the deployed and stowed/folded states.
Figure 34:
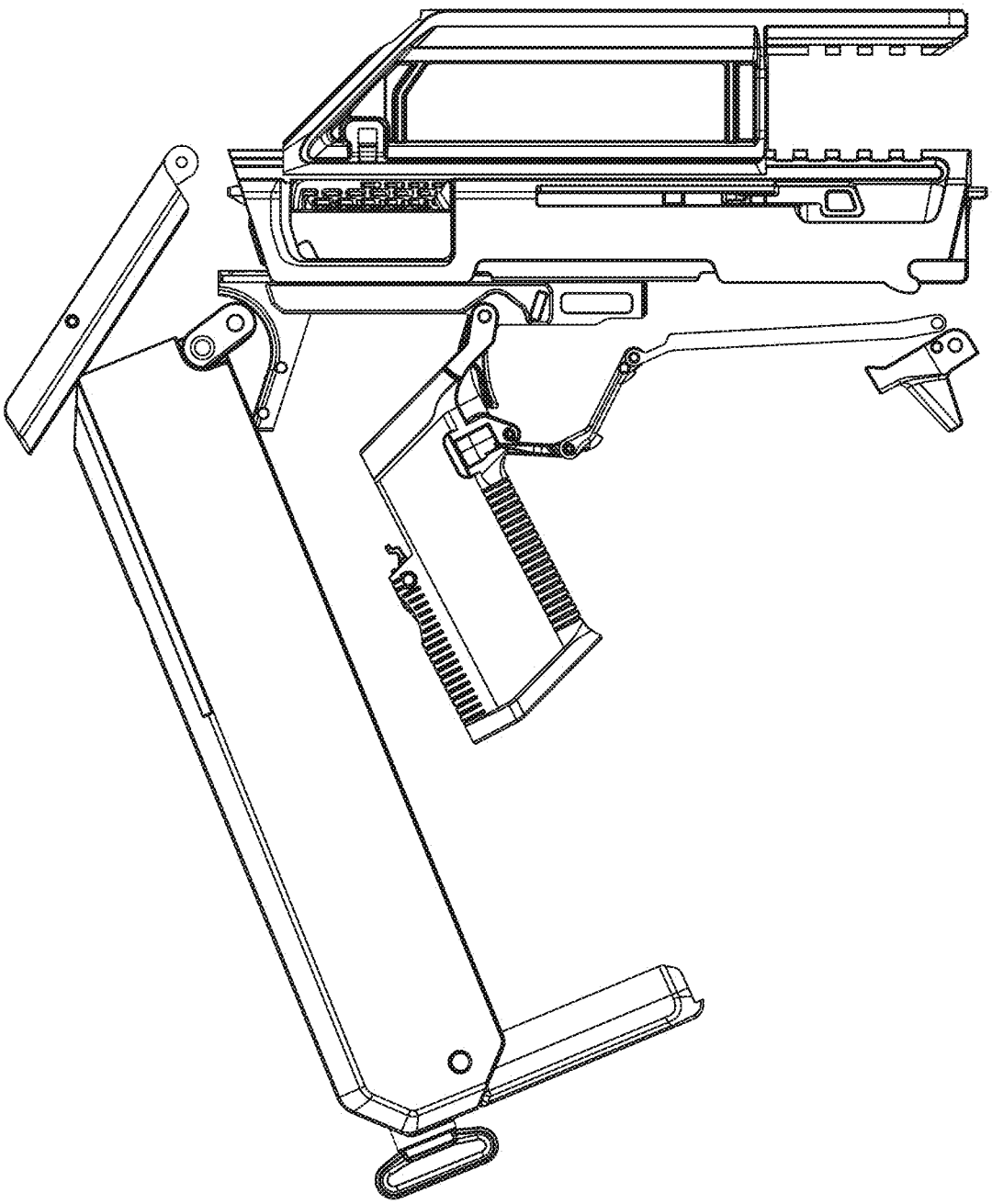
FIG. 34 illustrates the embodiment of FIG. 33 but with a lower half of the housing hidden to make the frame more easily visible.

Foldable Grip Assembly:

FIGS. 4, 35, 36, 37, and 38 illustrate embodiments of a foldable grip assembly of a foldable firearm 100, such as the foldable firearms seen in FIGS. 1-16. FIGS. 17-19 show further views of some embodiments of a folding firearm, but only showing the frame, folding grip assembly, and a safety cover 116 (or bottom shell). FIGS. 33-34 show additional views of an embodiment of a foldable firearm during folding, and FIG. 34 is shown with the bottom half of the housing 114 hidden to make more of the frame visible. FIGS. 35-38, show further views of some embodiments of a folding firearm in the folded state, where the top half of the housing 114 and the safety cover have been hidden to make the inner parts of the firearm easier to see.

In FIGS. 1-16 the foldable grip assembly 103 of foldable firearm 100 may comprise a foldable pistol grip 104, a foldable trigger 134, a foldable trigger guard assembly 112, a folding bar 142, and a hand stop 106. The foldable grip assembly 103 may fold from an unfolded to a folded configuration by the coupling of foldable pistol grip 104, foldable trigger 134, foldable trigger guard assembly 112, and hand stop 106.

Figure 4:
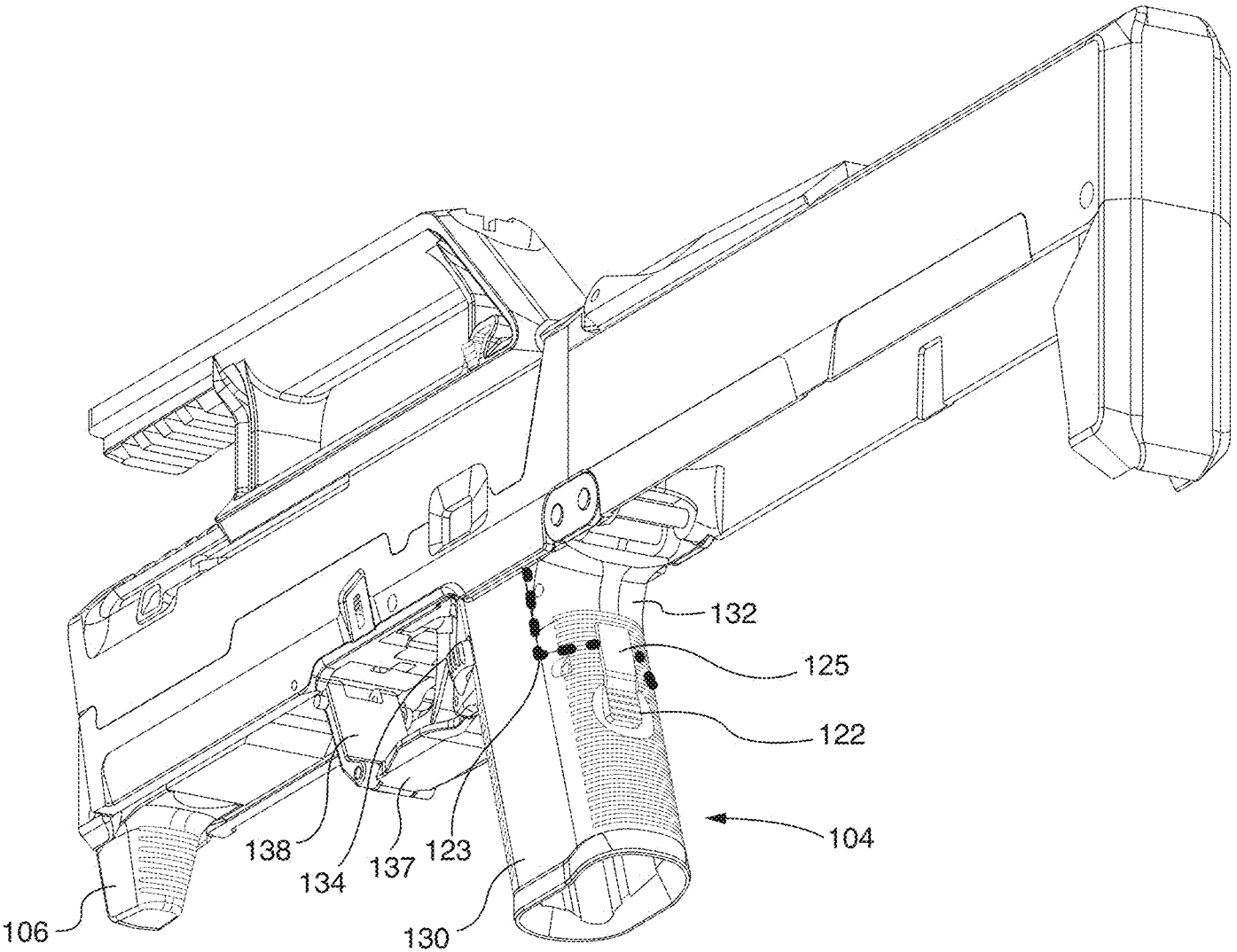
FIG. 4 illustrates a left side view of a first embodiment of a foldable firearm in an unfolded configuration.
Figure 5:
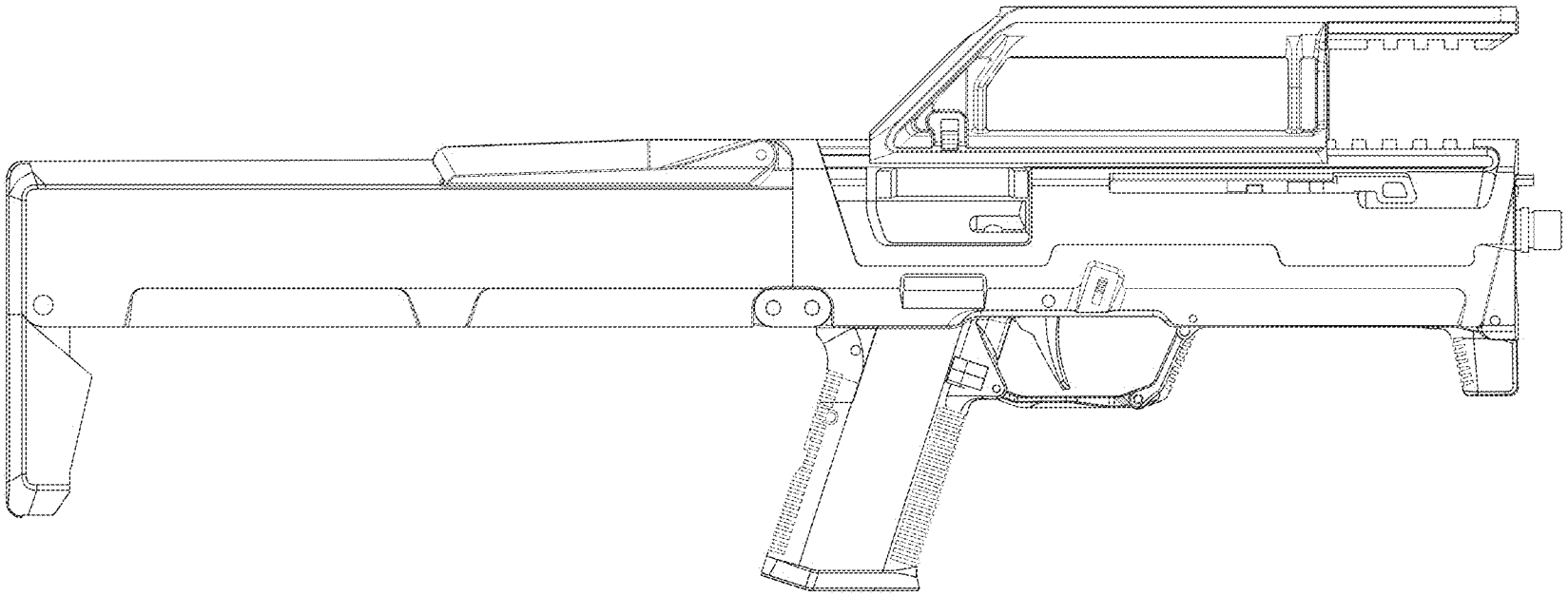
FIG. 5 illustrates an additional right-side view of a first embodiment of a foldable firearm in an unfolded configuration exemplifying a tab of a foldable firearm.
Figure 6:
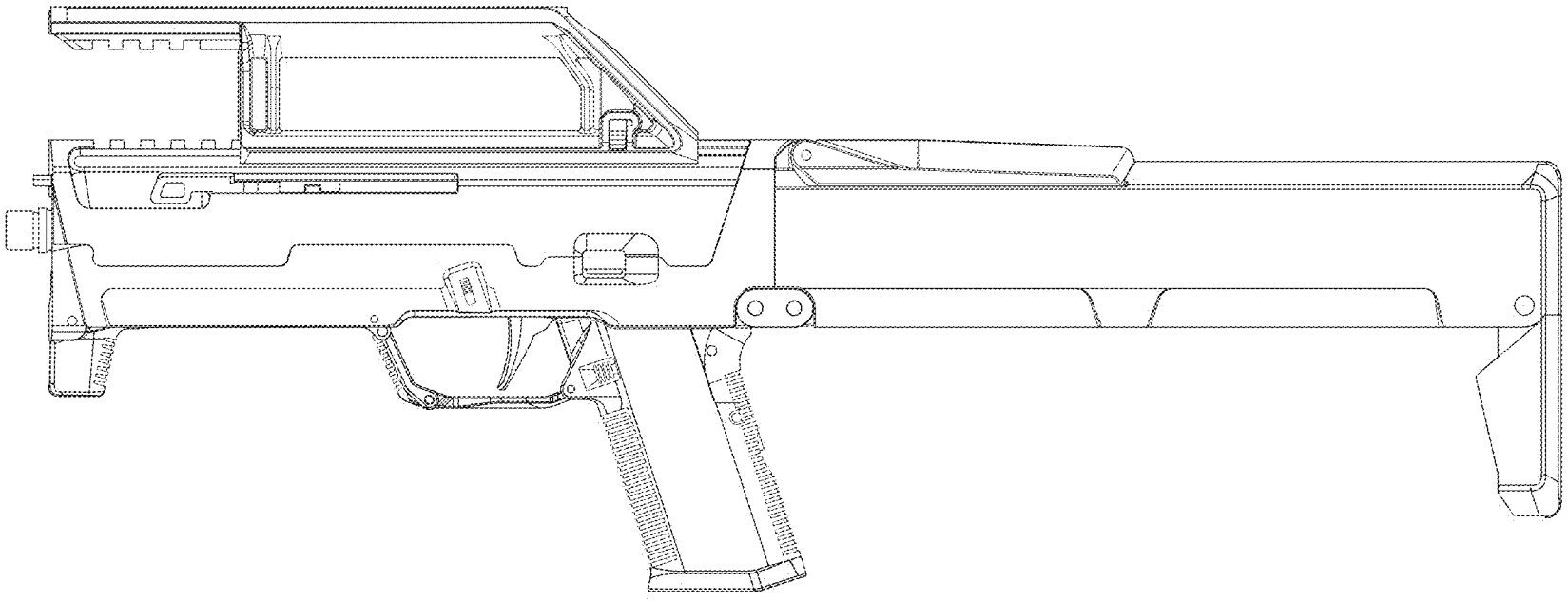
FIG. 6 illustrates an additional left side view of a first embodiment of a foldable firearm in an unfolded configuration.
Figure 7:
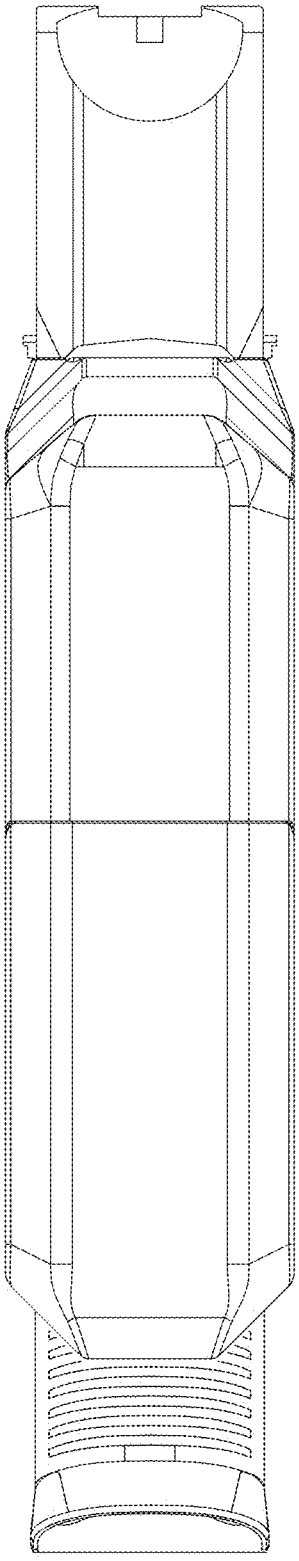
FIG. 7 illustrates a rear view of a first embodiment of a foldable firearm in an unfolded configuration.
Figure 8:
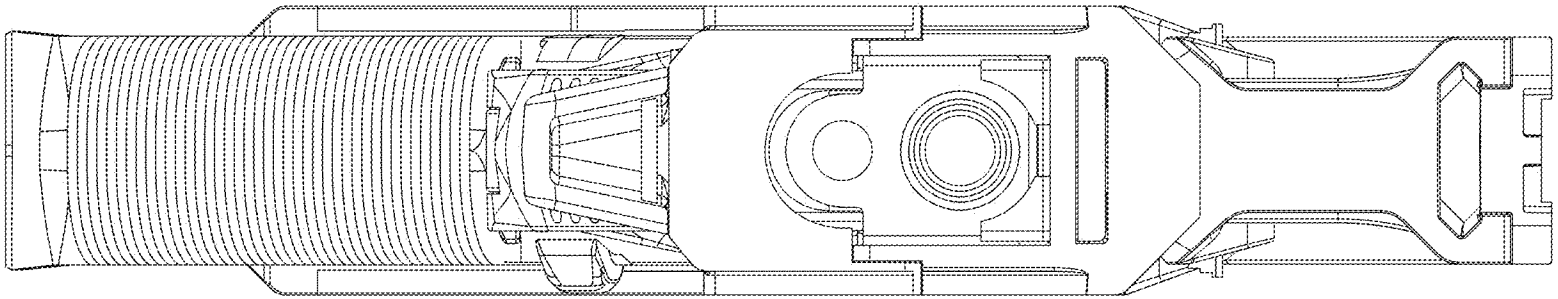
FIG. 8 illustrates a front view of a first embodiment of a foldable firearm in an unfolded configuration.
Figure 9:
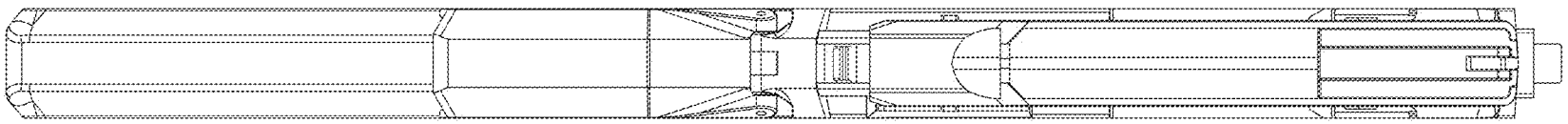
FIG. 9 illustrates a top view of a first embodiment of a foldable firearm in an unfolded configuration.
Figure 10:
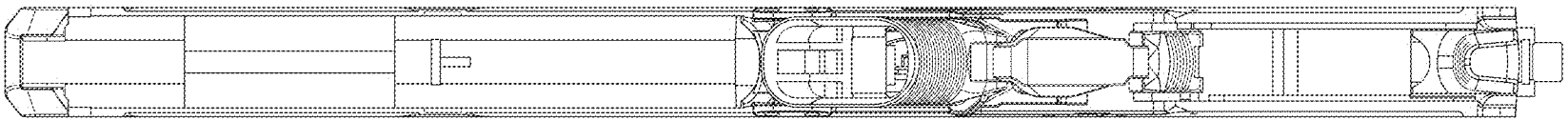
FIG. 10 illustrates a bottom view of a first embodiment of a foldable firearm in an unfolded configuration.
Figure 35:
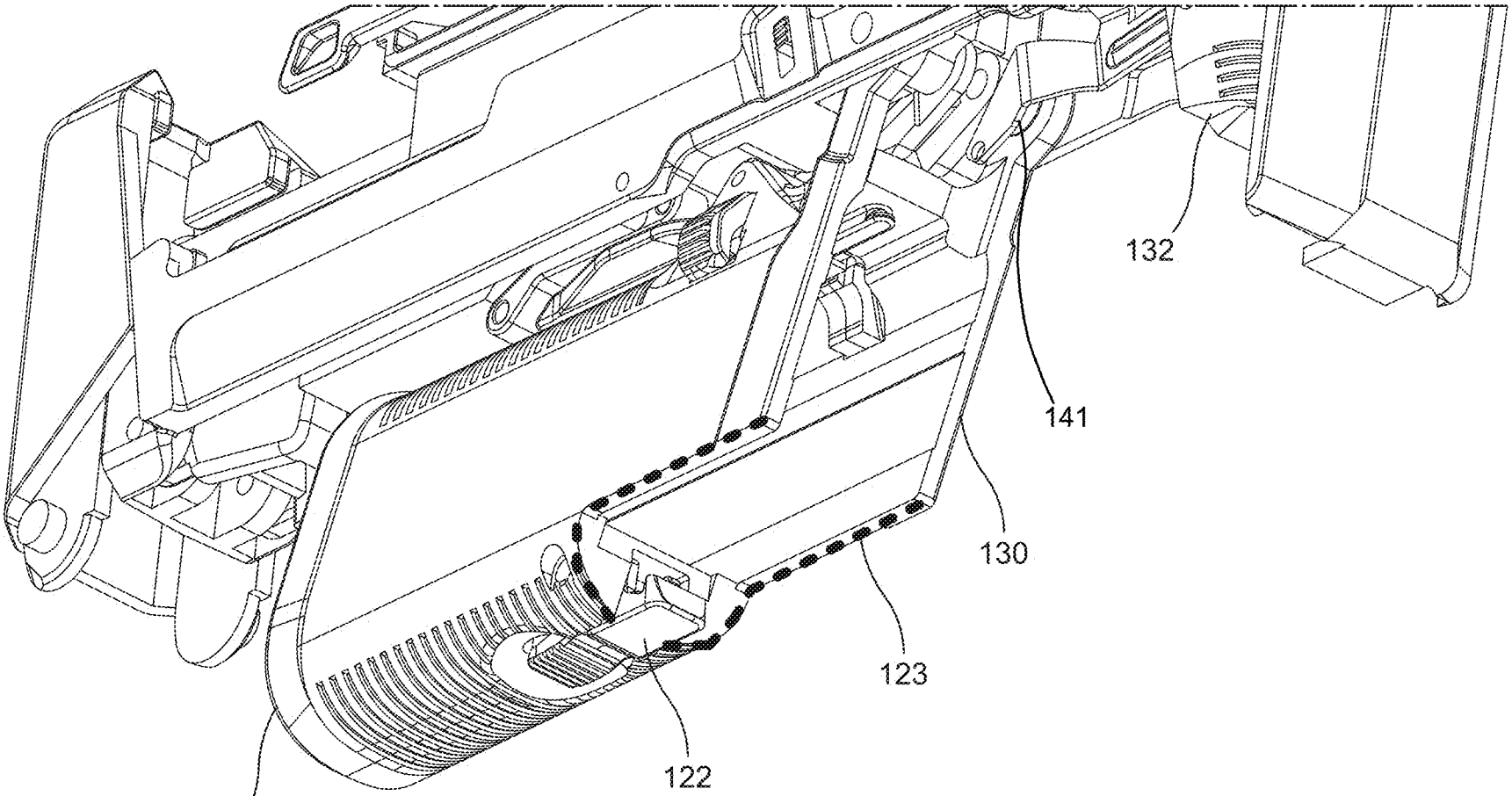
FIG. 35 illustrates a bottom left side rear view of an embodiment of a foldable firearm with a top half of the housing and a safety cover hidden illustrating a foldable grip assembly in the folded/stowed state.
Figure 36:
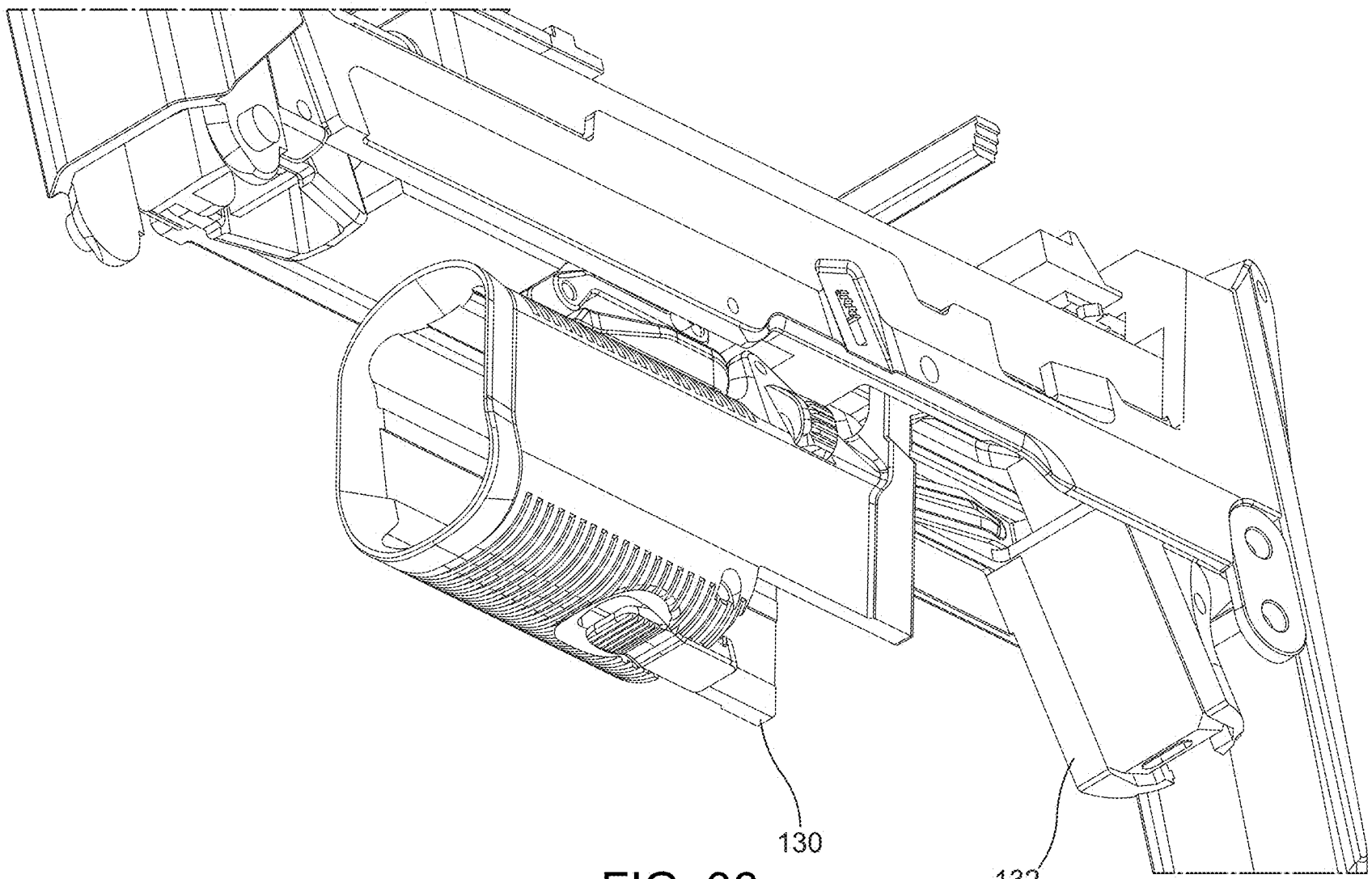
FIG. 36 illustrates a bottom left side front view of the embodiment of FIG. 35.
Figure 38:
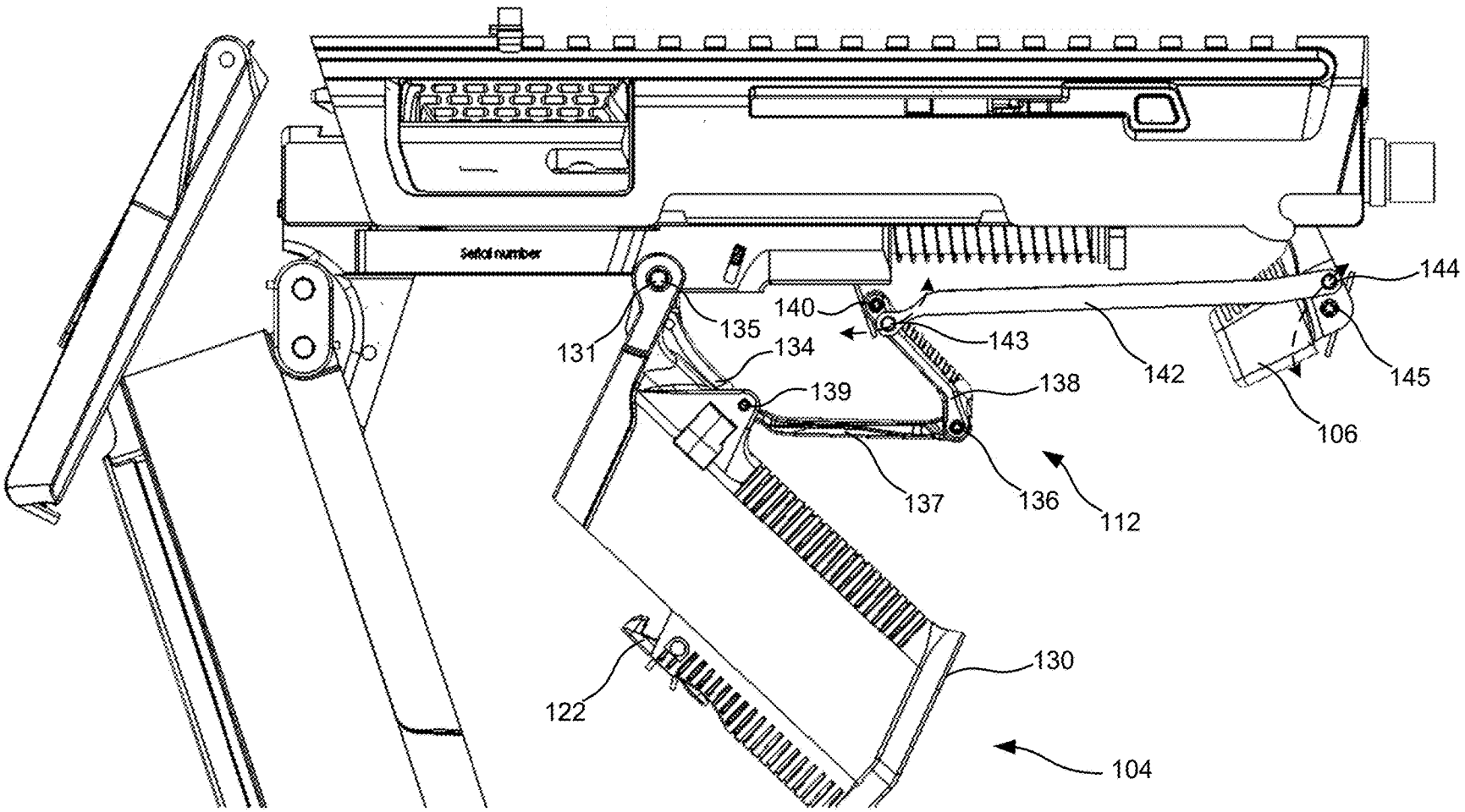
FIG. 38 illustrates a right-side view of the embodiments of foldable firearms shown in FIGS. 1-16, during folding, but with a lower half of the housing hidden to better see the frame and pivot points of the foldable trigger assembly.

FIG. 4 illustrates foldable pistol grip 104 in an unfolded or deployed configuration. In some embodiments, foldable pistol grip 104 may be regarded as being substantially similar to a traditional pistol grip, however, foldable pistol grip 104 may be rotatably coupled to foldable firearm 100 and fold into a folded or stowed configuration as illustrated in FIGS. 11, 13, 15, 19 and 28. Foldable pistol grip 104 may further comprise fixed rear part 132, folding part 130, and pistol grip release button 122. Additionally, the foldable pistol grip 104 can include a locking arm 125 that couples the folding part 130 and the fixed rear part 132, and wherein this locking arm 125 is moved out of a coupling position by depression of the grip release button 122. The fixed rear part 132 can extend downward from an axis parallel to a slide direction of a slide of the folding firearm. As illustrated in FIG. 4, fixed rear part 132 may be separably coupled to folding part 130. In some embodiments, when pistol grip release button 122 is actuated, fixed rear part may separate from folding part 130 about breakaway interface 123. This may enable the collapse of foldable pistol grip 104. Once detached from fixed rear part 132, folding part 130 may pivot about pistol grip-frame pivot axis 131 from a substantially vertical orientation, as illustrated in FIG. 4, to a substantially horizontal orientation, as illustrated in FIGS. 11, 13, 15, 19 and 28. Foldable pistol grip 104 may comprise a variety of materials including polymeric material, metal, composite, ceramic, or other suitable materials. FIG. 35. illustrates an exemplary view of such a collapsed orientation of foldable pistol grip 104 wherein fixed rear part 132 and folding part 130 are visibly separated about breakaway interface 123. FIG. 36 illustrates an additional exemplary collapsed orientation of foldable pistol grip 104 wherein fixed rear part 132 and folding part 130 are visibly separated. FIG. 38. illustrates an exemplary folding view of foldable pistol grip 104. Once detached from fixed rear part 132, folding part 130 may pivot about pistol grip-frame hinge axis 131 from a substantially vertical orientation, as illustrated in FIG. 4, to a substantially horizontal orientation, as illustrated in FIGS. 35 and 36. Foldable pistol grip 104 may comprise a variety of materials including polymeric material, metal, composite, ceramic, or other suitable materials.

Figure 37:
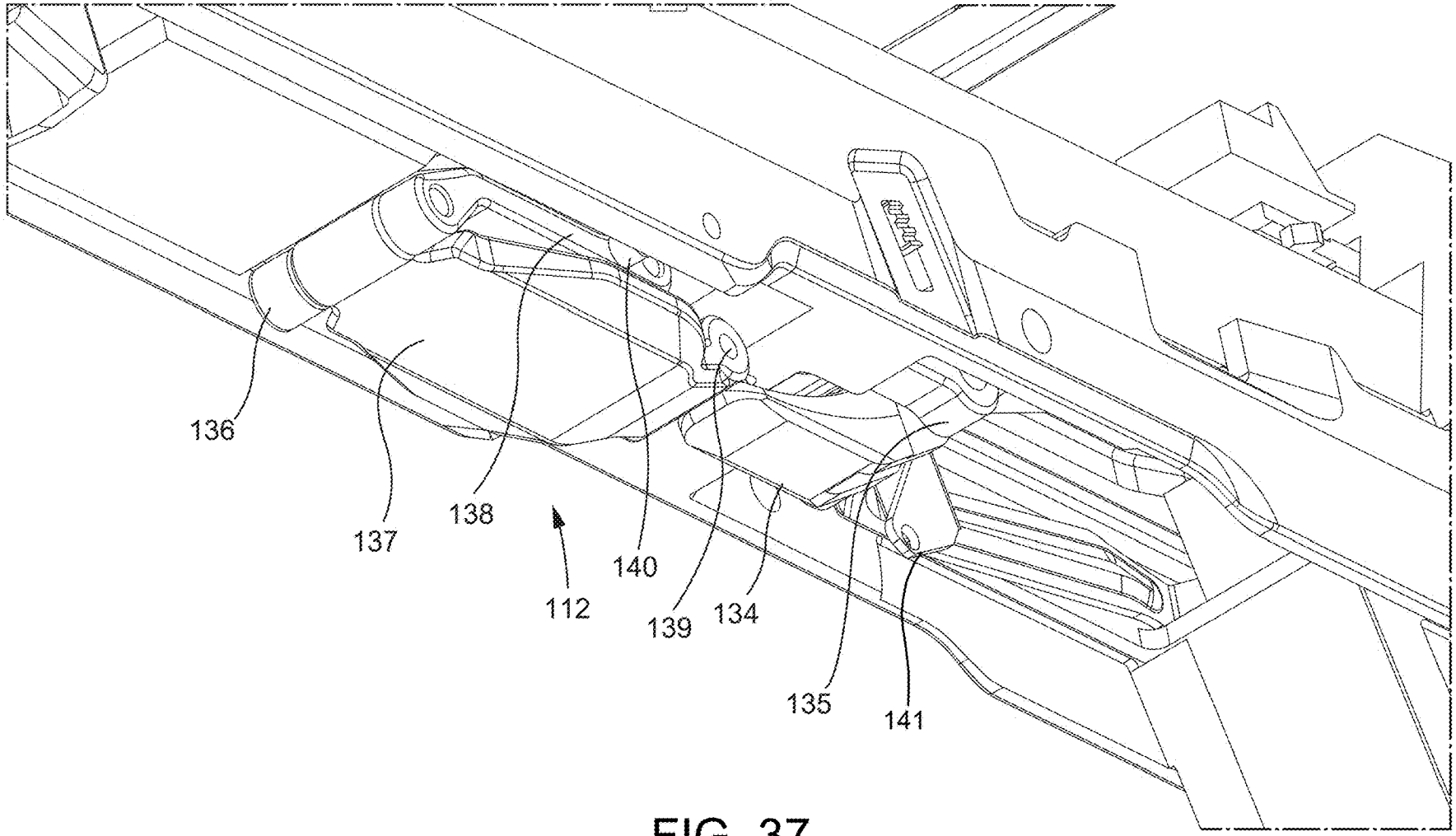
FIG. 37 illustrates another view of FIG. 36, but with the grip also hidden to better show the foldable grip assembly.

A foldable trigger 134 may also be seen in FIG. 38 where it is being folded from a substantially vertical orientation, as illustrated in FIG. 4, to a substantially horizontal orientation as illustrated in FIG. 37. Foldable trigger 134 may pivot towards the front end of foldable firearm 100 about trigger hinge axis 135 (or a fourth pivot axis) into a folded configuration. The folding part 130, when collapsing, may supply lateral force to foldable trigger 134 such that when folding part 130 pivots about pistol grip-frame axis 131, so too does foldable trigger 134 about trigger hinge axis 135. Foldable pistol grip 104 may comprise a variety of materials including polymeric material, metal, composite, ceramic, or other suitable materials.

FIG. 38 also illustrates the foldable trigger guard assembly 112, which may include a bottom leg 137, and a front leg 138. The foldable trigger guard assembly 112 may be coupled to the foldable pistol grip and housing 114 of the frame of the firearm such. In some embodiments, the bottom leg 137 may be regarded as the bottom section of the foldable trigger guard assembly 112. Bottom leg 137 may be oriented horizontally about the longitudinal axis of the foldable firearm 100, as illustrated in FIG. 4. Bottom leg 137 may be coupled to folding part 130 of foldable pistol grip 104 at trigger guard-pistol grip hinge axis 139 (or a second pivot axis). In some embodiments, when folding part 130 is detached from fixed rear part 132 of foldable pistol grip 112 and moved towards a folded configuration, bottom leg 137 may pivot about trigger guard-pistol grip axis 139 and move horizontally forwards and vertically upwards to a folded state at least partially within a channel of the housing, as illustrated in FIG. 37. The bottom leg 137 may be coupled to front leg 138 by a trigger guard hinge axis 136 (or a third pivot axis). Trigger guard hinge axis 136 may allow both bottom leg 137 and front leg 138 to pivot about trigger guard hinge axis 136 from an unfolded configuration, as illustrated in FIG. 4, to a substantially flat, folded configuration, as illustrated in FIG. 37. In some embodiments, front leg 138 may be regarded as the front part of trigger guard assembly 112 wherein foldable trigger 134 is positioned horizontally behind. Front leg 138 may be oriented substantially vertically about the longitudinal axis of foldable firearm 100, as illustrated in FIG. 4. Front leg 138 may be coupled to housing 114 of the foldable firearm 100 by trigger guard-frame hinge axis 140 (or a fourth pivot axis). In some embodiments, when folding part 130 is detached from fixed rear part 132 of foldable pistol grip 104 and moved towards a folded configuration, front leg 138 may pivot about trigger guard-frame hinge axis 140 since front leg 138 is rotatably coupled to bottom leg 137 by trigger guard hinge axis 136. The pivoting may cause front leg 138 to move vertically upwards and horizontally inwards about foldable firearm 100 to a folded configuration. Foldable trigger guard assembly 112 may comprise a variety of materials including polymeric material, metal, composite, ceramic, or other suitable materials.

The trigger guard assembly 112 may be coupled to the hand stop 106 via a folding bar 142. In some embodiments, folding bar 142 may be regarded as a longitudinal member which transfers horizontal force about the folded firearm to collapse hand stop 106 in conjunction with the folding of foldable pistol grip 104, foldable trigger 134, and foldable trigger guard assembly 112. Folding bar 142 may be rotatably coupled to front leg 138 at trigger guard-folding bar hinge axis 143. In some embodiments, when front leg 138 is folded upwards into a folded configuration, folding bar 142 pivots about trigger guard-folding bar hinge axis 143 such that folding bar 142 moves horizontally and vertically about foldable firearm 100 into a folded position. Folding bar 142 may comprise a variety of materials including polymeric material, metal, composite, ceramic, or other suitable materials.

The foldable firearm 100 can include a hand stop 106, that in some embodiments, may be regarded as a forward hand stop of foldable firearm 100 that may prevent forward motion of the user's hand during firing. Hand stop 106 may be coupled to the housing 114 of foldable firearm 100 by hand stop-frame hinge axis 145. Hand stop 106 may also be coupled to folding bar 142 by hand stop-folding bar hinge axis 144. In some embodiments, when folding bar 142 moves in a horizontal and vertical direction into a collapsed position (see dashed arrows at axis 143 and axis 144), hand stop 106 pivots about hand stop-folding bar hinge axis 144, which in turn causes hand stop 106 to pivot inwards about hand stop-frame hinge axis 145 to a folded position (see FIGS. 35-37). The housing 114 can include an opening to receive at least a portion of the hand stop 106 when it folds up and into the opening of the housing 114. Hand stop 106 may comprise a variety of materials including polymeric material, metal, composite, ceramic, or other suitable materials.

The foldable grip assembly of foldable firearm 100 may change from a folded to an unfolded configuration. For example, depressing release button 122 can unlock folding part 130 from fixed rear part 132 of foldable pistol grip 104. Providing a torqueing force about pistol grip-frame hinge axis 131 (or a first pivot axis) by pushing forward on the bottom half of folding part 130 causes the folding part 130 to rotate forward. The forward rotation of folding part 130 causes foldable trigger 134 to pivot forward and upward about trigger hinge axis 135. Foldable trigger guard assembly 112 is connected to folding part 130 by trigger guard-pistol grip hinge axis 139 and begins to pivot forward and upward with folding part 130. Front leg 138 begins to fold upwards as bottom leg 137 folds upwards since the two trigger guard pieces are connected by trigger guard hinge axis 136. As front leg 138 folds upwards about trigger guard-frame hinge axis 140, folding bar 142 moves in an arcuate manner forwards and upwards into a folded state. Due to hand stop 106 being coupled to folding bar 142 by hand stop-folding bar hinge axis 144, hand stop 106 begins to rotate back and upwards about hand stop-frame hinge axis 145. This folding continues until folding part 130 of foldable pistol grip 104 is in a substantially perpendicular orientation to the longitudinal axis of the foldable firearm 100, the folding part 130 resting inside safety cover 116 of foldable firearm 100. In this folded orientation, foldable pistol grip 104, foldable trigger 134, foldable trigger guard assembly 112, and hand stop 106 are folded substantially flat in a horizontal orientation to the longitudinal axis of foldable firearm 100.

Figure 11:
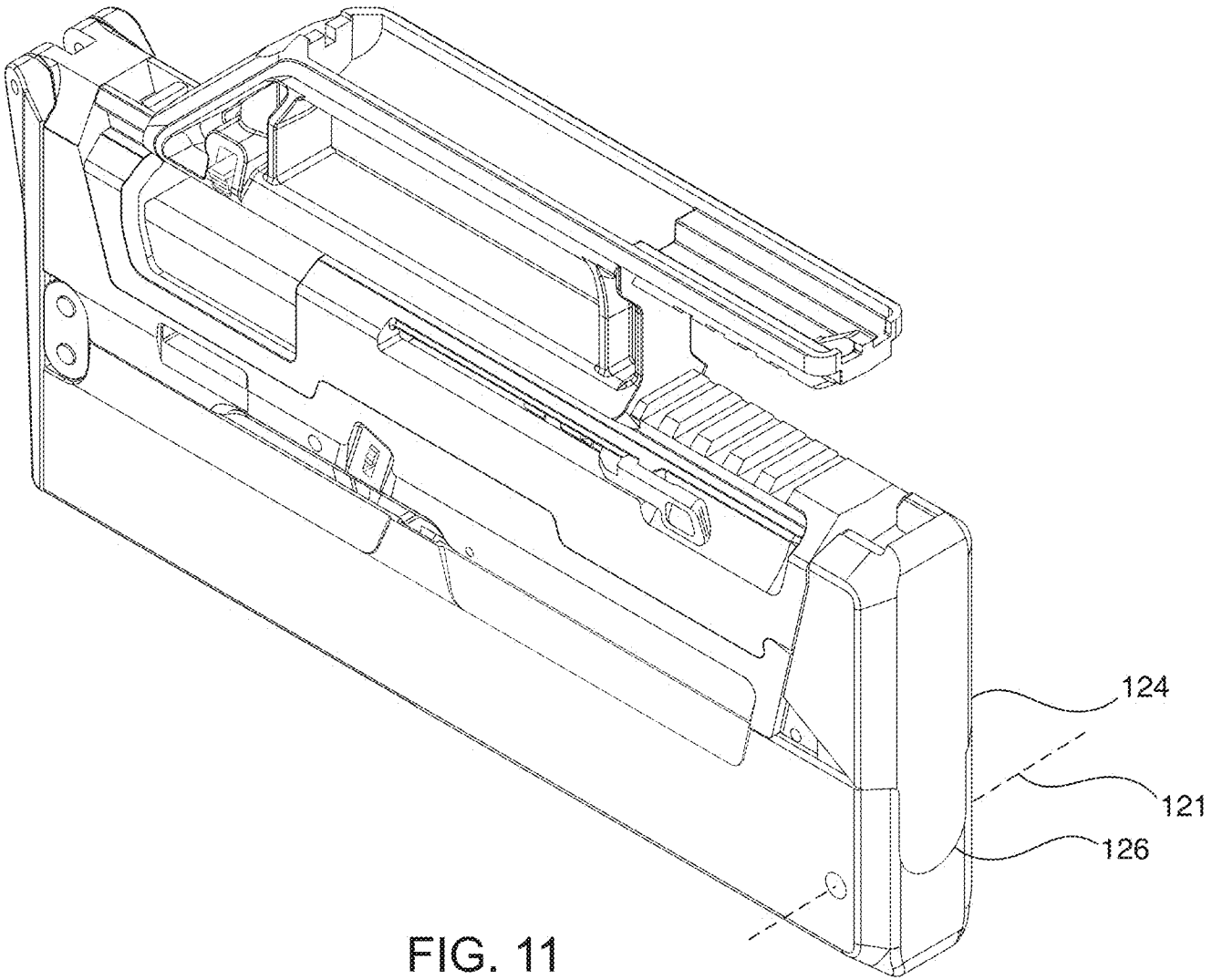
FIG. 11 illustrates a right-side view of a second embodiment of a foldable firearm in a folded configuration.

FIG. 11 illustrates a second embodiment of a foldable firearm with a second hinged tail, in a folded state. The second hinged tail 124 is taller/longer than the first hinged tail 102 and includes an arced top 126. A pivot axis 121 is adjusted vertically to account for the longer hinged tail 124.

Figure 12:
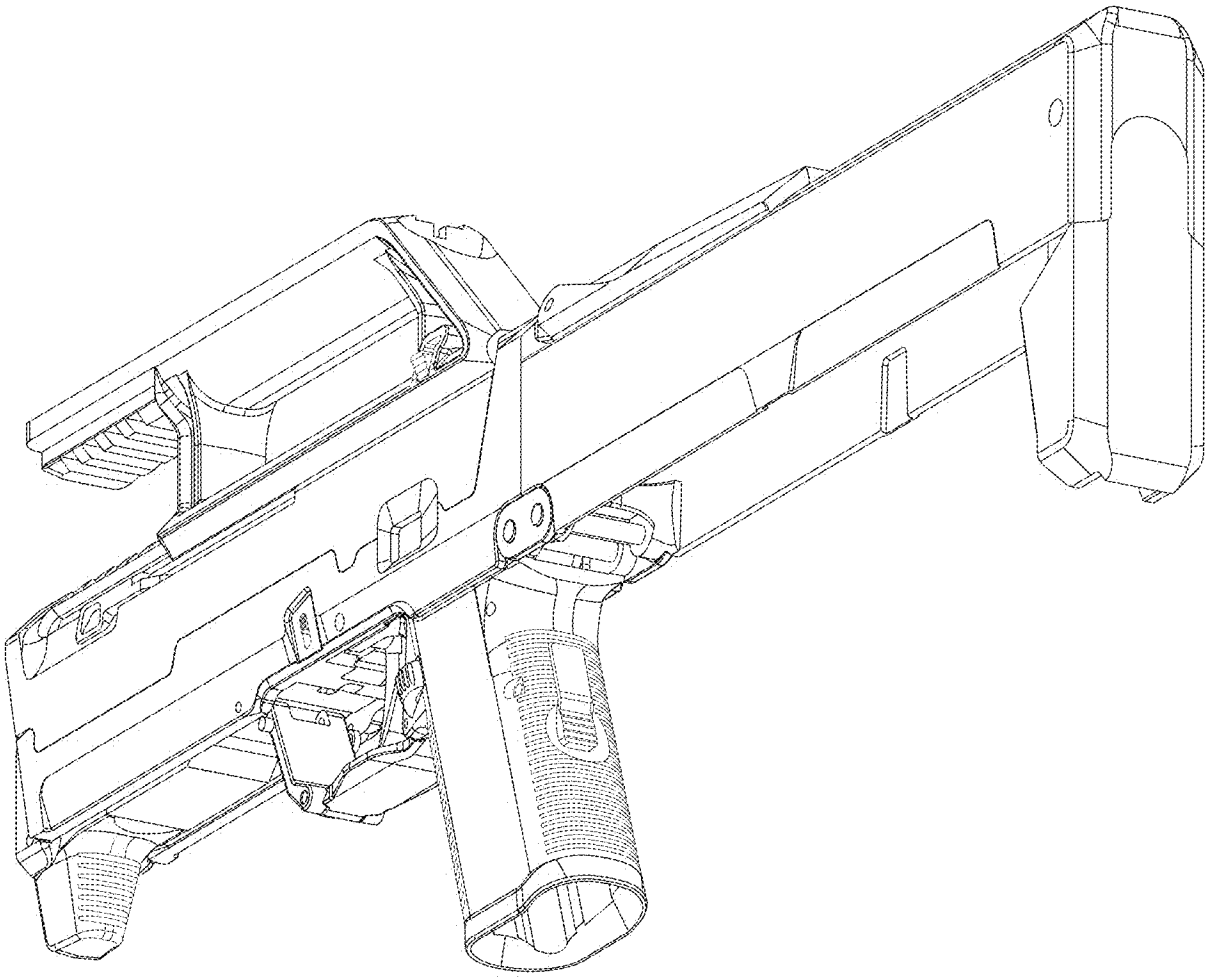
FIG. 12 illustrates a left side view of a second embodiment of a foldable firearm in an unfolded configuration.

FIG. 12 illustrates a deployed view of the foldable firearm of FIG. 11.

Figure 13:
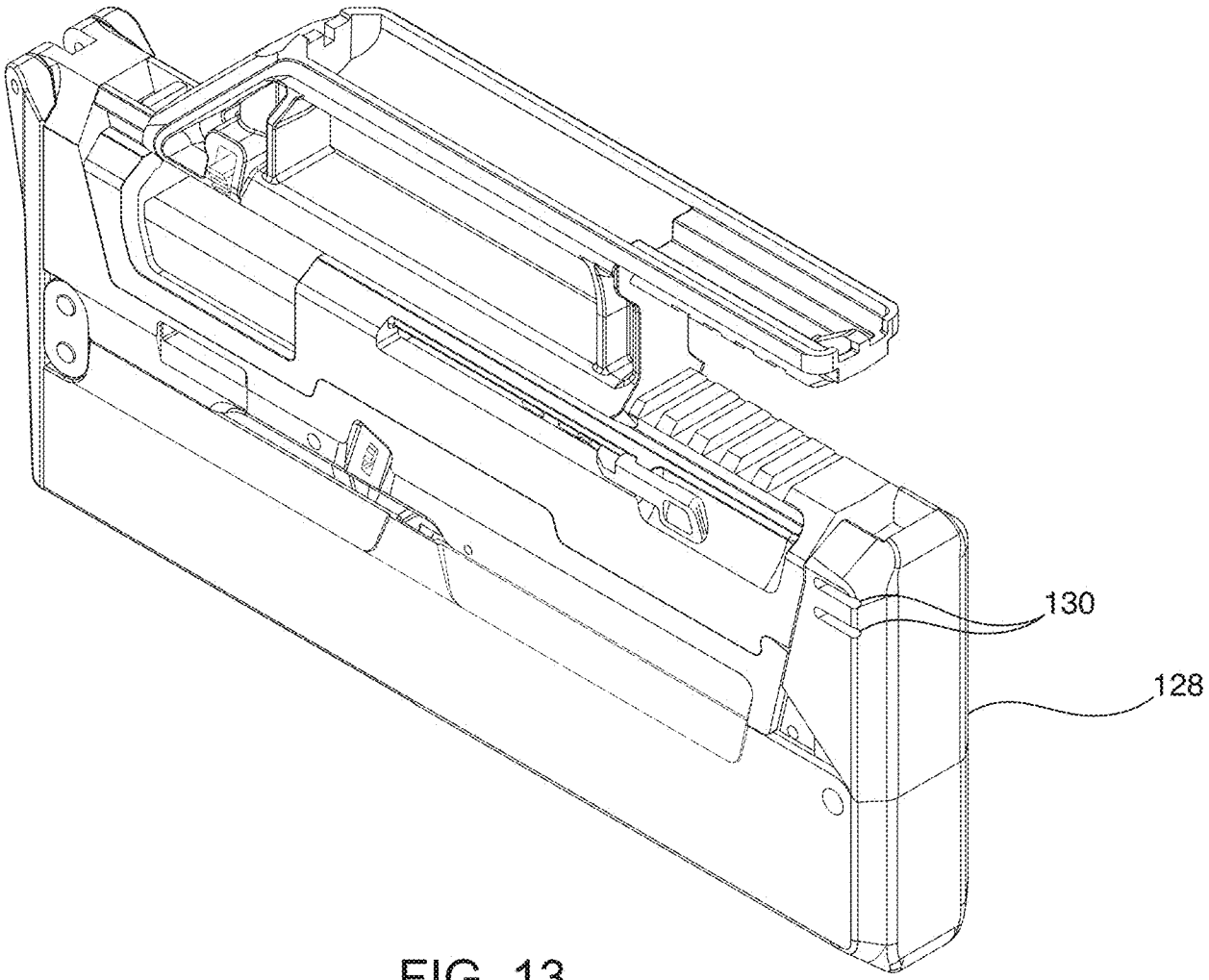
FIG. 13 illustrates a right-side view of a third embodiment of a foldable firearm in a folded configuration.
Figure 29A:
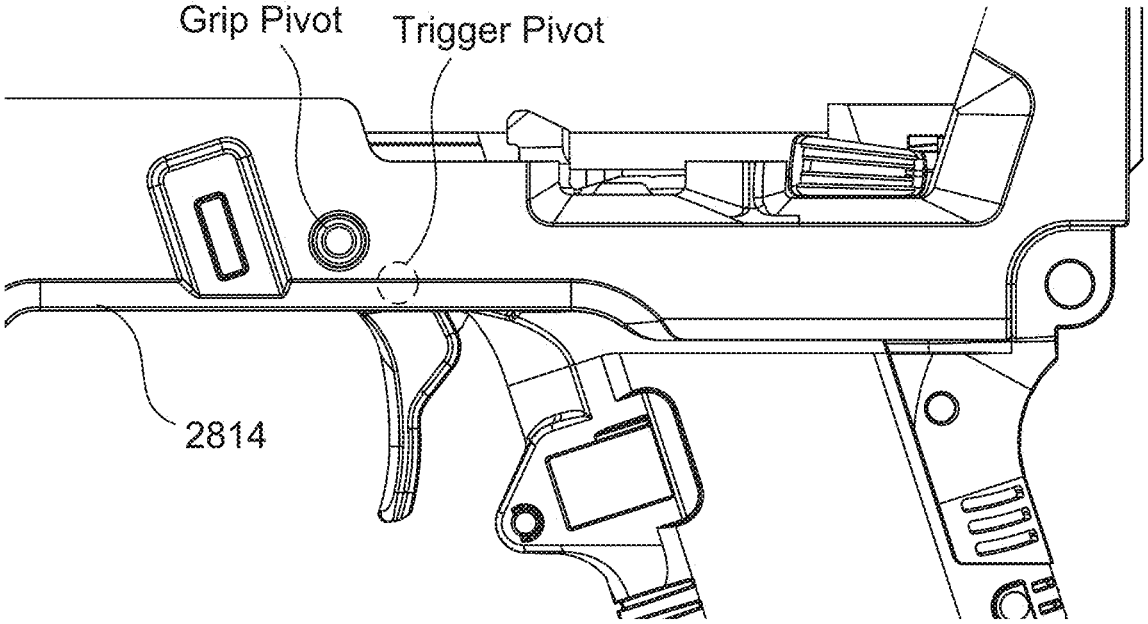
FIG. 29A illustrates an embodiment of the fire state of the manual safety with a housing visible and the frame not visible but arranged between two opposing sides of the housing.
Figure 29B:
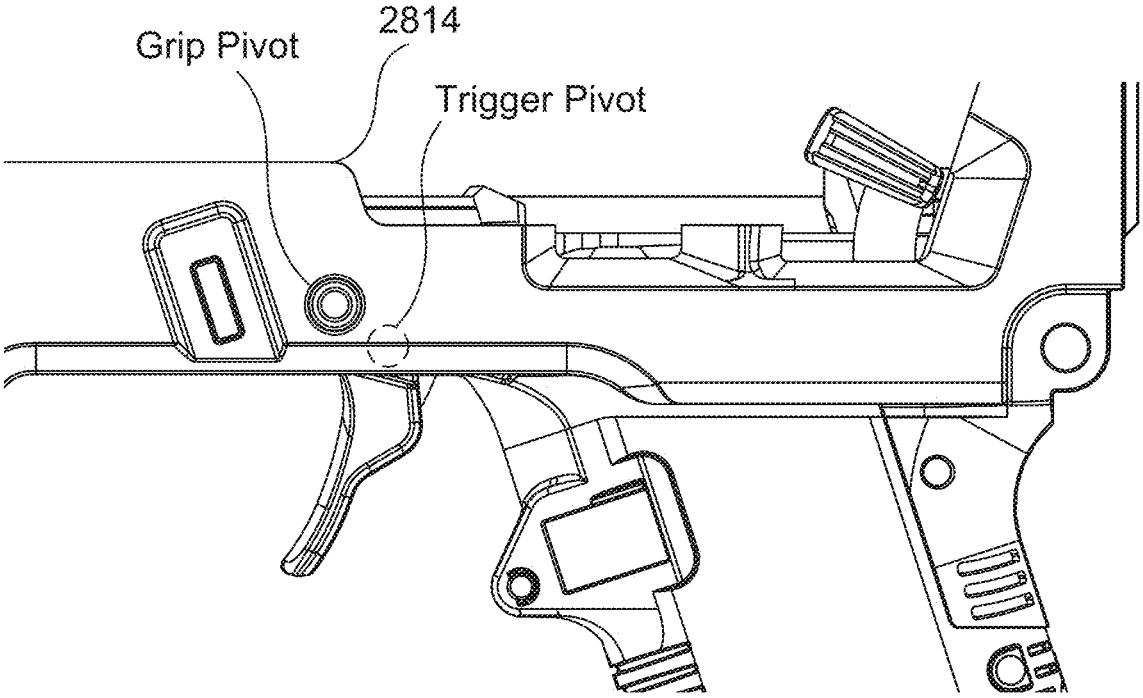
FIG. 29B illustrates an embodiment of the safe state of the manual safety of FIG. 29A.

FIG. 13 illustrates a third embodiment of a foldable firearm with a third hinged tail, the hinged tail inclusive of a bracing strap or apertures to affix a bracing strap. The foldable firearm is here illustrated in a folded state. The third hinged tail 128 has the same shape as the first hinged tail 102, but adds apertures 130 or other attachment points for a bracing strap (e.g., see FIG. 29). The bracing strap can be wrapped around an arm, shoulder, or torso of a user, to enhance shooting accuracy and reduce the effects of kick-back when the foldable firearm is fired.

Figure 14:
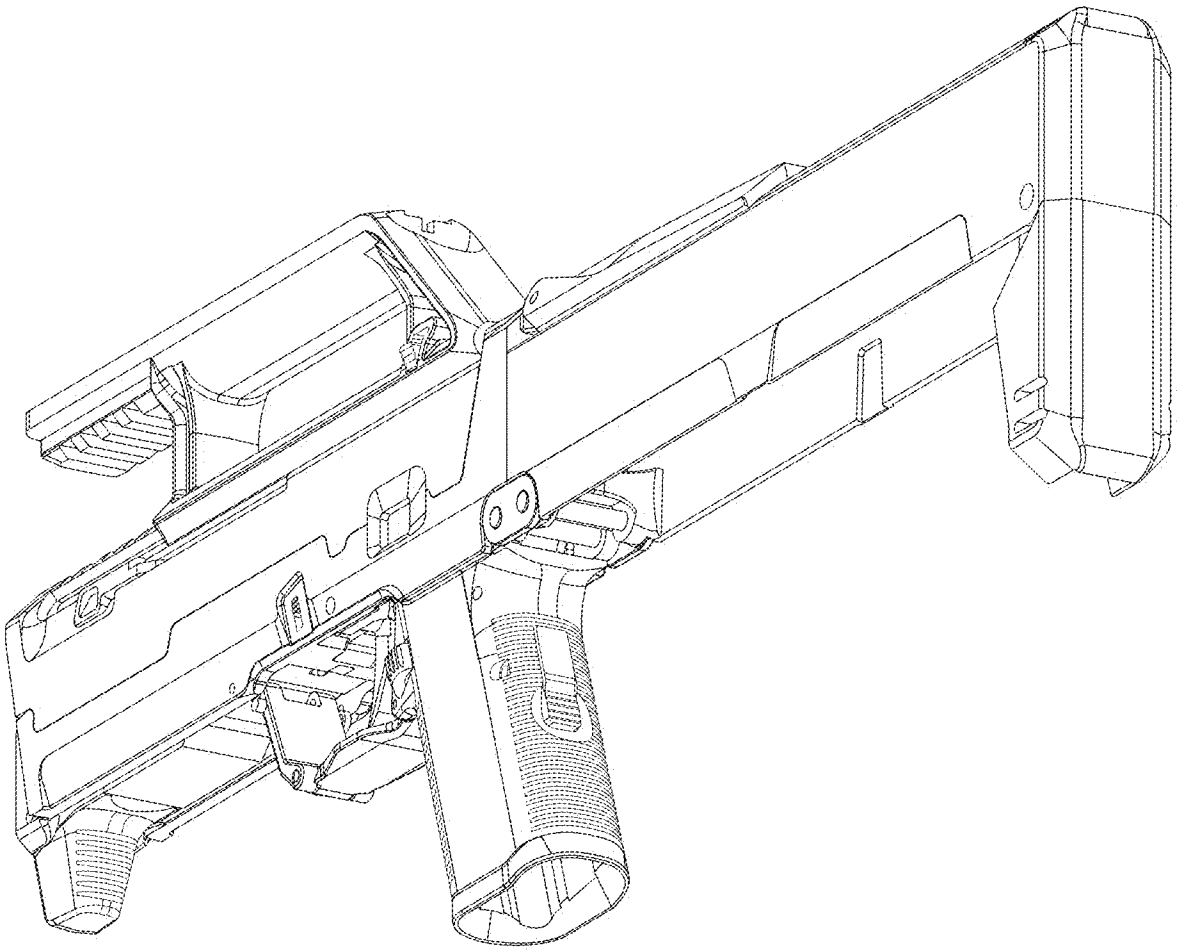
FIG. 14 illustrates a left side view of a third embodiment of a foldable firearm in an unfolded configuration.

FIG. 14 illustrates a deployed view of the foldable firearm of FIG. 13.

Figure 15:
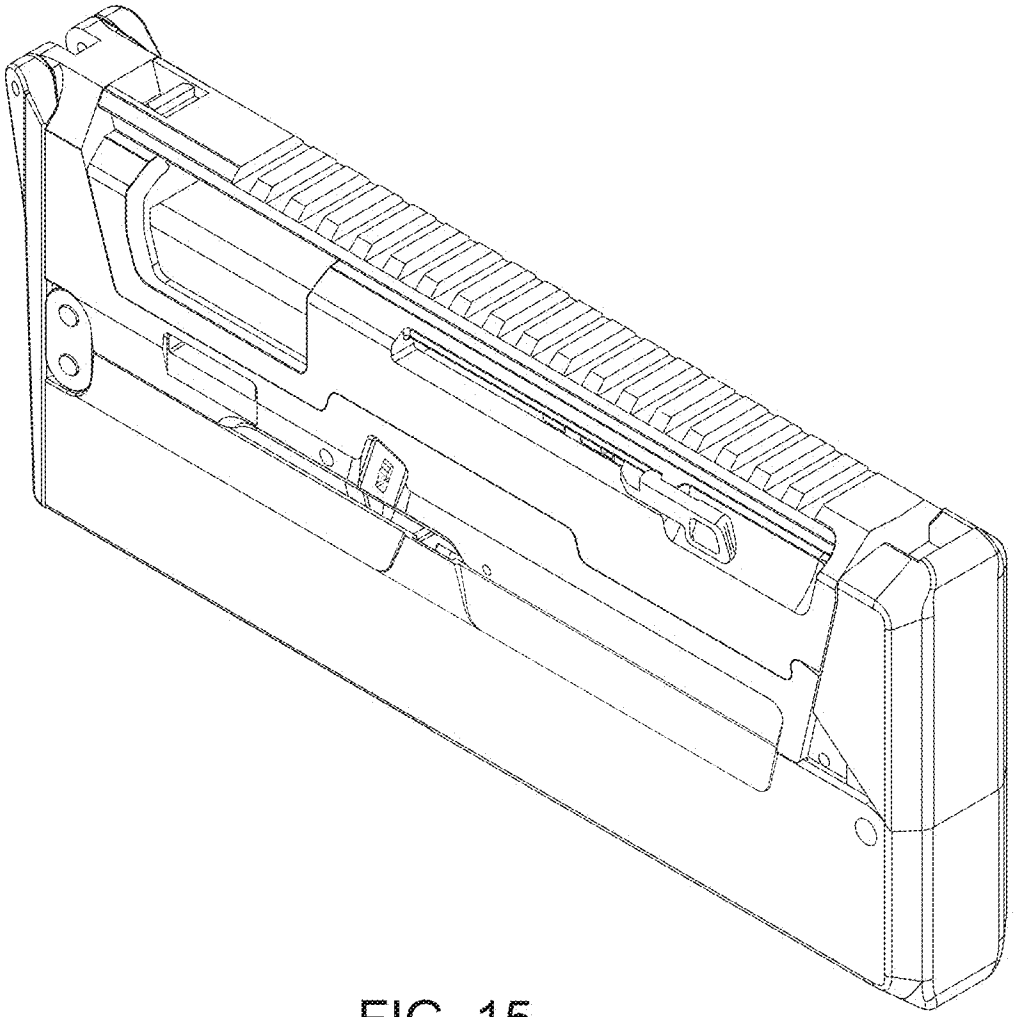
FIG. 15 illustrates a right-side view of a fourth embodiment of a foldable firearm in a folded configuration.
Figure 16:
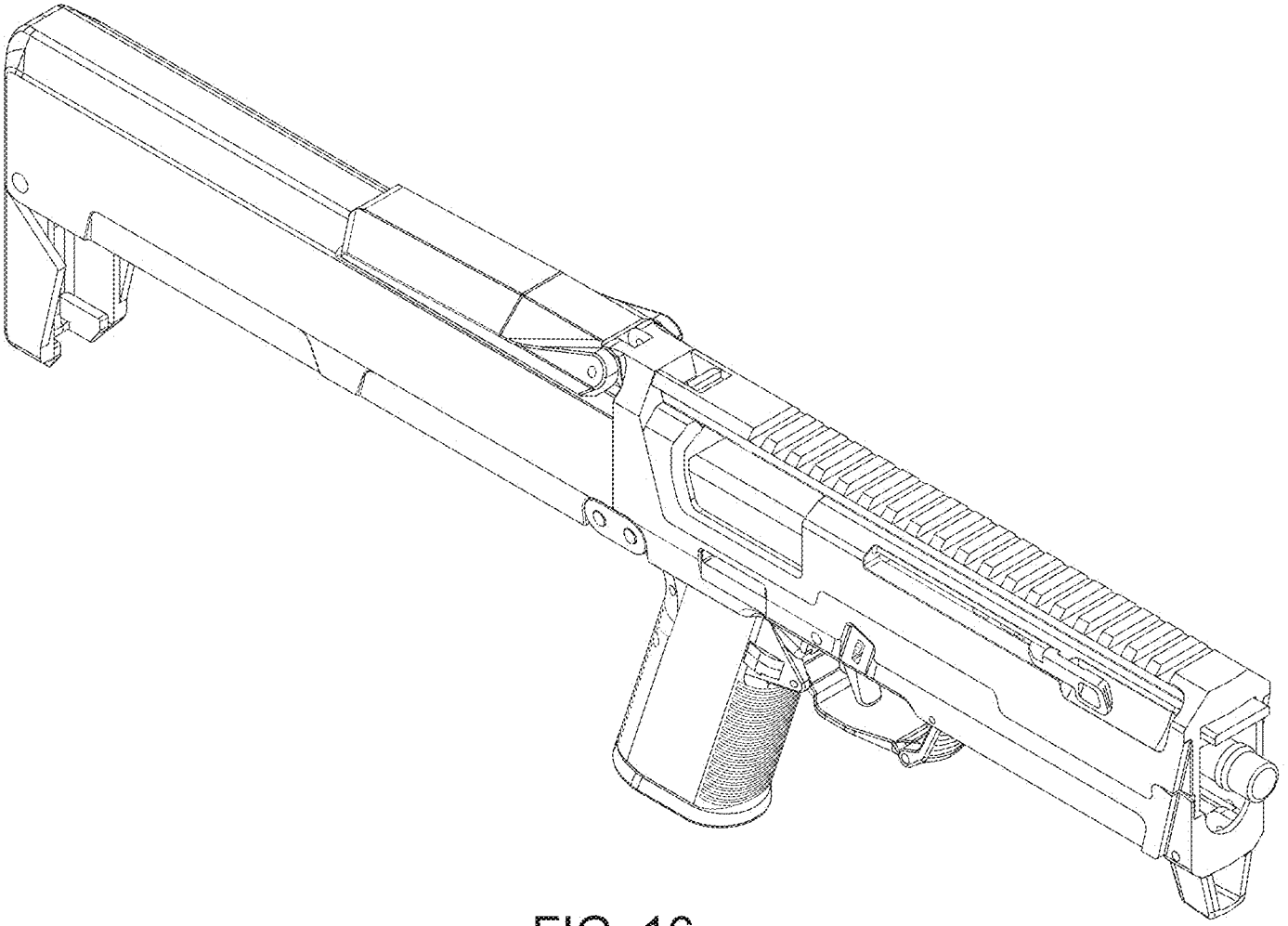
FIG. 16 illustrates a right-side view of a fourth embodiment of a foldable firearm in an unfolded configuration.

FIG. 15 illustrates an embodiment of a foldable firearm with the first hinged tail, in a folded state, but without a carrying handle.

FIGS. 33 and 34 show another embodiment of a folding firearm partway between the deployed and folded/stowed states. FIG. 33 shows the housing and FIG. 34 does not show the lower portion of the housing to make it easier to see the workings of the folding mechanisms.

Two-Part Folding Trigger

To allow the firearm to fold, a collapsible trigger is used to allow the trigger guard to articulate forward. The collapsible trigger can be a two-part design where a lower or forward part of the trigger pivots forward when contacted by the trigger guard. In some embodiments, a torsion spring can be used to bias the lower or forward part of the trigger toward a deployed position. In some embodiments, the lower or forward part of the trigger can be coupled to the upper or rear portion of the trigger via a pivot, for instance, via a pivot pin.

FIGS. 17-19 illustrate one embodiment of a two-part foldable trigger 1702 in deployed (FIG. 17), folding (FIG. 18), and folded (FIGS. 19, 21, and 27C) states. The two-part foldable trigger 1702 pivots around a pivot that can be coextensive with a pin or trigger pivot 1716 or other tubular component passing through a frame (partially visible behind the housing) of the firearm and perpendicular to an axis of the barrel. The two-part foldable trigger 1702 can be considered a part of the frame and the frame can include a fixed rear part 1744 extending downward from an axis parallel to a slide direction of a slide (hidden). The fixed rear part 1744 is sometimes referred to as a "beavertail" and in the deployed state, the fixed rear part 1744 can align with, and along with the foldable pistol grip 1712, form a smooth curve for a user's hand. The two-part foldable trigger 1702 includes a rotating forward part 1706 and a fixed rear part 1708, where the rotating forward part 1706 is free to rotate around the trigger pivot or pin 1716 or other tubular component, while the fixed rear part 1708 is fixed (or at least unable to be moved by the rotating forward part 1706) when the two-part foldable trigger 1702 is folding. When the foldable pistol grip 1712 begins to fold, the foldable trigger guard 1704 starts to fold forward and slightly upward, and the foldable trigger guard 1704 via a grip trigger contact region 1742 contacts and biases forward the rotating forward part 1706 of the two-part foldable trigger 1702. The grip trigger contact region 1742 can be proximal to a top of a front surface of the foldable pistol grip 1712. As the foldable pistol grip 1712 continues to fold, it biases or pushes the rotating forward part 1706 forward causing it to rotate around the trigger pivot or pin 1716 or other tubular component. Foldable pistol grip 1712 may comprise a variety of materials including polymeric material, metal, composite, ceramic, or other suitable materials.

When a user pulls the rotating forward part 1706 back, contact with the fixed rear part 1708 causes the fixed rear part 1708 to rotate backward. The fixed rear part 1708 is coupled to the trigger bar 1728, for instance, via a pin 1710, and thus when the fixed rear part 1708 rotates backward, the trigger bar 1728 moves backward and releases the striking mechanism. When folding occurs, the rotating forward part 1706 is pushed forward by the foldable pistol grip 1712 and separates or decouples from the fixed rear part 1708. Because the rotating forward part 1706 is in contact with the grip trigger contact region 1742 during folding and once folded, it cannot be moved backward to contact the fixed rear part 1708 and thus the trigger bar cannot be moved (i.e., there is an inherent safety when the firearm is folded). FIGS. 35-37 show an alternative embodiment where the foldable trigger 134 has decoupled from the trigger bar 141 after folding. In this embodiment, a fixed rear part is not used, and instead the foldable trigger 134 couples directly to the trigger bar in the deployed state and decouples therefrom when folding.

The foldable trigger guard 1704 can include a bottom leg 1730 and a front leg 1732 coupled at a pivot 1734 being oblique to each other when in the deployed state as seen in FIG. 17. The bottom leg 1730 can be substantially horizontal, while the front leg 1732 can be arranged at an obtuse angle relative to the bottom leg 1730 and can extend forward and upward from the pivot 1734 until meeting the housing 1714. The front leg 1732 can couple to the housing 1714 at a pivot 1736 from within a channel within the housing 1714, and the bottom leg 1730 can couple to the foldable pistol grip 1712 at a pivot 1738. The pivot 1738 can be arranged higher than the pivot 1734 but lower than the pivot 1736. The front leg 1732 can couple to the housing 1714 via pivot pins or other structures that extend outward toward the housing 1714. Similarly, the foldable pistol grip 1712 can couple to the housing 1714 via pivot pins or other structures that extend outward toward the housing 1714. In other words, the foldable pistol grip 1712 and the front leg 1732 can be arranged within the housing 1714, or within an opening in a bottom of the housing 1714 (e.g., a channel) and can include outwardly-coupling members to pivotally couple to the housing 1714 from within the opening or channel. During folding, the pivot 1734 can move forward and arc upward until it and the front leg 1732 fold up into the opening in the housing 1714, with the bottom leg 1730 folding up beneath the front leg 1732 but below a bottom of the housing 1714.

The housing 1714 may include a cutout 1740, for instance, having a trapezoidal shape, in a bottom thereof that extends to either side of the two-part foldable trigger 1702. This cutout 1740 may extend forward proximal to the front leg 1732 and rearward past a front edge of the foldable pistol grip 1712, although other dimensions of the cutout 1740 can also be implemented. The cutout 1740 extends past a front of the trigger 1702 sufficiently to allow a user to easily access a front of the two-part foldable trigger 1702 with a finger, hence the advantage of extending this cutout 1740 to near the front leg 1732.

Previous folding guns have arranged a trigger and grip to pivot about separate axes where the grip pivot 1718 is behind the trigger pivot (see U.S. Pat. No. 8,006,425). However, to promote compact folding, this disclosure describes a grip pivot 1718 that can be forward of the trigger pivot 1716 (e.g., see FIGS. 17-19), forward and higher than the trigger pivot 1716 (e.g., see FIGS. 17-19), or coextensive with the trigger pivot 1716 (e.g., see FIGS. 1, 4-6, 12, 14, and 16).

Figure 21:
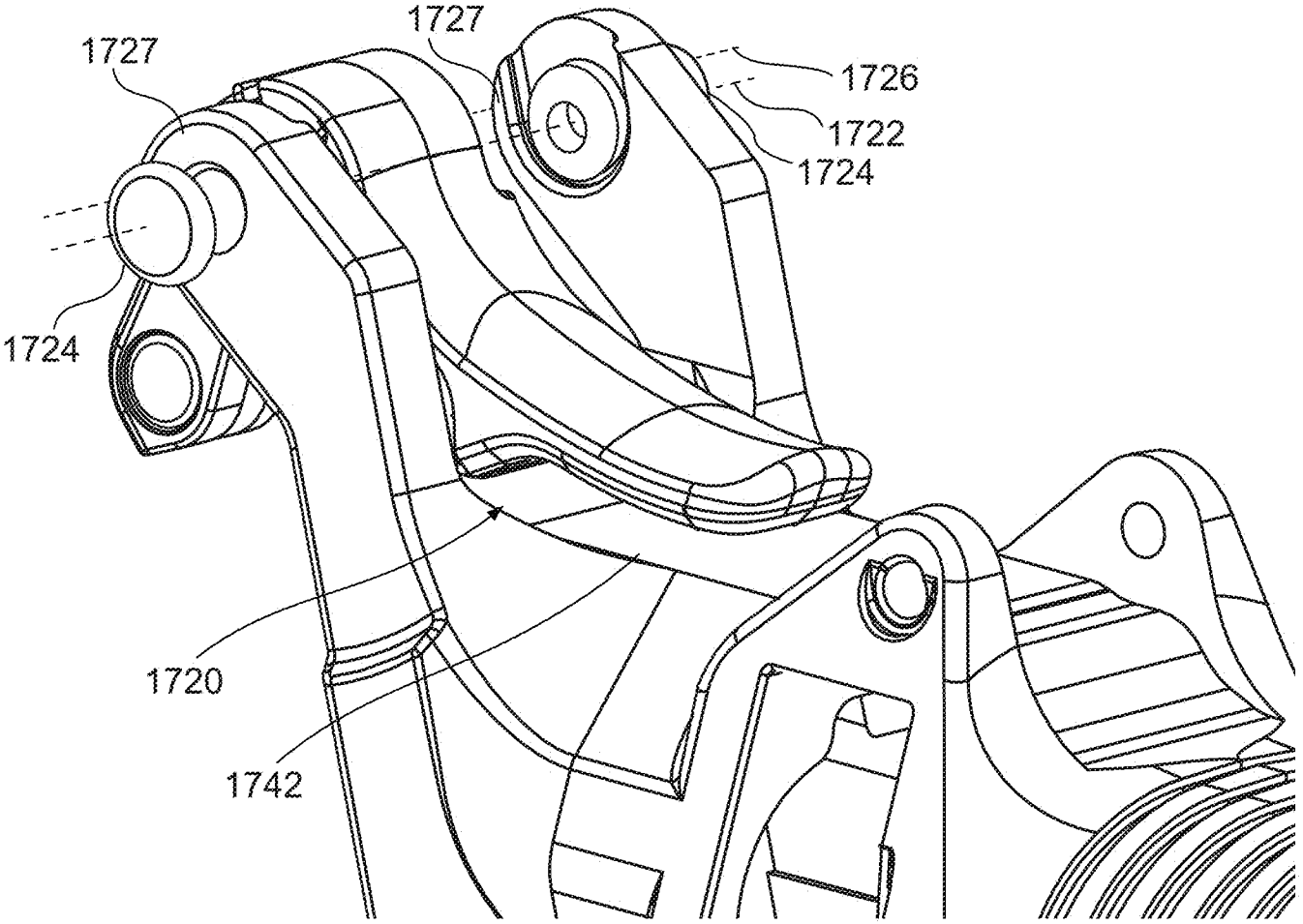
FIG. 21 shows a detailed embodiment of a two-part folding trigger and folding grip in the stowed/folded state.

The foldable pistol grip 1712 can include a cutout 1720 best seen in FIG. 21, arranged between two extensions 1727 that allows the foldable pistol grip 1712 to fold past and clear the fixed rear part 1708 of the two-part foldable trigger 1702 (see FIG. 19). There can be two or more extensions 1727 extending between a body of the foldable pistol grip 1712 and the grip pivot 1718, and they may couple to the housing 1714 rather than the frame at a grip pivot ahead of or ahead of and higher than the trigger pivot 1716. The body of the foldable pistol grip 1712 can include those portions of the foldable pistol grip 1712 visible below the housing 1714 in FIG. 17 (the extensions being hidden within the housing 1714). In this figure, the rotating portion of the trigger has been biased forward via a grip trigger contact region 1742.

To make the firearm more compact, the frame may include recesses on outer sides (see recesses 2729 in FIG. 27) shaped to accept the extensions 1727 (2727 in FIGS. 27) and allow movement thereof during folding of the foldable pistol grip 1712. In particular, the recesses may have an angled shape as seen in FIG. 27 with an angular spread of around 90. In this way, a first width between outer faces of the extensions 1727 can be substantially the same as a second width of the frame proximal to the two extensions 1727. In this way, the foldable pistol grip 1712 can have a similar width to that of the frame. The foldable pistol grip 1712 can include a locking arm 1723 that extends substantially upward from a back portion of the foldable pistol grip 1712 and locks into a fixed rear part 1744 of the frame when the folding firearm is in the deployed state.

Figure 20:
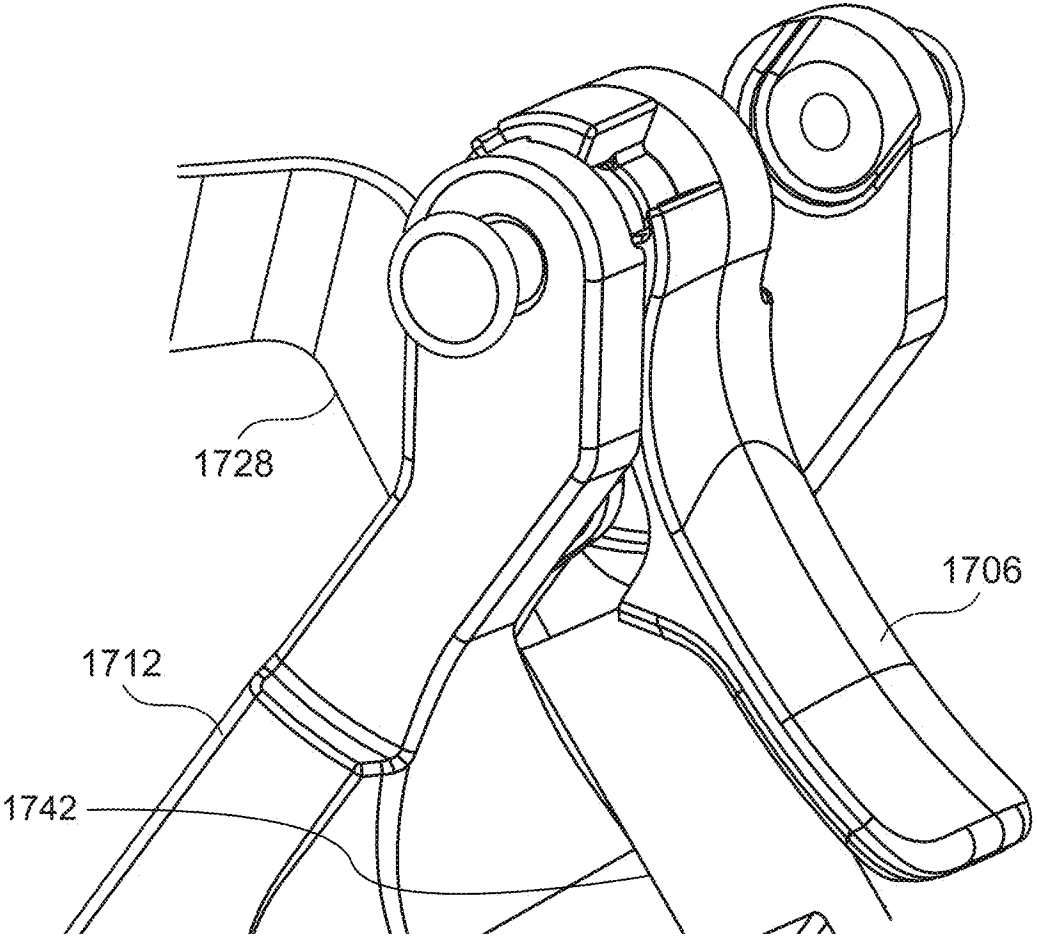
FIG. 20 shows a detailed embodiment of a two-part folding trigger and trigger bar in the process of folding, such as the one shown in FIGS. 17-19.

FIG. 18 shows an embodiment of the trigger as the firearm begins to fold. The two-part foldable trigger 1702 is configured to fold forward and split into a fixed rear part 1708 and a forward part 1706 when the grip trigger contact region 1742 of the foldable grip biases the two-part foldable trigger 1702 forward and the foldable grip is folded about a pivot 1718 while the foldable trigger 1702 folds around a trigger pivot axis 1716. Although the pivots 1718 and 1716 are illustrated as distinct, in some embodiments, they can be coextensive or the same. The fixed rear part 1708 of the two-part foldable trigger 1702 is coupled to a trigger bar 1728 (see FIG. 20) that controls release of a striking mechanism. When the fixed rear part 1708 is moved backward by user depression of the two-part foldable trigger 1702, this correspondingly pushes the trigger bar 1728 back, which in turn releases the striking mechanism and fires the weapon. However, as folding begins, the rotating forward part 1706 of the two-part foldable trigger 1702 begins to rotate forward and is no longer in contact with the fixed rear part 1708. As such, there is no way for a user or an object that accidentally enters the foldable trigger guard 1704 to contact and accidentally move the fixed rear part 1708 and the trigger bar 1728. In other words, once the firearm begins to fold, accidental movement of the trigger bar 1728 is precluded. When the rotating forward part 1706 of the two-part foldable trigger 1702 is completely unfolded to its deployed position, and in contact with the fixed rear part 1708, the striking mechanism can be released. It should be understood that the fixed rear part 1708 does not move when the grip is being folded, but does rotate backward with the forward part 1706 when the grip is deployed and the trigger is depressed.

Figure 26:
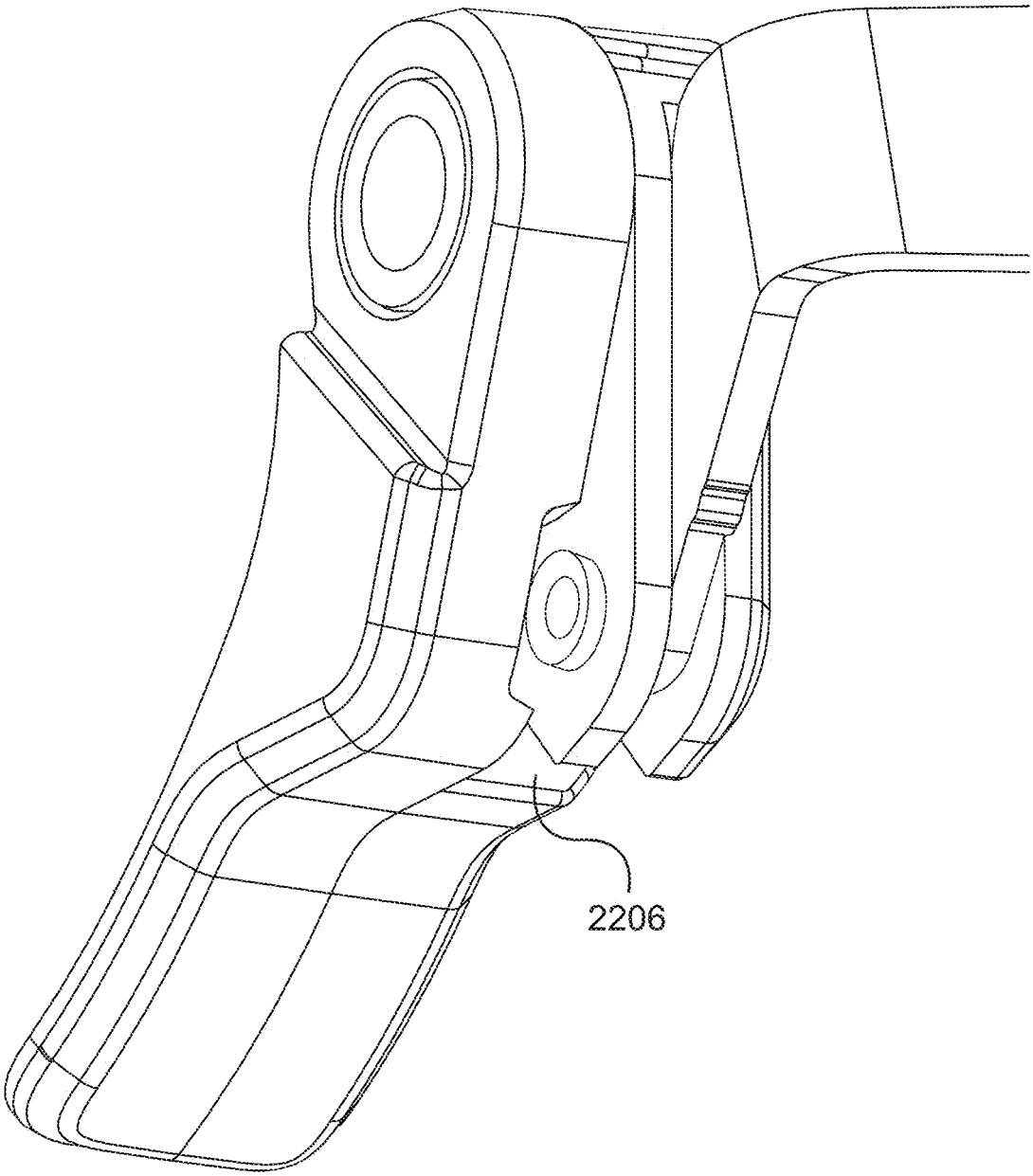
FIG. 26 shows another view of the embodiment shown in FIG. 25.

Although not required, the trigger bar 1728 meets the fixed rear part 1708 along a plane offset from a plane passing through a middle of the rotating forward part 1706. This is best seen in FIG. 26 where the trigger bar 1728 meets the fixed rear part 1708 to a right of a plane through a middle of the rotating forward part 1706. This offset helps to optimize a strength of the rotating forward part 1706 by minimizing any narrow sections of material in the rotating forward part 1706 (e.g., prevents splitting the rotating forward part 1706 into two separate thin sections on either side of the fixed rear part 1708).

Figure 22:
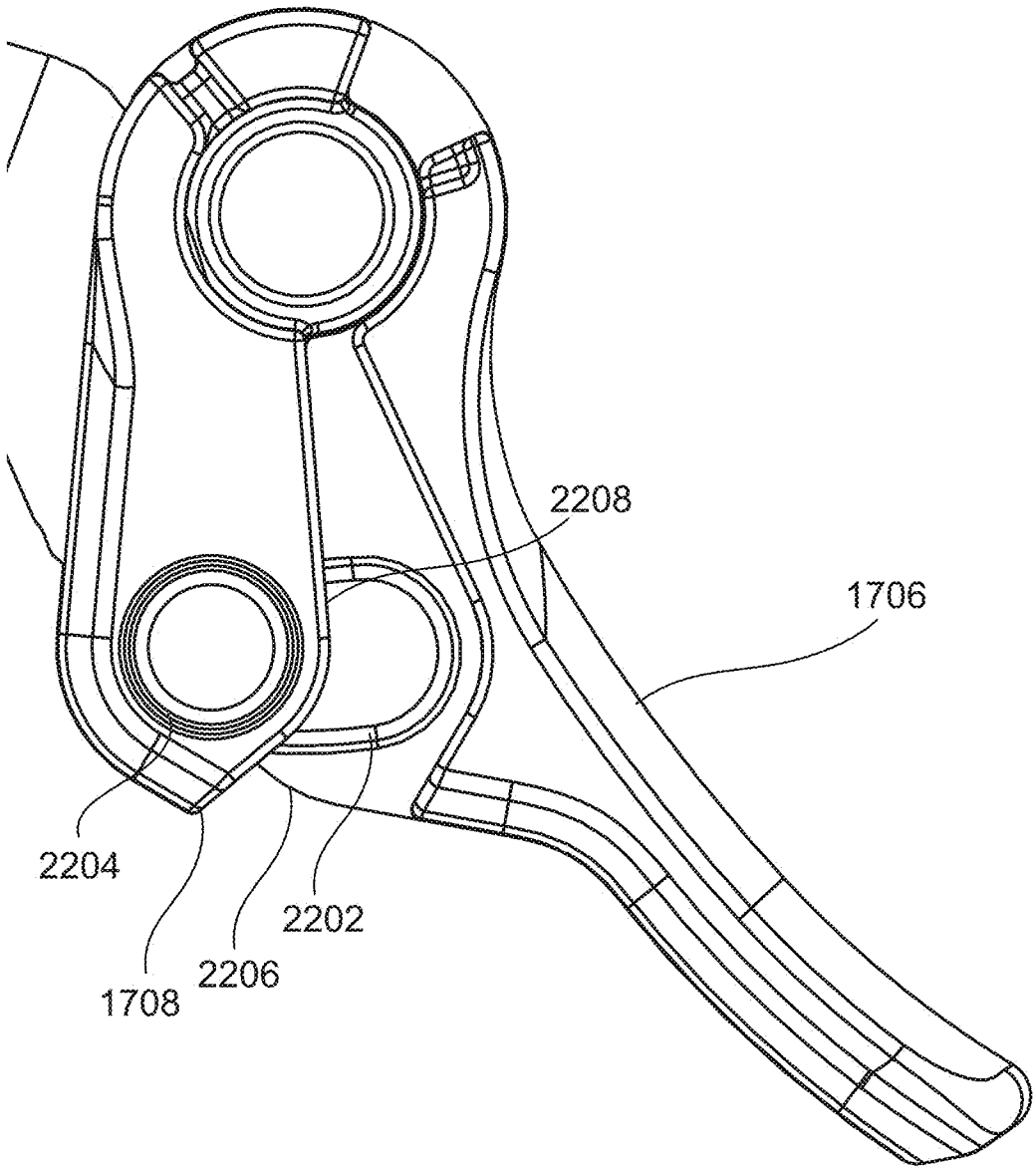
FIG. 22 shows a profile view of the embodiment shown in FIG. 20, where the two-part trigger has started to separate and fold forward.

The rotating forward part 1706 can include an arced slot 2202, as seen in FIG. 22, that is shaped to guide a pin 2204 in the fixed rear part 1708 as the rotating forward part 1706 rotates from a folded to a deployed position. The rotating forward part 1706 is shown in a folding position in FIG. 22 and in a folded position in FIGS. 23 and 24 (though the grip is not completely folded in FIGS. 23 and 24). The pin 2204 can pass through an aperture in the fixed rear part 1708 and extend into the arced slot 2202 or can be unitary with the fixed rear part 1708. The pin 2204 can also couple the trigger to the trigger bar as better seen in FIG. 25.

The rotating forward part 1706 further can include a depression 2206 that is shaped to receive a curved forward edge 2208 of the fixed rear part 1708. The interfacing of this depression 2206 and the curved forward edge 2208 when the trigger is pulled helps ensure a solid lock between the two parts of the trigger when the trigger is pulled backward from a deployed position and to efficiently transfer energy from the user's pull into the trigger bar. The curved forward edge 2208 and the depression 2206 can also be seen in FIGS. 25 and 26.

FIG. 21 also shows an embodiment of the two pivot axes of the grip and trigger. Grip pivot axis 1722 passes through pivot pins 1724 of the foldable pistol grip 1712, and these pins 1724 create a rotatable coupling between the foldable pistol grip 1712 and the housing (not shown). Trigger pivot axis 1726 passes through the two-part foldable trigger 1702 and the frame (see FIG. 27) and in some embodiments does not pass through the housing.

Figure 23:
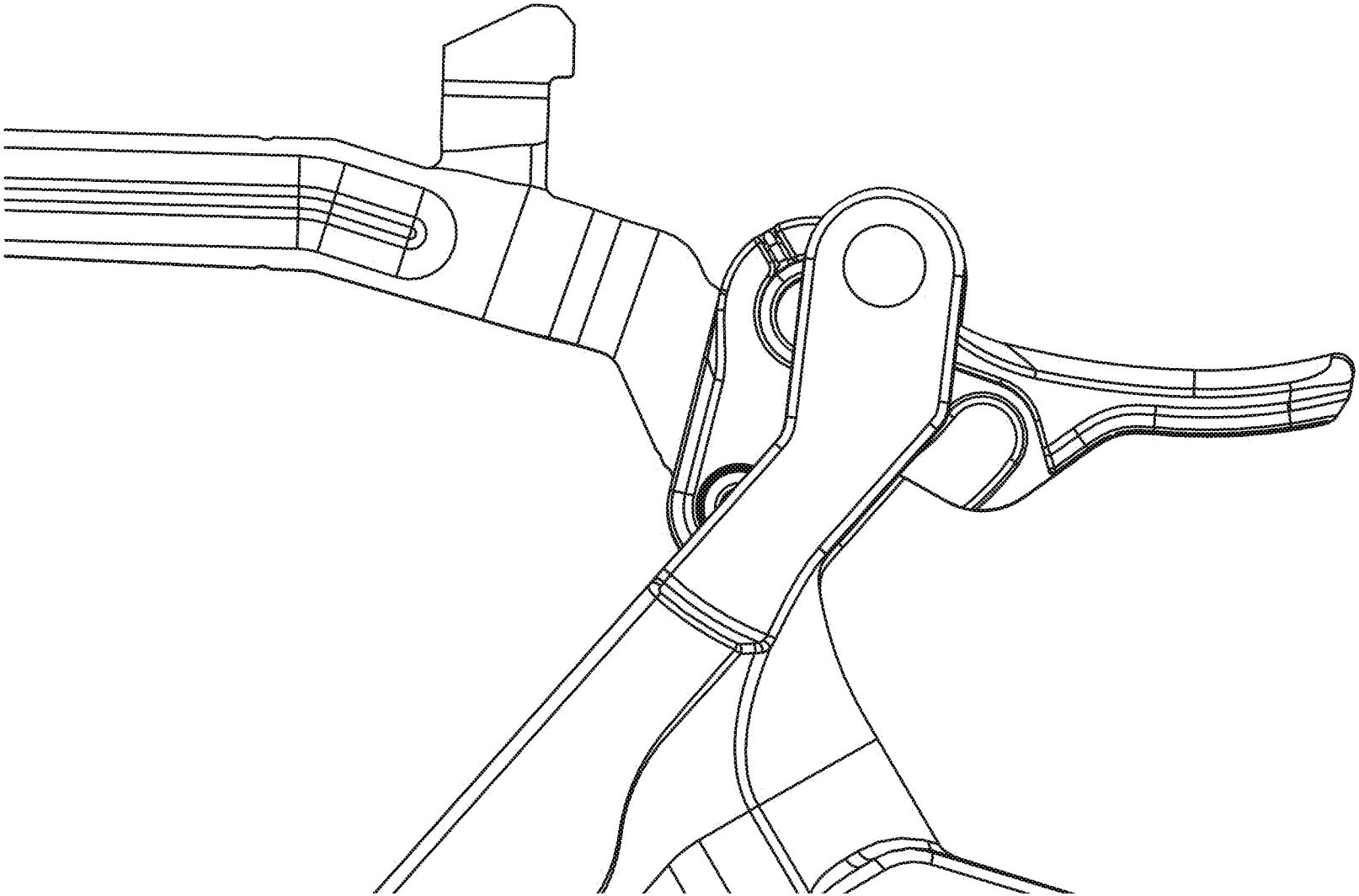
FIG. 23 shows an embodiment of the grip, trigger, and trigger bar during the folding process.

FIG. 23 shows an embodiment of the grip, trigger, and trigger bar during the folding process. The frame and housing are hidden to more clearly show the interaction of these three components. In this illustration, the rotating forward portion of the trigger has rotated forward beyond a rate of rotation of the grip, which would typically not occur in practice, but is illustrated here to help visually separate the illustrated components.

Figure 24:
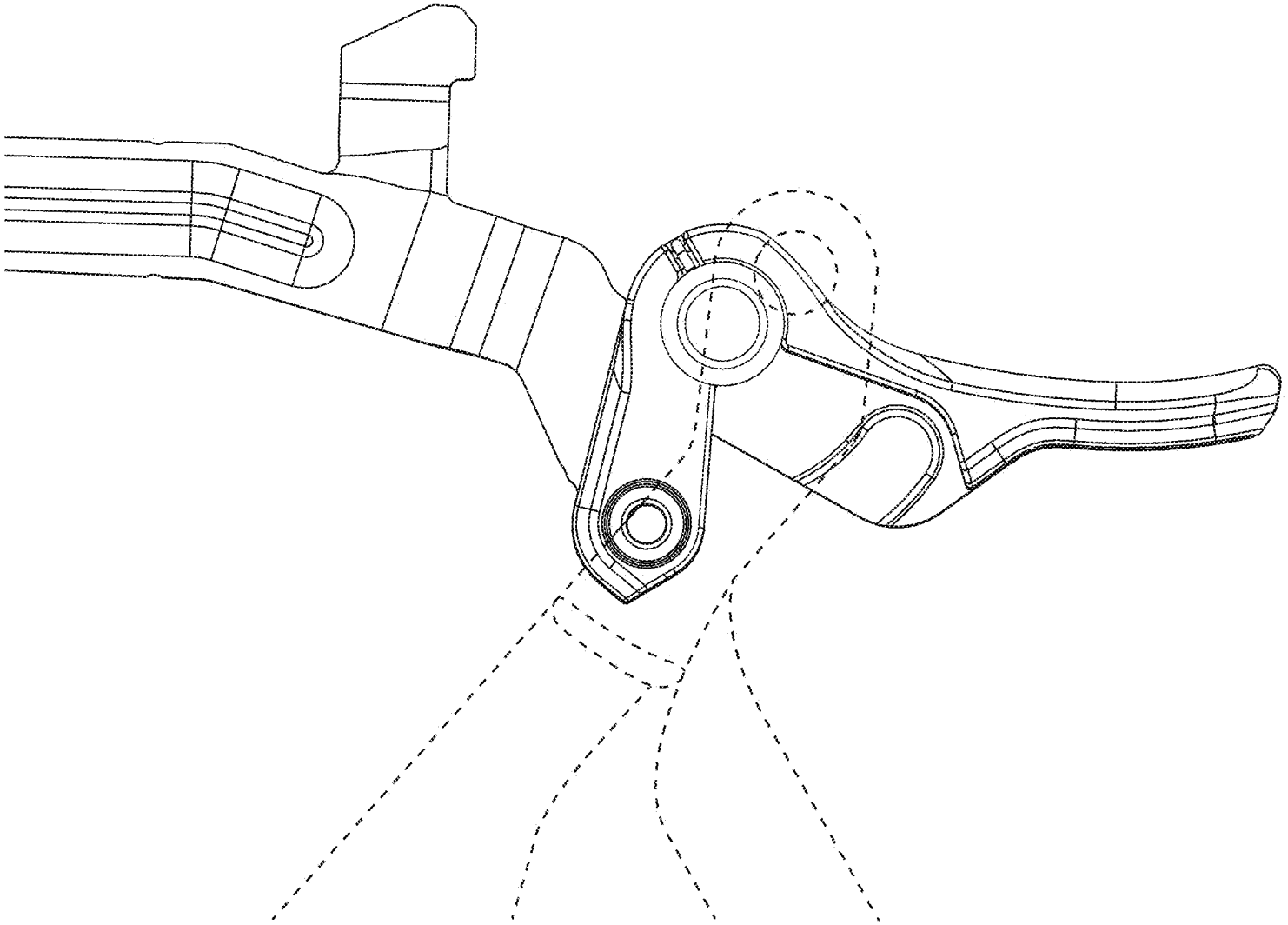
FIG. 24 shows another view of FIG. 23, but with the grip shown transparently, so that the offset between the grip and trigger pivot is more clearly visible
Figure 25:
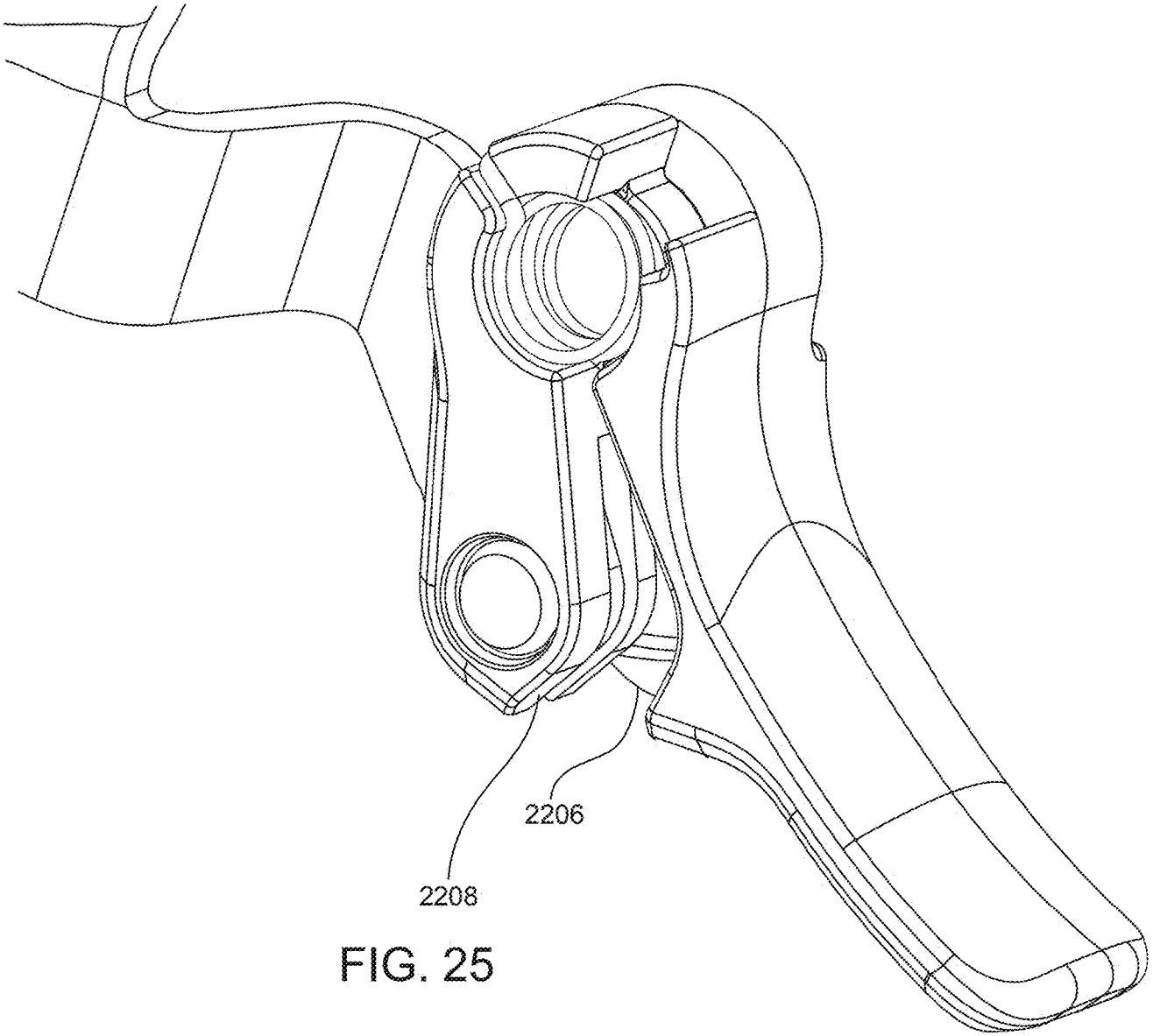
FIG. 25 shows a detailed embodiment of a two-part folding trigger and trigger bar between the deployed and stowed/folded states.

FIG. 24 shows another view of FIG. 23, but with the grip shown transparently, so that the offset between the grip and trigger pivot is more visible. The pivot pins or other structures passing through the grip pivot do not overlap with the pivot pin or other structure passing through the trigger. In other words, these two pivots are distinct and not coextensive. At the same time, the pins or other structures around which rotation occurs, may overlap, or may be aligned on a common tangent or close to overlapping from the profile view as shown in FIG. 24. As seen, the grip pivot can be forward of the trigger pivot. Alternatively, and as shown, the grip pivot can be forward of and higher than the trigger pivot. FIG. 24 shows just one arrangement of the grip and trigger pivots, and in some embodiments, these two pivots may be one and the same (i.e., aligned on a common axis). In that embodiment, one or more pivot pins can be used to couple the trigger to the frame and the grip to the housing.

Figure 1:
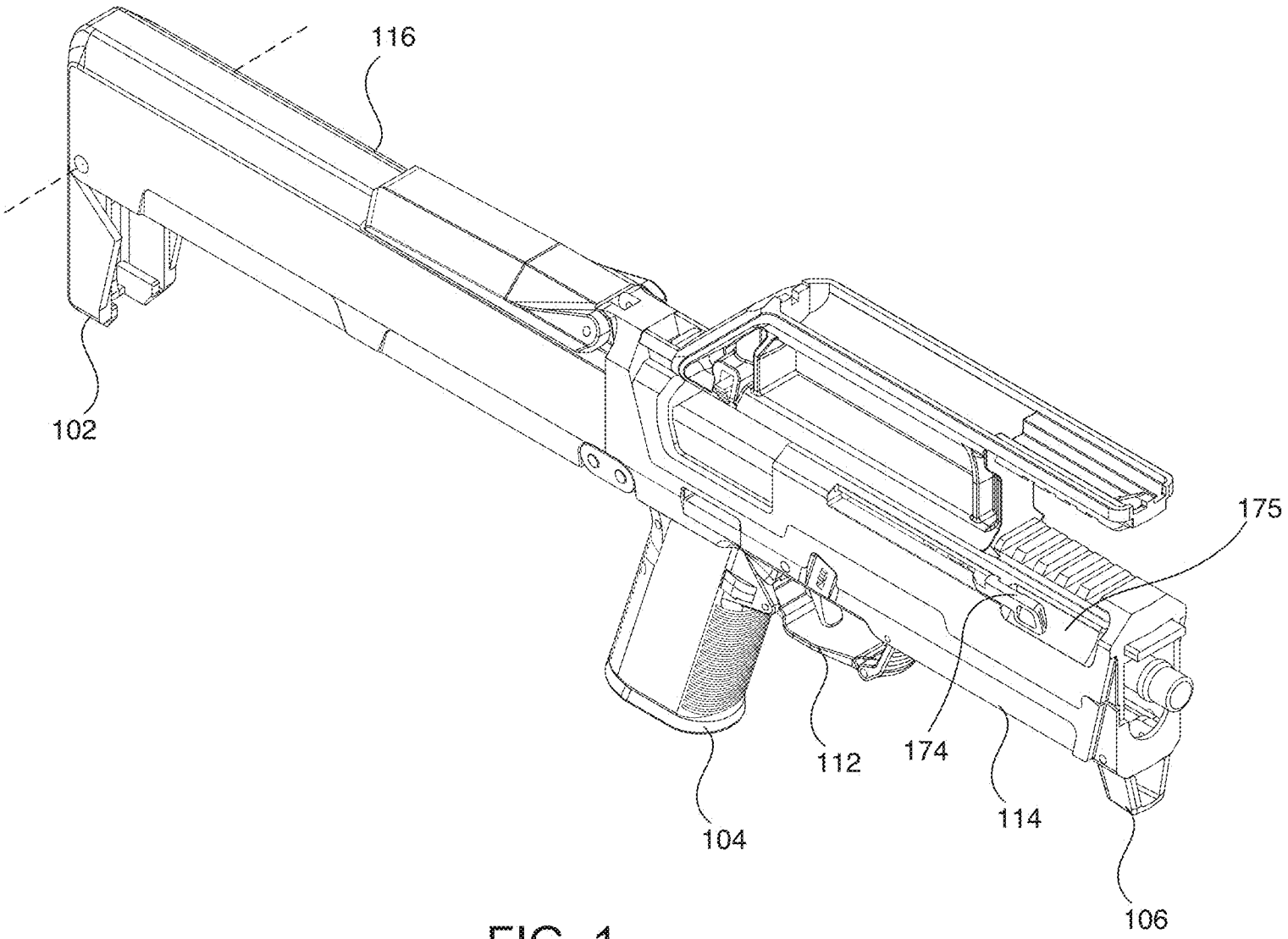
FIG. 1 illustrates a right-side view of a first embodiment of a foldable firearm in an unfolded configuration.
Figure 2:
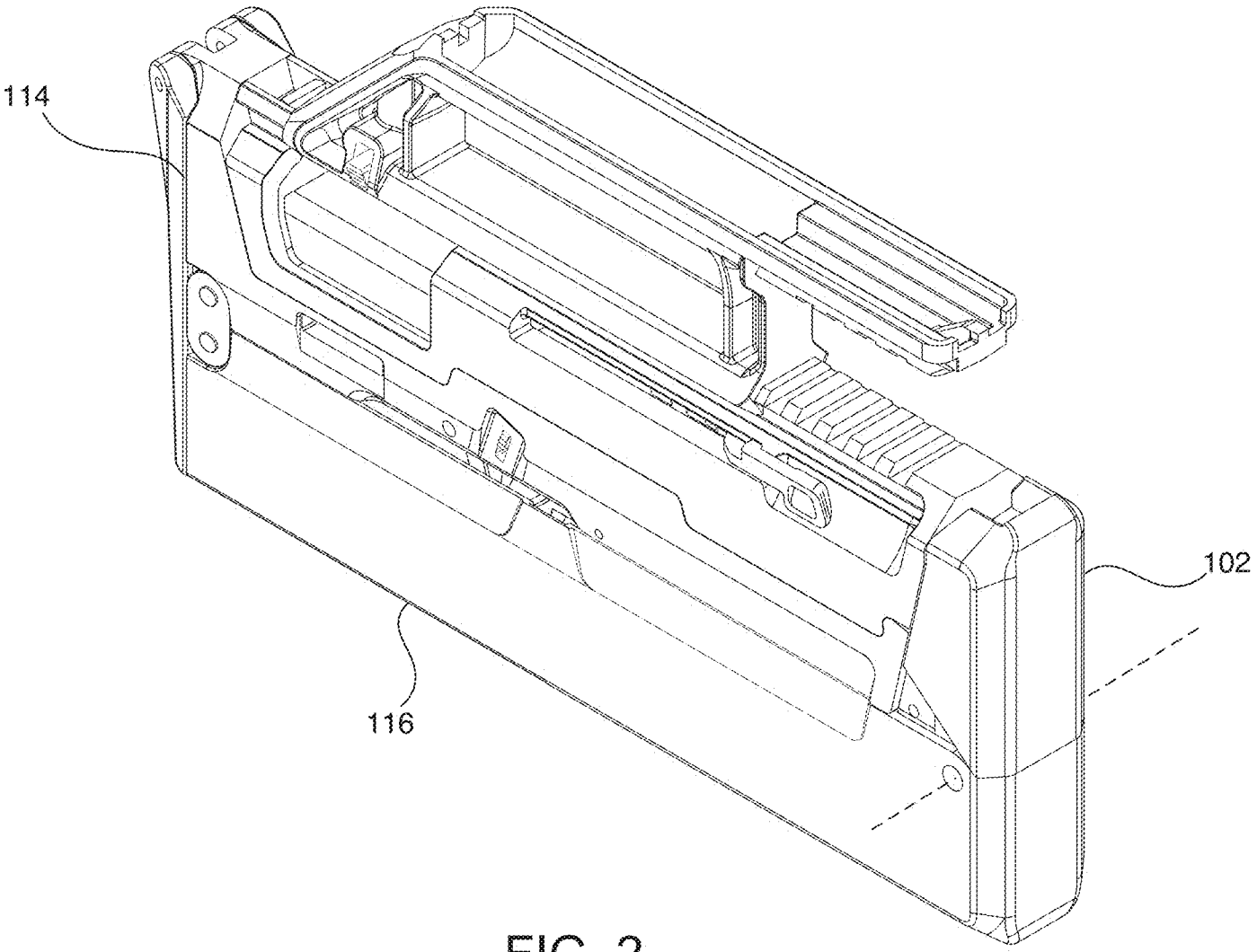
FIG. 2 illustrates a right-side view of a first embodiment of a foldable firearm in a folded configuration.
Figure 3:
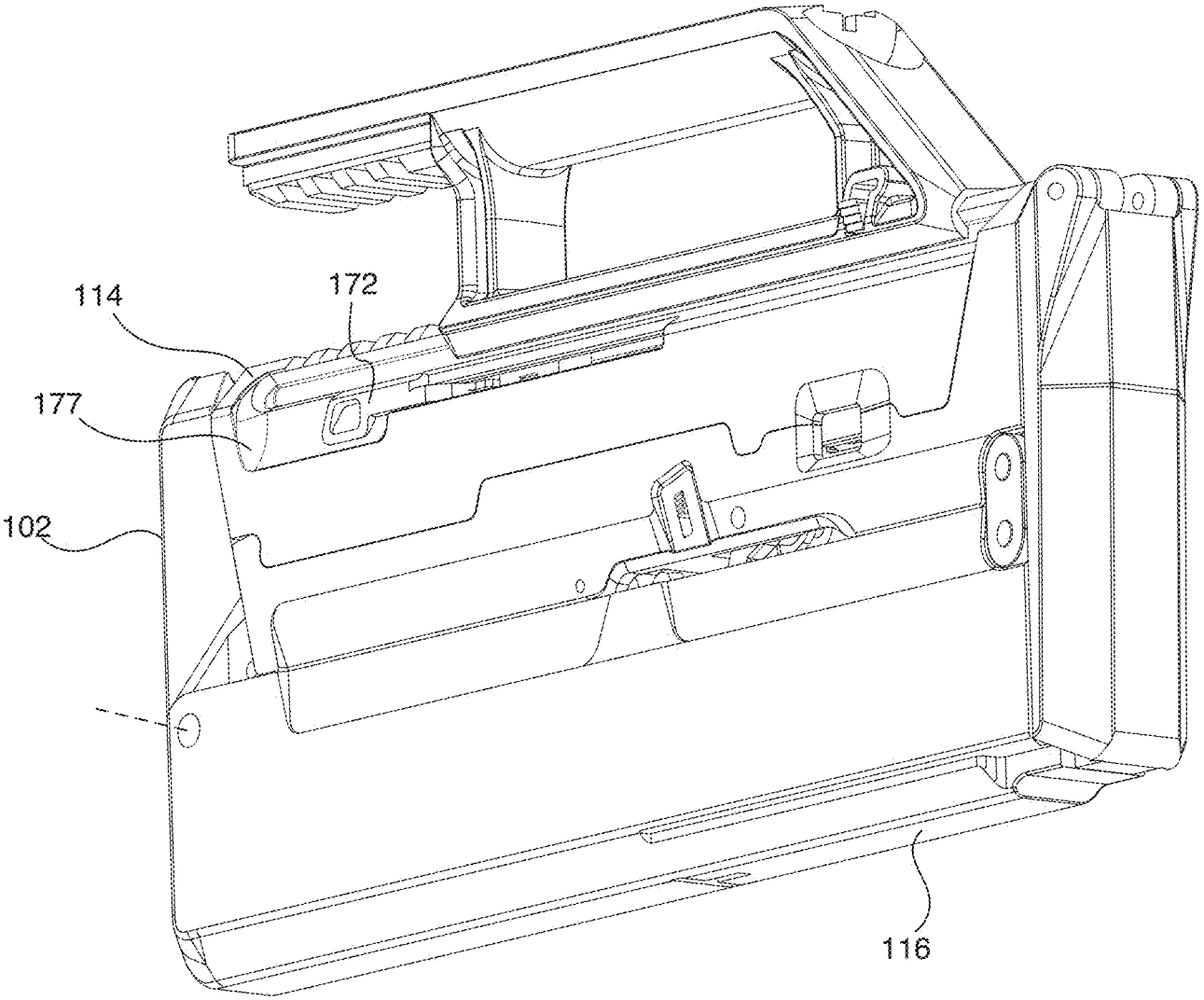
FIG. 3 illustrates a left side view of a first embodiment of a foldable firearm in a folded configuration.
Figure 27A:
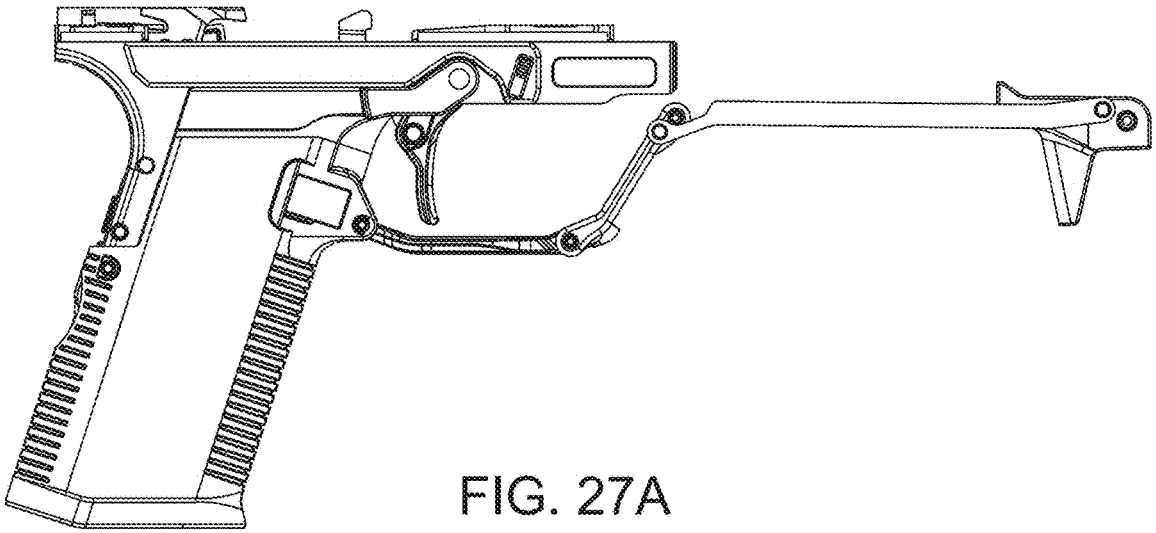
FIG. 27A illustrates an embodiment of the foldable trigger guard assembly seen in FIGS. 1 and 4 and similar to that seen in FIGS. 17-19, in a deployed state.
Figure 27B:
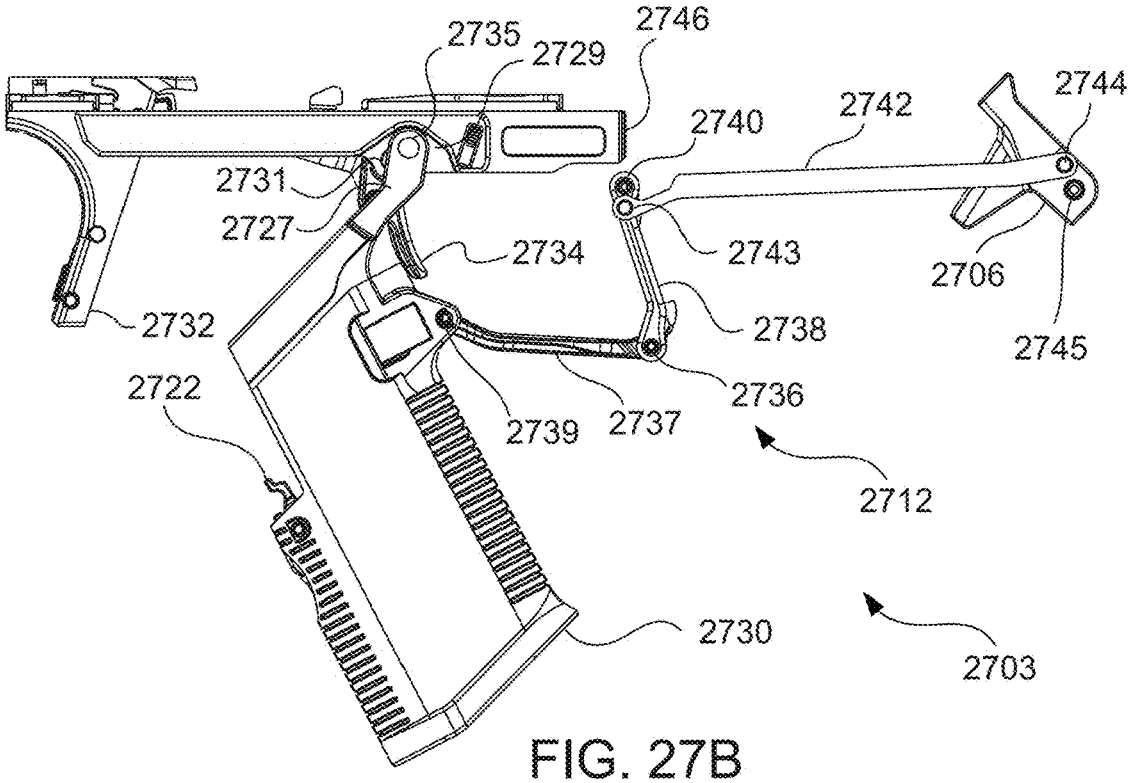
FIG. 27B illustrates the embodiment of FIG. 27A in between deployed and stowed/folded states.
Figure 27C:
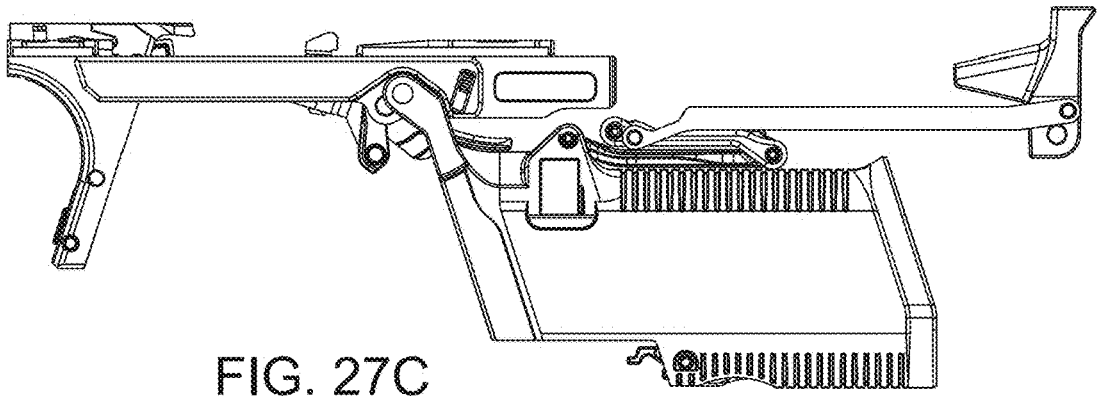
FIG. 27C illustrates the embodiment of FIG. 27A in the stowed/folded state.

FIGS. 27A, 27B, and 27C illustrate an alternative of the foldable trigger guard assembly 112 seen in FIGS. 1 and 4 and similar to that seen in FIGS. 17-19. In these illustrations the housing has been hidden to increase visibility of the folding mechanisms. FIG. 27A shows the foldable trigger guard assembly in a deployed state while FIG. 27C shows the foldable trigger guard assembly in a stowed or folded state. FIG. 27B shows the foldable trigger guard assembly in between these two states (either folding or unfolding).

In this embodiment, the foldable grip assembly 2703 includes a foldable grip 2730, a foldable trigger guard assembly 2712, and a safety hand stop 2706. The foldable grip 2730 can lock onto a fixed rear part 2732 of the frame 2746 via a locking arm 2722 and this locking arm 2722 can be disengaged to allow folding of the firearm. The fixed rear part 2732 can extend downward from an axis parallel to a slide direction of a slide of the folding firearm. Disengaging the locking arm 2722 can be via depression of a button or other release mechanism on a back of the foldable grip 2730.

The foldable trigger guard assembly 2712 is partly formed by a front face of the foldable grip 2730, a bottom leg 2737, a front leg 2738, and a bottom surface of the frame 2746 and the housing (hidden). The foldable trigger guard assembly 2712 also includes a foldable trigger 2734 that may be a two-part foldable trigger as seen, for instance, in FIGS. 18-26. The foldable trigger guard assembly 2712 and the safety hand stop 2706 are coupled via a folding bar 2742. These components are interconnected via pivot axes such that the foldable trigger guard assembly 2712 can fold into a relatively flat state when the foldable grip assembly 2703 is folded.

When the foldable grip assembly 2703 starts to fold, the foldable grip 2730 can begin to rotate away from the fixed rear part 2732 about a grip-housing pivot axis 2735 (or a first pivot axis). This grip-housing pivot axis 2735 can be slightly forward and higher than that of the trigger pivot axis 2731 (or a fifth pivot axis) and forward of a front surface of the foldable grip 2730 (though in some embodiments, the grip-housing pivot axis 2735 can be aligned with the trigger pivot axis 2731). The bottom leg 2737 is rotatably coupled to the foldable grip 2730 via a grip-trigger guard pivot axis 2739 (or a second pivot axis), and rotatably coupled to the front leg 2738 via a trigger guard pivot axis 2736 (or a third pivot axis). The front leg 2738 is coupled to the housing (hidden) via a trigger guard-housing pivot axis 2740 (or a fourth pivot axis). Pivot pins or other structure for rotatably coupling the front leg 2738 to the housing can extend outward from the front leg 2738 allowing the front leg 2738 to be arranged within an opening in a bottom of the housing rather than an outside of the housing, which would increase the overall width of the platform. In one embodiment, the front leg 2738 is coupled to the housing and not to the frame 2746. The folding bar 2742 spans between the front leg 2738 and the safety hand stop 2706 and is coupled to the front leg 2738 via a trigger guard-locking bar pivot axis 2743 and is coupled to the safety hand stop 2706 via a locking bar-safety hand stop pivot axis 2744. The trigger guard-locking bar pivot axis 2743 can be arranged proximal to, and below (when in the deployed state), the trigger guard-housing pivot axis 2740 and toward a top end of the front leg 2738. The locking bar-safety hand stop pivot axis 2744 and the safety hand stop-housing pivot axis 2745 can be proximal but offset, and a safety hand stop-housing pivot axis 2745 can be fixed relative to the housing, while the locking bar-safety hand stop pivot axis 2744 can be free to move along an arcing path relative to the housing, and centered around the safety hand stop-housing pivot axis 2745. When foldable grip assembly 2703 is folded, the front leg 2738 rotates forward about trigger guard-housing pivot axis 2740, which pushes the folding bar 2742 forward, which in turn rotates the safety hand stop 2706 back and upward around the safety hand stop-housing pivot axis 2745. This folds the safety hand stop 2706 up and into an opening in a bottom of the housing.

The frame 2746 may include recesses 2729 on outer sides of the frame 2746 (only one of which is visible in FIG. 27). The recesses 2729 may be shaped to accept extensions 2727 of the foldable grip 2730 and to allow rotation or movement of the extensions 2727 as the foldable grip rotates between the deployed and stowed/folded states. Arranging the extensions 2727 within the recesses 2729 may allow a width of the foldable grip 2730 to be reduced and to be roughly the same as a width of the frame 2746. This helps to minimize a footprint of the platform. As seen, the recesses 2729 can have a triangular shape with two top edges arranged at a roughly 90 angle.

Manual Safety

Glock-type weapon systems which rely on a trigger safety are at additional risk for accidental discharge when utilized on a weapon that is not primarily carried in a holster or with another trigger guard shielding device, such as the folding firearm herein disclosed. While the embodiments shown here are intended to be mostly carried in a folded configuration with the trigger mechanism shielded, it can also be carried in a deployed (unfolded) state for immediate action. When used in this manner, especially when carried on a sling, elements of a user's equipment (such as straps, buttons, antennas, knobs, other protrusions) or environmental features (branches, debris) may inadvertently enter the trigger guard, overcome the trigger safety and discharge the weapon. To overcome this danger, a manual thumb-activated safety is disclosed to provide expected levels of safety when handling the weapon in this way.

In an embodiment, the manual safety can include a rotating arm with a lobe that blocks the trigger bar, or holds it, in a "safe position" and prevents the trigger from being depressed. In the "fire position," the lobe is arranged out of a path of the trigger bar, thereby allowing the trigger to be depressed and energize a striker mechanism via the trigger bar.

Figure 28:
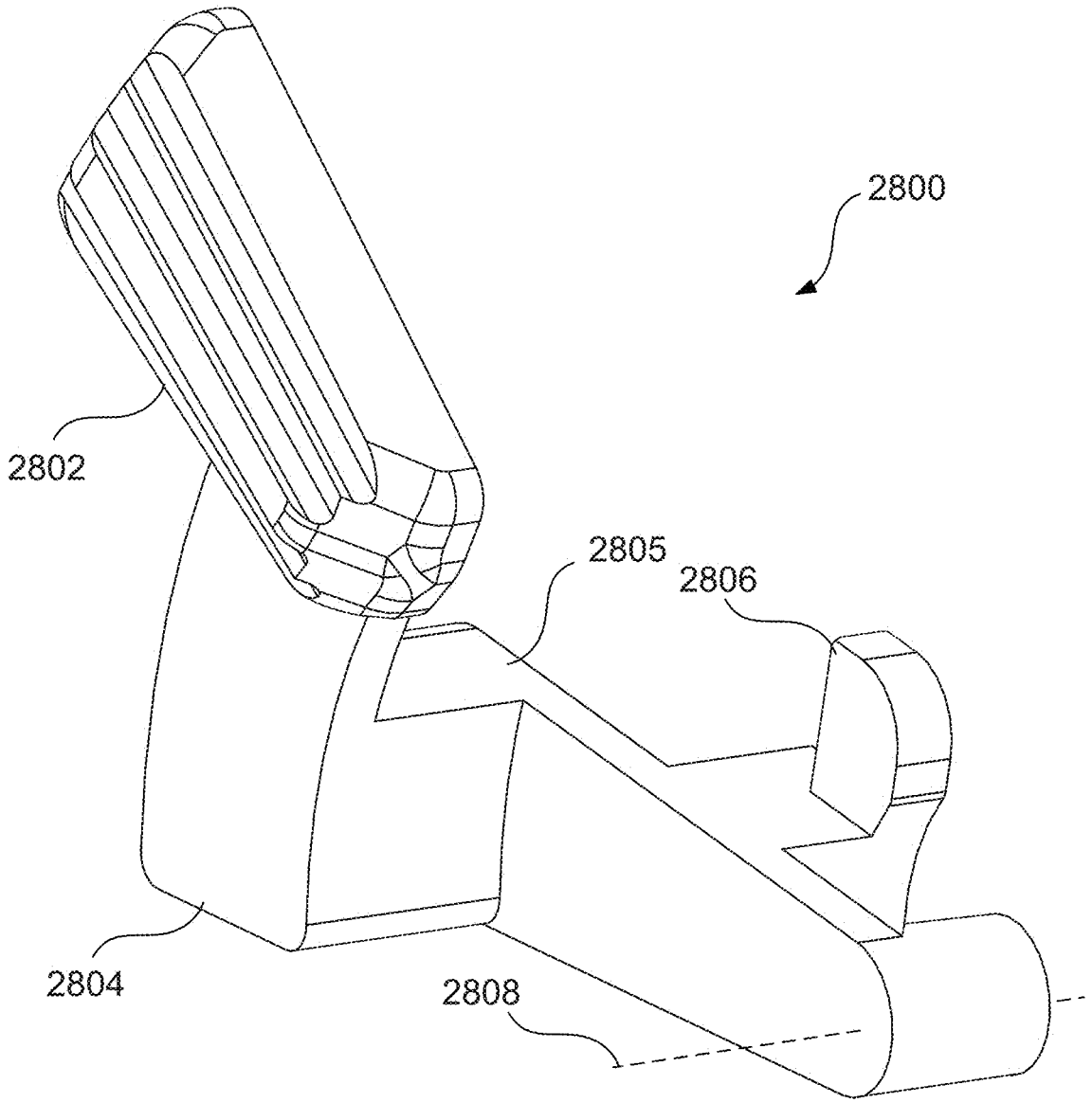
FIG. 28 shows an embodiment of an isolated manual safety for a folding firearm.
Figure 30A:
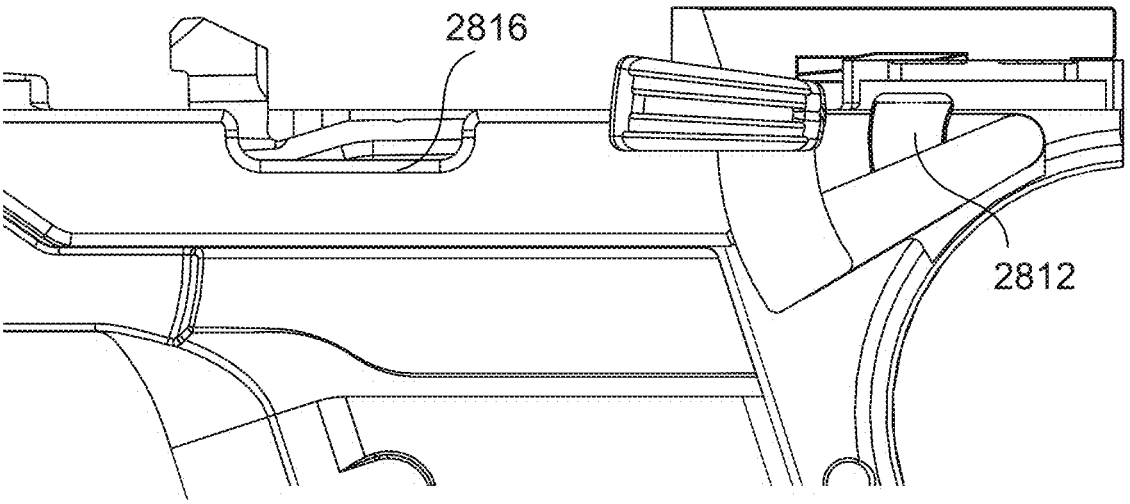
FIG. 30A illustrates the same profile view as FIG. 29A, but with the housing hidden to show the manual safety relative to the frame.
Figure 30B:
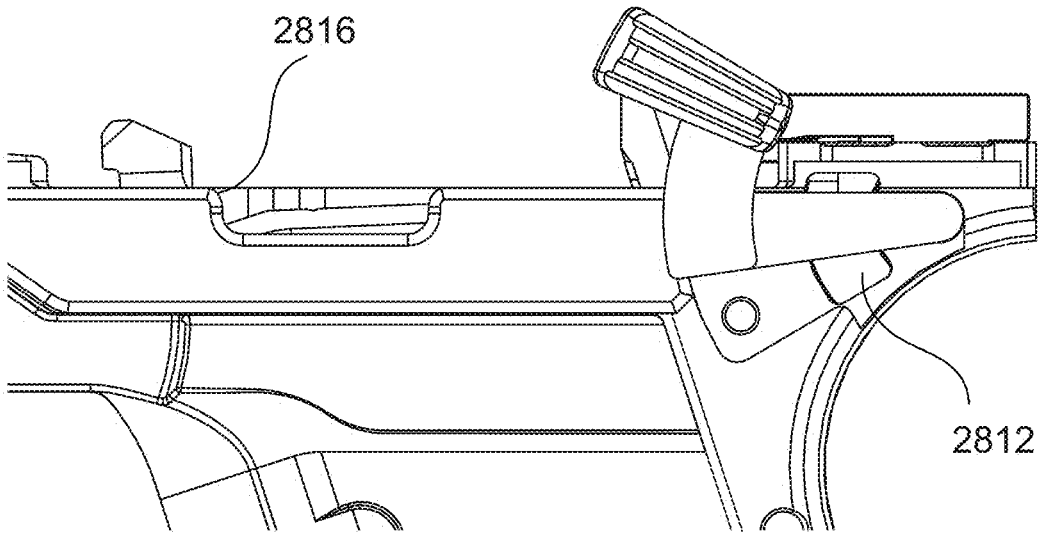
FIG. 30B illustrates the same profile view as FIG. 29B, but with the housing hidden to show the manual safety relative to the frame.
Figure 31A:
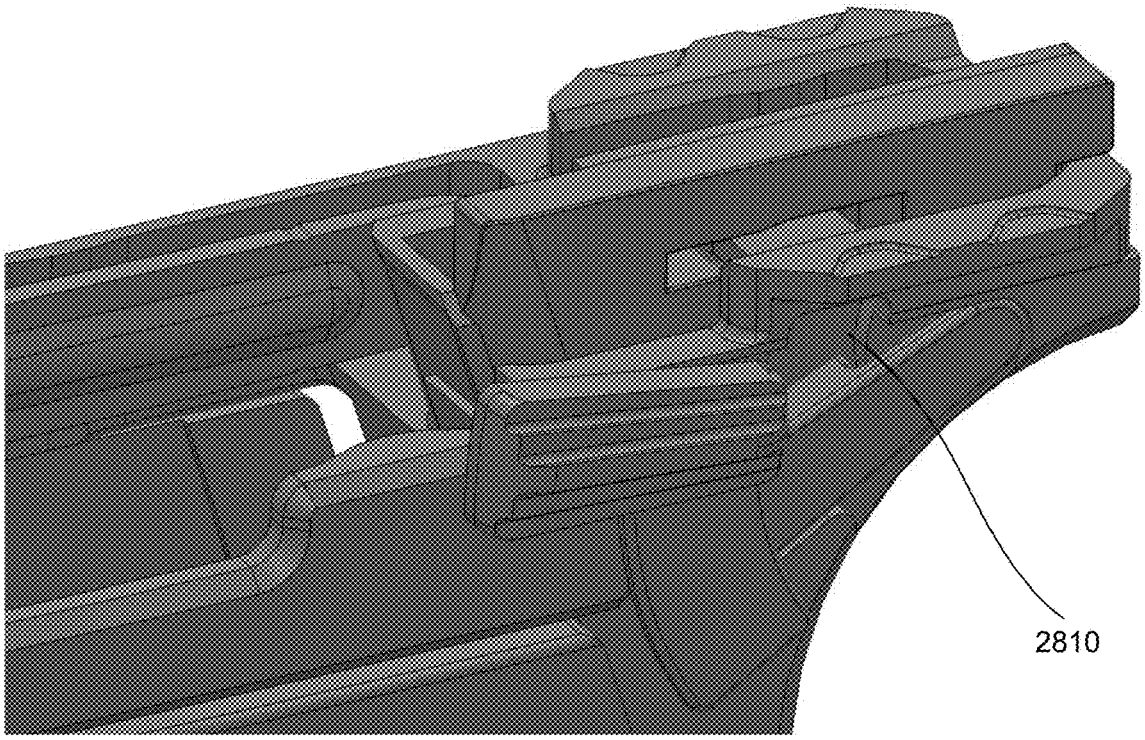
FIG. 31A shows an alternative view of the manual safety shown in FIG. 28.
Figure 31B:
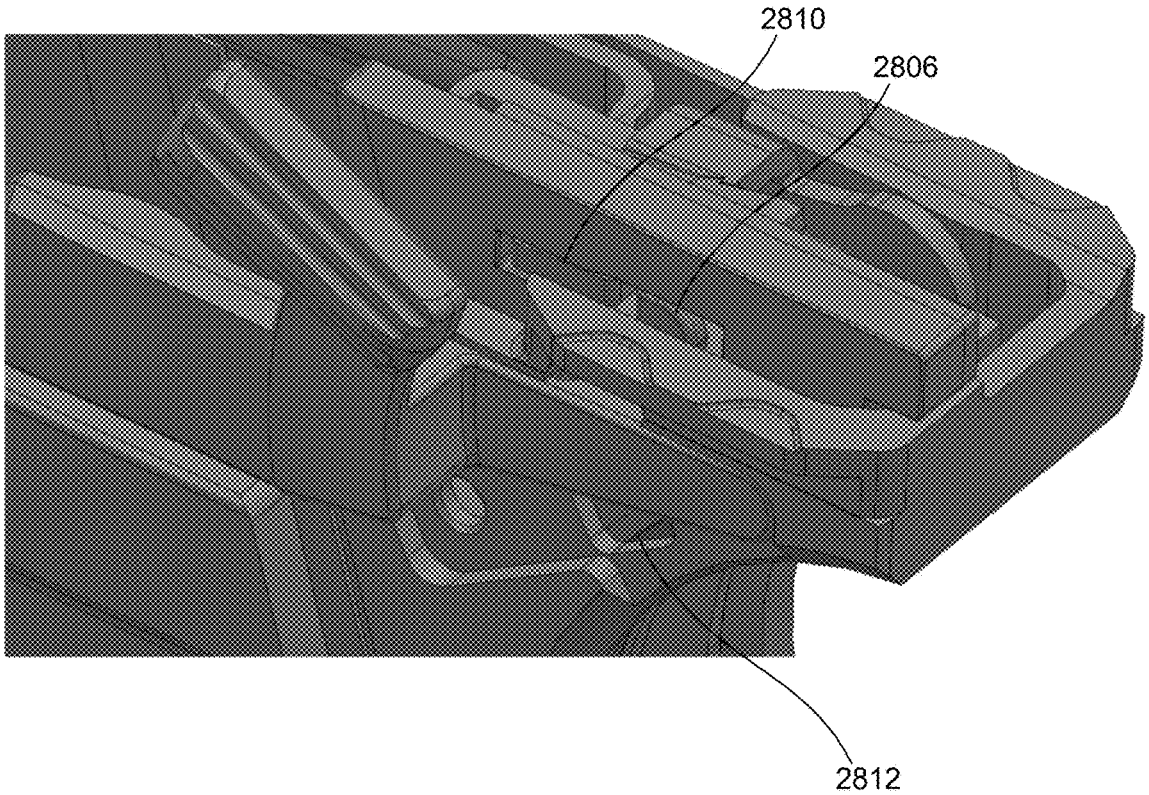
FIG. 31B shows another alternative view of the manual safety shown in FIG. 28.
Figure 32A:
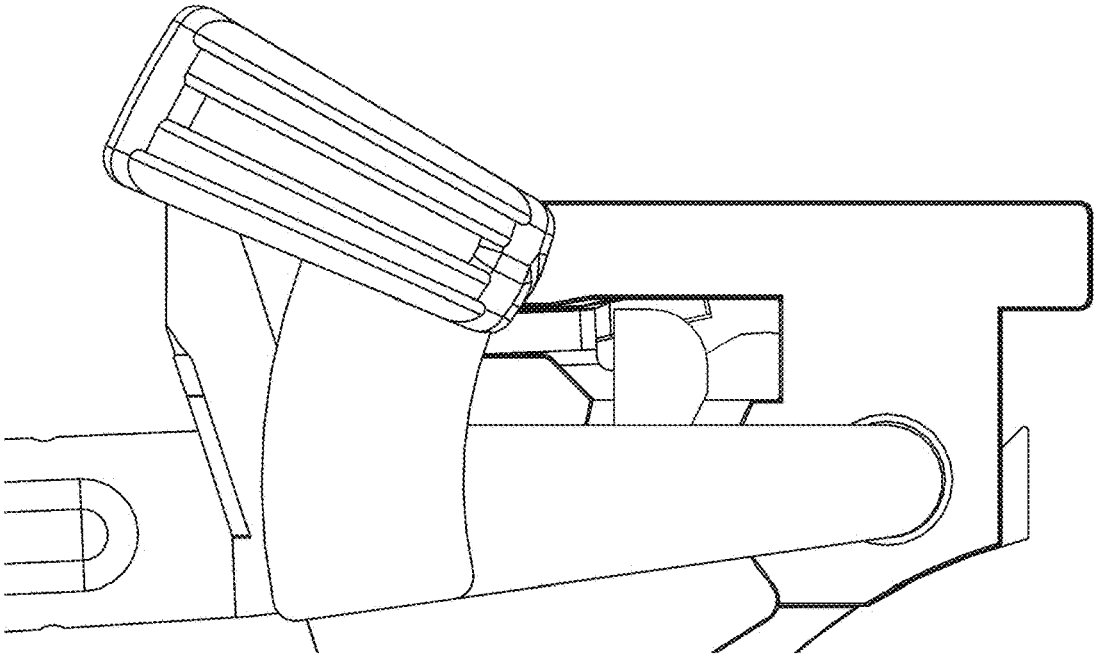
FIG. 32A shows another view of the manual safety in the safe state.
Figure 32B:
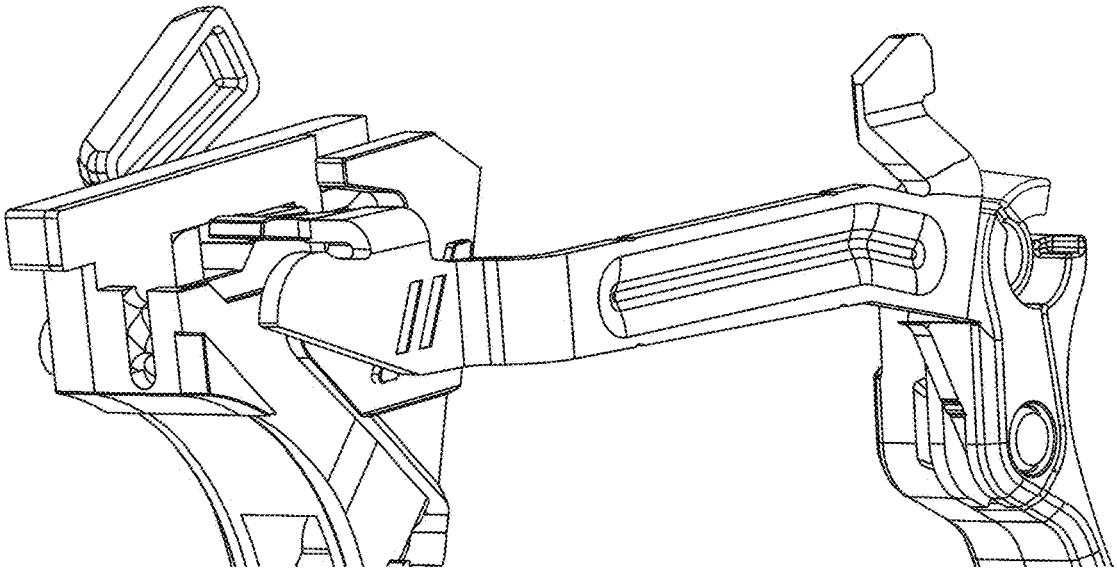
FIG. 32B shows another view of the manual safety, trigger bar, and two-part folding trigger in the safe state.

FIG. 28 shows an embodiment of an isolated manual safety for a folding firearm. The manual safety 2800 includes a safety interface 2802 that a user can bias to toggle between safe and fire modes. The safety interface 2802 can be exposed to an outside of a housing of the firearm and thus be accessible to the user, while other portions of the manual safety 2800 may be arranged within the housing. The safety interface 2802 can extend from a top and side of an optionally curved arm 2804 that is coupled to a trigger bar stop 2806. The trigger bar stop 2806 can extend upward from the manual safety 2800. When the safety interface 2802 is toggled, the manual safety 2800 can rotate around a pivot axis 2808. When the manual safety 2800 is in a safe mode (see FIGS. 29B, 30B, 31A, 31B, 32A, and 32B), the trigger bar stop 2806 can be rotated upward, and when the manual safety 2800 is in a fire mode (see FIGS. 29A, 30A, and 31A), the trigger bar stop 2806 can be rotated downward. FIGS. 31A and 31B show alternative views of the manual safety 2800 interfacing with the trigger bar. In particular, FIG. 31B shows the manual safety 2800 in a safe position, rotated upward, and the trigger bar stop 2806 blocking rearward movement of the trigger bar 2810. The curved arm 2804 is coupled to the trigger bar stop 2806 by at least a coupling portion 2805. The frame of the firearm can include a slot 2812 (e.g., a curved slot) through which the coupling portion 2805 can pass, for instance, as seen in FIG. 31.

FIG. 29 illustrates the safe and fire states of the manual safety 2800 with a housing 2814 visible, and the frame not visible but arranged between two opposing sides of the housing 2814.

FIG. 30 illustrates the same profile view as FIG. 29, but with the housing 2814 hidden to show the manual safety 2800 relative to the frame 2816.

Figure 39C:
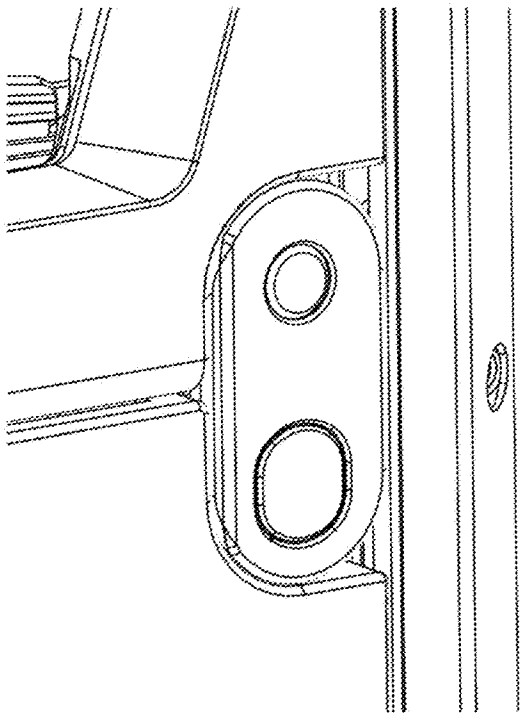
FIG. 39C illustrates the safety cover hinge of FIG. 39A in a folded state of the folding firearm.
Figure 39B:
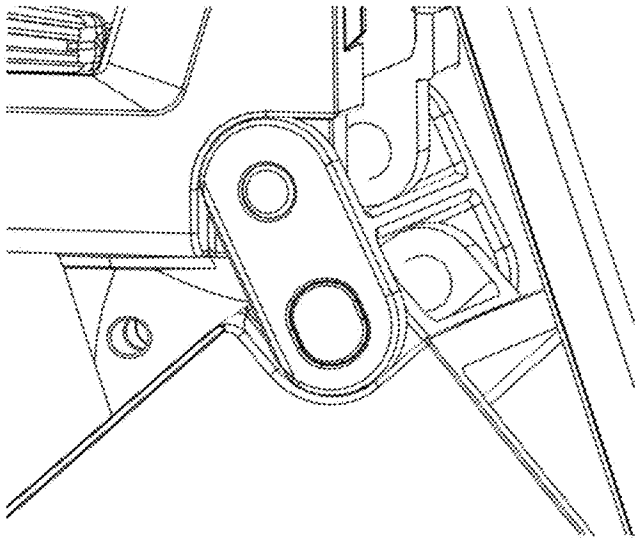
FIG. 39B illustrates the safety cover hinge of FIG. 39A during folding of the folding firearm.
Figure 39A:
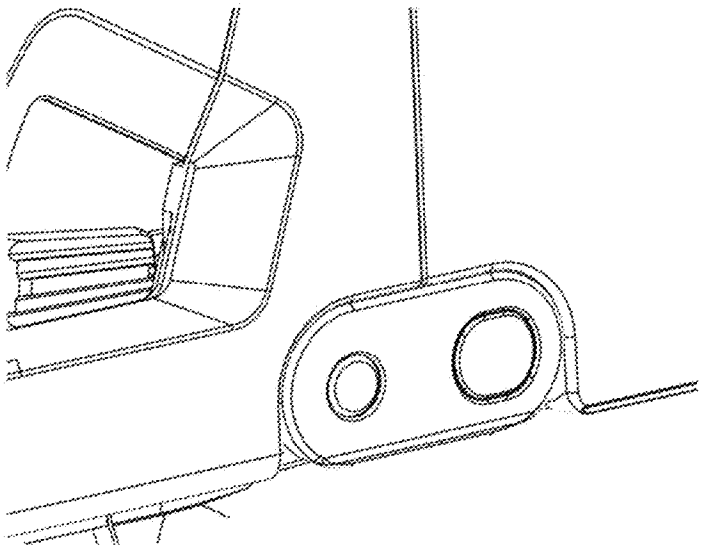
FIG. 39A illustrates an embodiment of a left side view of a safety cover hinge for a folding firearm.
Figure 40:
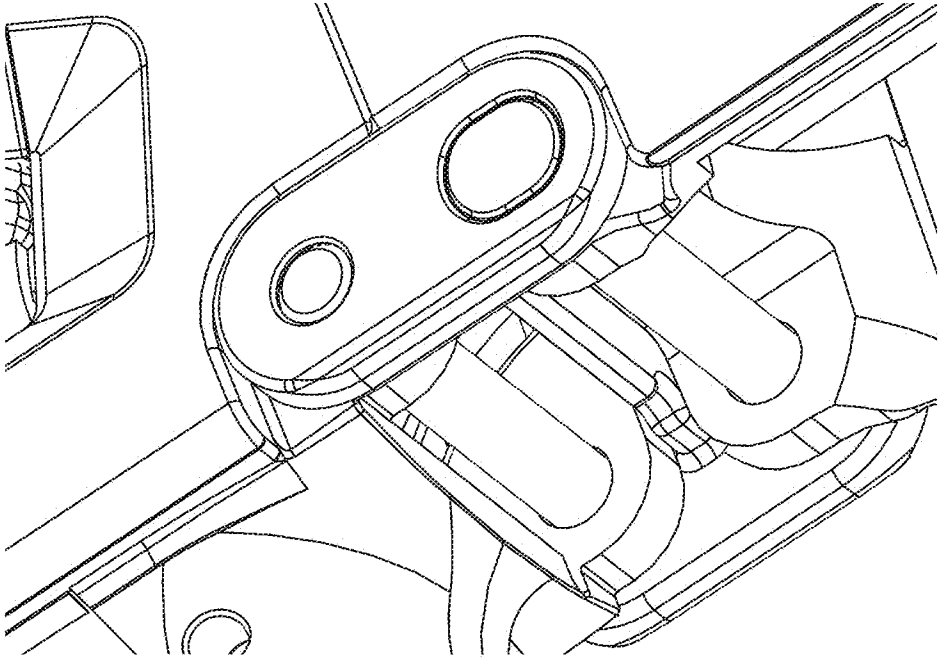
FIG. 40 illustrates a bottom left rear side view of the safety cover hinge of FIG. 39.
Figure 41:
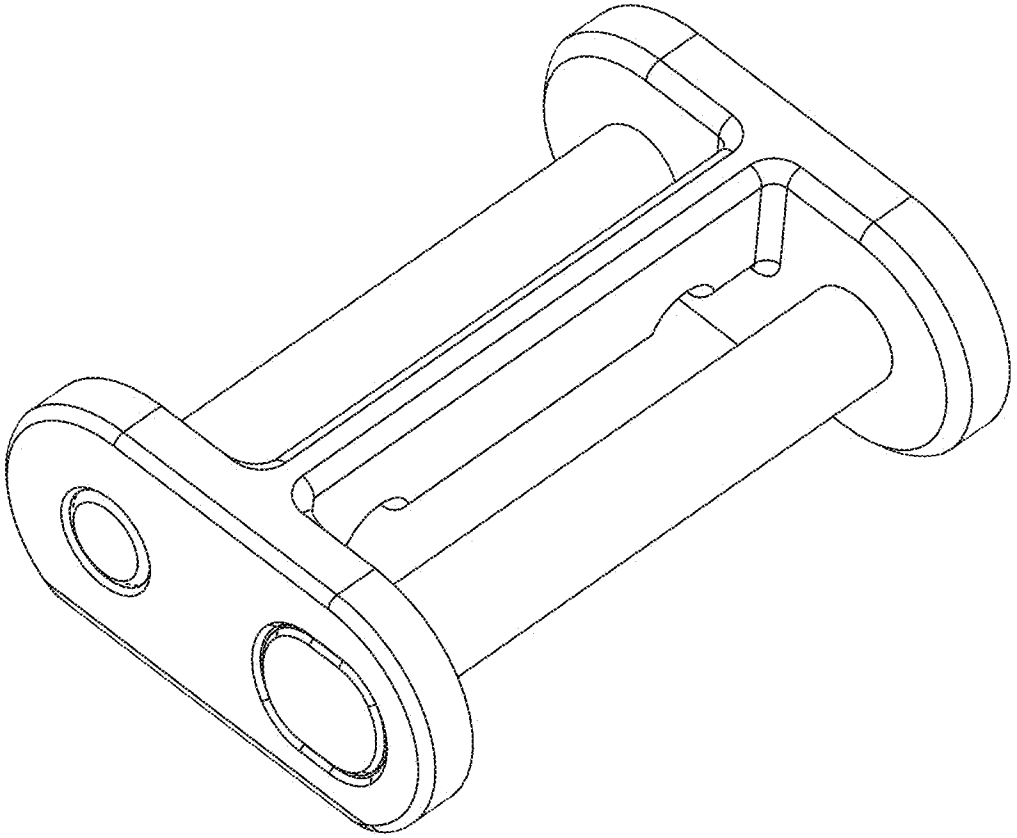
FIG. 41 illustrates the safety cover hinge of FIG. 39 in isolation.

FIGS. 39-41 illustrate an embodiment of a hinge for the safety cover of a folding firearm. The hinge comprises two pins each aligned with a distinct pivot axis, thus allowing a more compact folding of the safety cover under the housing of the folding firearm. Further, in an embodiment, each of these pins can include a resistance or spring force that provides a torque to help or retard rotation about one of the pivot axes, and these resistances or spring forces can be different from each other.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A folding firearm comprising:

a frame comprising a trigger and a fixed rear part extending downward from an axis parallel to a slide direction of a slide of the folding firearm;

a foldable grip that rotatably separates from the fixed rear part along a breakaway interface when the folding firearm is folded, and is configured to fold around a first pivot axis that is forward of a front surface of the foldable grip when in a deployed state, the foldable grip further having a grip trigger contact region proximal a top of the front surface;

a foldable trigger guard comprising a front leg, a bottom leg, and a folded and a deployed state, the front leg and the bottom leg being oblique to each other in the deployed state, the bottom leg rotatably coupling to the foldable grip via a second pivot axis, the front leg and the bottom leg rotatably coupling via a third pivot axis; and the trigger configured to fold forward and split into a rear part and a forward part when the foldable grip biases the trigger forward, the trigger rotating about a fourth pivot axis.

2. The folding firearm of claim 1, wherein the first pivot axis is forward of the fourth pivot axis.

3. The folding firearm of claim 2, wherein the first pivot axis is arranged higher than the fourth pivot axis.

4. The folding firearm of claim 1, wherein the first pivot axis and the fourth pivot axis are the same.

5. The folding firearm of claim 1, further comprising a housing coupled to the frame.

6. The folding firearm of claim 5, wherein the front leg folds up into a channel in the housing and the bottom leg folds up below the front leg and below the housing.

7. The folding firearm of claim 5, wherein the front leg pivots about pins that extend outward from the front leg and wherein the pins are arranged through at least a part of the housing.

8. The folding firearm of claim 5, further comprising pins that extend outward from the front leg and into the housing and are aligned with a fifth pivot axis through the housing.

9. The folding firearm of claim 1, wherein the rear part of the trigger is coupled to a trigger bar.

10. The folding firearm of claim 9, wherein at least a portion of the trigger decouples from the trigger bar when the folding firearm is folded.

11. The folding firearm of claim 1, wherein the foldable grip comprises a locking arm that extends substantially upward from a back portion of the foldable grip and locks into the fixed rear part of the frame when the folding firearm is in the deployed state.

12. The folding firearm of claim 1, wherein the foldable grip comprises two extensions between a body of the foldable grip and the first pivot axis, wherein the frame includes recesses on outer sides of the frame shaped to allow rotation of the two extensions and wherein a first width between outer faces of the two extensions is substantially equal to a second width of the frame proximal the two extensions.

13. A folding firearm comprising:

a frame comprising a trigger and a fixed rear part extending downward from an axis parallel to a slide direction of a slide of the folding firearm;

a foldable grip that rotatably separates from the fixed rear part along a breakaway interface when the folding firearm is folded, and is configured to fold around a first pivot axis that is forward of a front surface of the foldable grip when in a deployed state;

a foldable trigger guard comprising a front leg, a bottom leg, and a folded and a deployed state, the front leg and the bottom leg being oblique to each other in the deployed state, the bottom leg rotatably coupling to the foldable grip via a second pivot axis, the front leg and the bottom leg rotatably coupling via a third pivot axis; and the trigger configured to fold forward and split into a rear part and a forward part when the foldable grip biases the trigger forward, the trigger rotating about the first pivot axis.

14. The folding firearm of claim 13, further comprising a housing coupled to the frame, and wherein the front leg folds up into a channel in a bottom of the housing and the bottom leg folds up below the front leg and below the housing.

15. The folding firearm of claim 14, wherein the front leg pivots about pins that extend outward from the front leg and wherein the pins are arranged through at least a part of the housing.

16. A folding firearm comprising:

a frame comprising a trigger and a fixed rear part extending downward from an axis parallel to a slide direction of a slide of the folding firearm;

a foldable grip that rotatably separates from the fixed rear part along a breakaway interface when the folding firearm is folded, and is configured to fold around a first pivot axis that is forward of a front surface of the foldable grip when in a deployed state;

a foldable trigger guard comprising a front leg, a bottom leg, and a folded and a deployed state, the front leg and the bottom leg being oblique to each other in the deployed state, the bottom leg rotatably coupling to the foldable grip via a second pivot axis, the front leg and the bottom leg rotatably coupling via a third pivot axis, wherein the front leg pivots about pins that extend outward from the front leg and wherein the pins are arranged through at least a part of the frame; and the trigger configured to fold forward and separate from a trigger bar when the foldable grip biases the trigger forward, the trigger rotating about a fourth pivot axis.

17. The folding firearm of claim 16, wherein the first and the fourth pivot axes are the same.

18. The folding firearm of claim 16, further comprising a housing coupled to the frame.

* * * * *